US008274456B2

(12) United States Patent
Hayakawa et al.

(10) Patent No.: US 8,274,456 B2
(45) Date of Patent: Sep. 25, 2012

(54) DISPLAY DEVICE AND DRIVING METHOD OF THE SAME, AND ELECTRONIC APPARATUS

(75) Inventors: Masahiko Hayakawa, Kanagawa (JP); Yu Kojima, Kanagawa (JP); Yukari Ando, Gifu (JP); Keisuke Miyagawa, Kanagawa (JP); Jun Koyama, Kanagawa (JP); Mitsuaki Osame, Kanagawa (JP); Aya Anzai, Kanagawa (JP); Shunpei Yamazaki, Tokyo (JP); Satoshi Seo, Kanagawa (JP); Hiroko Abe, Tokyo (JP); Hajime Kimura, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 0 days.

(21) Appl. No.: 13/190,598

(22) Filed: Jul. 26, 2011

(65) Prior Publication Data

US 2011/0279441 A1 Nov. 17, 2011

Related U.S. Application Data

(62) Division of application No. 11/151,702, filed on Jun. 14, 2005, now Pat. No. 8,013,809.

(30) Foreign Application Priority Data

Jun. 29, 2004 (JP) ..... 2004-192256

(51) Int. Cl.
*G09G 3/36* (2006.01)

(52) U.S. Cl. ..... 345/76; 345/77

(58) Field of Classification Search ..... 345/76–79, 345/87–100, 204, 211
See application file for complete search history.

(56) References Cited

U.S. PATENT DOCUMENTS

| | | | |
|---|---|---|---|
| 5,594,463 | A | 1/1997 | Sakamoto |
| 6,335,713 | B1 | 1/2002 | Imai |
| 6,473,064 | B1 | 10/2002 | Tsuchida et al. |
| 6,528,951 | B2 | 3/2003 | Yamazaki et al. |
| 6,617,801 | B2 | 9/2003 | Ishizuka et al. |

(Continued)

FOREIGN PATENT DOCUMENTS

CN 1329368 A 1/2002

(Continued)

OTHER PUBLICATIONS

R. M. A. Dawson et al., "Design of an Improved Pixel for a Polysilicon Active-Matrix Organic LED Display," SID Digest '98: SID International Symposium Digest of Technical Papers, vol. XXIX, May 17, 1998, pp. 11-14.

(Continued)

*Primary Examiner* — Nitin Patel
(74) *Attorney, Agent, or Firm* — Fish & Richardson P.C.

(57) ABSTRACT

The brightness of a light emitting element varies when changes in ambient temperature or changes with time occur. In view of this, the invention provides a display device where the influence of variations in the current value of the light emitting element due to changes in ambient temperature and changes with time can be suppressed. The display device of the invention includes a monitoring element that is driven with a constant current, and a voltage applied to the monitoring element is detected and inputted to a light emitting element. In other words, the monitoring element is driven with a low current, and a voltage applied to the monitoring element is inputted to the light emitting element such that the light emitting element is driven with a constant current.

19 Claims, 37 Drawing Sheets

U.S. PATENT DOCUMENTS

| | | | | |
|---|---|---|---|---|
| 6,680,719 | B2 | 1/2004 | Tsuchida et al. | |
| 7,215,307 | B2 | 5/2007 | Ochi et al. | |
| 7,221,338 | B2 | 5/2007 | Yamazaki et al. | |
| 7,233,302 | B2 | 6/2007 | Ishizuka | |
| 7,298,347 | B2 | 11/2007 | Yamazaki et al. | |
| 7,319,444 | B2 | 1/2008 | Jo | |
| 7,528,810 | B2 * | 5/2009 | Ohshima et al. | 345/77 |
| 7,605,783 | B2 * | 10/2009 | Tseng et al. | 345/82 |
| 7,623,098 | B2 | 11/2009 | Yamazaki et al. | |
| 7,623,099 | B2 | 11/2009 | Yamazaki et al. | |
| 7,623,100 | B2 | 11/2009 | Yamazaki et al. | |
| 8,013,809 | B2 * | 9/2011 | Hayakawa et al. | 345/76 |
| 2001/0030511 | A1 | 10/2001 | Yamazaki et al. | |
| 2001/0033252 | A1 | 10/2001 | Yamazaki et al. | |
| 2001/0038367 | A1 * | 11/2001 | Inukai | 345/76 |
| 2002/0101395 | A1 | 8/2002 | Inukai | |
| 2002/0180721 | A1 | 12/2002 | Kimura et al. | |
| 2003/0063081 | A1 | 4/2003 | Kimura et al. | |
| 2003/0132716 | A1 | 7/2003 | Yamazaki et al. | |
| 2004/0232952 | A1 | 11/2004 | Kimura et al. | |
| 2005/0012731 | A1 | 1/2005 | Yamazaki et al. | |
| 2005/0017963 | A1 | 1/2005 | Yamazaki et al. | |
| 2005/0017964 | A1 | 1/2005 | Yamazaki et al. | |
| 2009/0153449 | A1 * | 6/2009 | Kaneko et al. | 345/82 |
| 2010/0045578 | A1 * | 2/2010 | Yamazaki et al. | 345/76 |
| 2011/0140997 | A1 * | 6/2011 | Yamazaki et al. | 345/76 |

FOREIGN PATENT DOCUMENTS

| | | | |
|---|---|---|---|
| EP | 0923067 | A1 | 6/1999 |
| EP | 1079361 | A | 2/2001 |
| EP | 1148466 | A2 | 10/2001 |
| EP | 1168291 | A2 | 1/2002 |
| EP | 1318499 | A2 | 6/2003 |
| EP | 1355289 | A2 | 10/2003 |
| EP | 2242038 | A1 | 10/2010 |
| JP | 05-094151 | A | 4/1993 |
| JP | 07-036410 | A | 2/1995 |
| JP | 11231834 | A | 8/1999 |
| JP | 11-272223 | A | 10/1999 |
| JP | 11-273856 | A | 10/1999 |
| JP | 2001056661 | A | 2/2001 |
| JP | 2001-109433 | A | 4/2001 |
| JP | 2001236040 | A | 8/2001 |
| JP | 2001306031 | A | 11/2001 |
| JP | 2002333861 | A | 11/2002 |
| JP | 2002351399 | A | 12/2002 |
| JP | 2003031358 | A | 1/2003 |
| JP | 2003162255 | A | 6/2003 |
| JP | 2003233342 | A | 8/2003 |
| JP | 2004004759 | A | 1/2004 |
| JP | 2004085751 | A | 3/2004 |
| JP | 2004302485 | A | 10/2004 |
| WO | WO 98/40871 | | 9/1998 |
| WO | WO 98/40871 | A1 | 9/1998 |
| WO | WO 01/27910 | A1 | 4/2001 |

OTHER PUBLICATIONS

M. Mizukami et al., "6-Bit Digital VGA OLED," SID Digest '00, SID International Symposium Digest of Technical Papers, vol. XXXI, May 16, 2000, pp. 912-915.

Office Action (CN Application No. 200510081154.9) dated Jun. 6, 2008 (19 pages), with English translation.

Office Action (CN Application No. 200510081154.9) dated Jun. 6, 2008 (19 pages).

* cited by examiner

DISPLAY DEVICE AND DRIVING METHOD OF THE SAME, AND ELECTRONIC APPARATUS

CROSS-REFERENCE TO RELATED APPLICATIONS

This application is a divisional of U.S. application Ser. No. 11/151,702, filed Jun. 14, 2005, now allowed, which claims the benefit of a foreign priority application filed in Japan as Serial No. 2004-192256 on Jun. 29, 2004, both of which are incorporated by reference.

BACKGROUND OF THE INVENTION

1. Field of the Invention

The present invention relates to a passive matrix display device. In particular, the invention relates to a passive matrix display device using a light emitting element such as an organic electroluminescence element for a pixel portion.

2. Description of the Related Art

In recent years, a so-called self-light emitting type display device having a pixel including a light emitting element such as a light emitting diode (LED) has attracted attention. As a light emitting element used for such a self-light emitting type display device, there are known an organic light emitting diode (OLED), an organic EL element, and an electroluminescence (EL) element, which are used for an organic EL display and the like.

Since a light emitting element such as an OLED is a self-light emitting type, it is more advantageous than a liquid crystal display in high visibility of pixel, fast response without requiring a back light, and the like. The brightness of a light emitting element is controlled by the amount of current flowing therethrough.

A display device using such a self-luminous light emitting type element is driven by a passive matrix method or an active matrix method. According to the active matrix method, each pixel includes a control circuit having several switching thin film transistors (also referred to as TFTs) and light emission or non-light emission of each pixel is controlled by the control circuit of each pixel. On the other hand, in a passive matrix display device, plural column signal lines and plural row signal lines intersect each other and an organic EL element is disposed at each intersection thereof. Accordingly, a potential difference is generated in an area sandwiched between a selected row signal line and a column signal line that outputs a signal, thereby an organic EL element (called a pixel) emits light when a current flows.

SUMMARY OF THE INVENTION

The light emitting element has the characteristic that its resistance (internal resistance) varies with the surrounding temperature (hereinafter referred to as the ambient temperature). Specifically, provided that room temperature is a normal temperature, the resistance decreases when the temperature is higher than normal, while the resistance increases when the temperature is lower than normal. Accordingly, in a constant voltage drive, when the temperature rises, the current value increases and brightness higher than required is obtained. Meanwhile, when the temperature falls, the current value decreases and brightness lower than required is obtained. The light emitting element also has the characteristic that its current value decreases with time.

The aforementioned characteristics of the light emitting element cause variations in brightness when the ambient temperature changes or changes with time occur. In view of the foregoing, the invention provides a display device with a constant voltage drive, where the influence of variations in the current value of the light emitting element due to changes in ambient temperature and changes with time can be suppressed.

According to a structure of the invention, a display device includes a column signal line, a row signal line, a light emitting element whose layer containing an organic compound is formed in an area sandwiched between the column signal line and the row signal line, a monitoring element formed in an area sandwiched between a first electrode and a second electrode, a current source, and an amplifier. The fist electrode of the monitoring element is connected to the current source, the first electrode of the monitoring element is connected to an input terminal of the amplifier, and an output of the amplifier is inputted to the column signal line.

According to another structure of the invention, a display device includes a column signal line, a row signal line, a light emitting element whose layer containing an organic compound is formed in an area sandwiched between the column signal line and the row signal line, a plurality of monitoring elements each formed in an area sandwiched between a first electrode and a second electrode, a current source, and an amplifier. The first electrode of each of the monitoring elements is connected to the current source, the first electrode of each of the monitoring elements is connected to an input terminal of the amplifier, and an output of the amplifier is inputted to the column signal line.

According to another structure of the invention, a display device includes a column signal line, a row signal line, a light emitting element whose layer containing an organic compound is formed in an area sandwiched between the column signal line and the row signal line, a monitoring element formed in an area sandwiched between a first electrode and the row signal line, a current source, and an amplifier. The first electrode of the monitoring element is connected to the current source, the first electrode of the monitoring element is connected to an input terminal of the amplifier, and an output of the amplifier is inputted to the column signal line.

According to another structure of the invention, a display device includes a column signal line, a row signal line, a light emitting element whose layer containing an organic compound is formed in an area sandwiched between the column signal line and the row signal line, a plurality of monitoring elements each formed in an area sandwiched between a first electrode and the row signal line, a current source, and an amplifier. The first electrode of each of the monitoring elements is connected to the current source, the first electrode of each of the monitoring elements is connected to an input terminal of the amplifier, and an output of the amplifier is inputted to the column signal line.

According to another structure of the invention, a display device includes a column signal line, a row signal line, a light emitting element sandwiched between the column signal line and the row signal line, a monitoring element, and a current source for supplying a constant current to the monitoring element. The monitoring element is driven by a constant current from the current source, and a voltage applied between two electrodes of the monitoring element is detected and inputted to the light emitting element.

According to another structure of the invention, a display device includes a column signal line, a row signal line, a light emitting element sandwiched between the column signal line and the row signal line, a monitoring element, and a current source for supplying a constant current to the monitoring element. The monitoring element is driven by a constant current from the current source, and the potential of an anode of the monitoring element is detected and inputted to the column signal line.

According to another structure of the invention, a display device includes a column signal line, a row signal line, a light emitting element sandwiched between the column signal line and the row signal line, a monitoring element, a current source for supplying a constant current to the monitoring element, and an amplifier. The monitoring element is driven by a constant current from the current source, the potential of an anode of the monitoring element is detected by the amplifier, and the detected potential is inputted to the column signal line.

According to another structure of the invention, a display device includes a column signal line, a row signal line, a light emitting element sandwiched between the column signal line and the row signal line, a monitoring element, a current source for supplying a constant current to the monitoring element, a capacitor for holding a voltage between two electrodes of the monitoring element, a first switch for turning on/off the connection between the capacitor and the current source, a second switch for turning on/off the connection between the current source and the monitoring element, and an amplifier. The monitoring element is driven by a constant current from the current source, the potential of an anode of the monitoring element is detected by the amplifier, and the detected potential is inputted to the column signal line.

In the display device having any one of the aforementioned structures, the monitoring element and the light emitting element are formed over the same substrate.

The invention provides an electronic apparatus that includes a display portion using the display device having any one of the aforementioned structures.

The invention provides a driving method of a display device including a column signal line, a row signal line, a light emitting element sandwiched between the column signal line and the row signal line, and a monitoring element. The driving method includes the steps of driving the monitoring element by a constant current, detecting a voltage applied between two electrodes of the monitoring element, and inputting the detected voltage to the light emitting element.

The invention provides another driving method of a display device including a column signal line, a row signal line, a light emitting element sandwiched between the column signal line and the row signal line, a monitoring element, and a current source for supplying a constant current to the monitoring element. The driving method includes the steps of driving the monitoring element by a constant current from the current source, detecting the potential of an anode of the monitoring element, and inputting the detected potential to the light emitting element.

The invention provides another driving method of a display device including a column signal line, a row signal line, a light emitting element sandwiched between the column signal line and the row signal line, a monitoring element, a current source for supplying a constant current to the monitoring element, and an amplifier. The driving method includes the steps of driving the monitoring element by a constant current from the current source, detecting the potential of an anode of the monitoring element by the amplifier, and inputting the detected potential to the column signal line.

The invention provides another driving method of a display device including a column signal line, a row signal line, a light emitting element sandwiched between the column signal line and the row signal line, a monitoring element, a current source for supplying a constant current to the monitoring element, a capacitor for holding a voltage between two electrodes of the monitoring element, a first switch for turning on/off the connection between the capacitor and the current source, a second switch for turning on/off the connection between the current source and the monitoring element, and an amplifier. The driving method includes the steps of driving the monitoring element by a constant current from the constant current source when the first switch and the second switch are turned on, detecting the potential of an anode of the monitoring element by the amplifier, inputting the detected potential to the column signal line, holding in the capacitor the potential of the anode of the monitoring element at the moment when the first switch and the second switch are turned off, detecting the potential held in the capacitor by the amplifier, and inputting the detected potential to the column signal line.

According to the aforementioned driving method of a display device, a period to supply a current to the monitoring element is 30% of a period during which the display device displays images.

According to the aforementioned driving method of a display device, the period to supply a current to the monitoring element is determined to satisfy $g(Q_p)/g(Q_m)=\exp[k\cdot t)\beta](g(Q_p)$ is a monotonically decreasing function using the total amount of charge $Q_p$ of the light emitting element as a parameter, $g(Q_m)$ is a monotonically decreasing function using the total amount of charge $Q_m$ of the monitoring element as a parameter, k is a rate constant, β is a parameter representing the initial degradation).

According to the aforementioned driving method of a display device, the first switch and the second switch are formed by using transistors with different conductivity.

According to the aforementioned driving method of a display device, the first switch and the second switch are formed by using transistors with the same conductivity.

The invention provides another driving method of a display device including a column signal line, a row signal line, a light emitting element whose layer containing an organic compound is formed in an area sandwiched between the column signal line and the row signal line, a monitoring element formed in an area sandwiched between a first electrode and a second electrode, a first current source, a second current source, and an amplifier. The driving method includes the steps of supplying a current from the first current source to the monitoring element in a precharge period, such that the potential of the first electrode of the monitoring element is inputted to an input terminal of the amplifier and a potential substantially equal to that of the first electrode of the monitoring element is outputted from an output terminal of the amplifier to the column signal line, and supplying a current from the second current source to the monitoring element in a light emitting period, such that the light emitting element emits light.

The invention provides another driving method of a display device including a column signal line, a row signal line, a light emitting element whose layer containing an organic compound is formed in an area sandwiched between the column signal line and the row signal line, a monitoring element formed in an area sandwiched between a first electrode and a second electrode, a current source, and an amplifier. The driving method includes the steps of supplying a current from the current source to the monitoring element in a precharge period, such that the potential of the first electrode of the monitoring element is inputted to an input terminal of the amplifier and a potential substantially equal to that of the first electrode of the monitoring element is outputted from an output terminal of the amplifier to the column signal line, and supplying a current from the current source to the monitoring element in a light emitting period, such that the light emitting element emits light.

According to the invention, it is possible to suppress brightness unevenness due to variations in the current value of the light emitting element caused by changes in ambient temperature and changes with time.

DETAILED DESCRIPTION OF THE INVENTION

[Embodiment Mode]

Although the invention will be described by way of Embodiment Modes with reference to the accompanying drawings, it is to be understood that various changes and modifications will be apparent to those skilled in the art. Therefore, unless such changes and modifications depart from the scope of the invention, they should be construed as being included therein.

Figure 1:
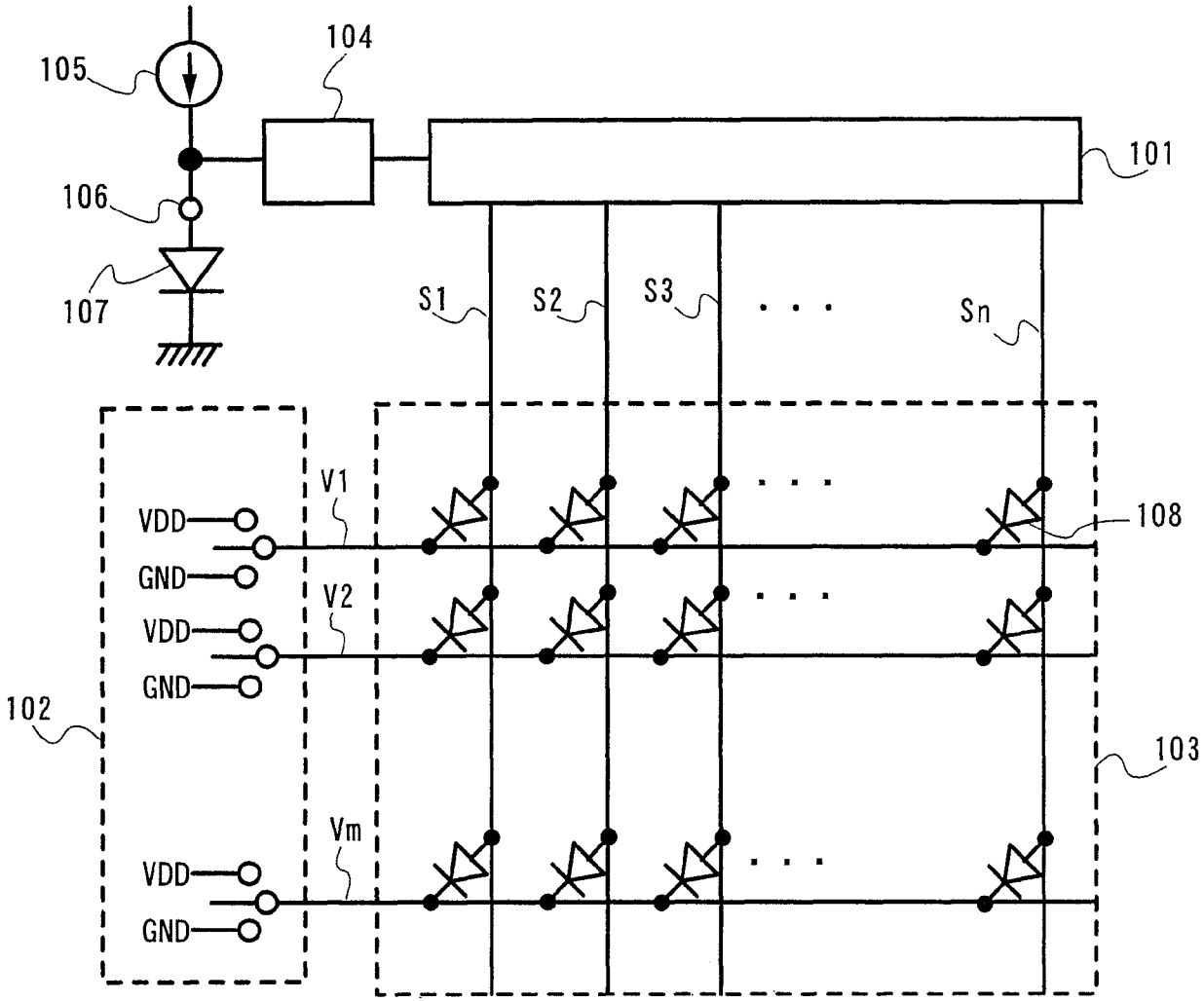
FIG. 1 is a schematic diagram showing a display device of the invention.

The basic principle of temperature and degradation compensation according to the invention is described with reference to FIG. 1. FIG. 1 is a schematic diagram showing a display device having a circuit for compensating temperature and degradation.

The display device of the invention includes a column signal line driver circuit 101, a row signal line driver circuit 102, a pixel portion 103, an amplifier 104, a constant current source 105, and a monitoring element 107. The pixel portion 103 includes a plurality of light emitting elements 108. Note that the monitoring element 107 is formed by a light emitting element having the same I-V characteristics as the light emitting element 108. For example, when an EL element is used for the light emitting element, the monitoring element 107 and the light emitting element 108 are formed by EL elements that are formed under the same conditions using the same EL material. Further, the monitoring element 107 and the light emitting element 108 are preferably formed over the same substrate. The display device of the invention has a temperature and degradation compensation function (hereinafter simply referred to as a compensation function).

The constant current source 105 supplies a constant current to the monitoring element 107. That is, the monitoring element 107 is driven with a constant current, and thus the current value of the monitoring element 107 is always kept constant. When the ambient temperature changes in this state, the resistance of the monitoring element 107 itself changes. When the resistance of the monitoring element 107 changes, the potential difference between two electrodes of the monitoring element 107 changes because of the constant current value of the monitoring element 107. Changes in ambient temperature are detected by detecting changes in the potential difference of the monitoring element 107. More specifically, the potential of the electrode connected to the constant current source 105, namely the potential of an anode 106 in FIG. 1 is detected, because the potential of the other electrode of the monitoring element 107, namely the potential of a cathode in FIG. 1 does not change.

Figure 10:
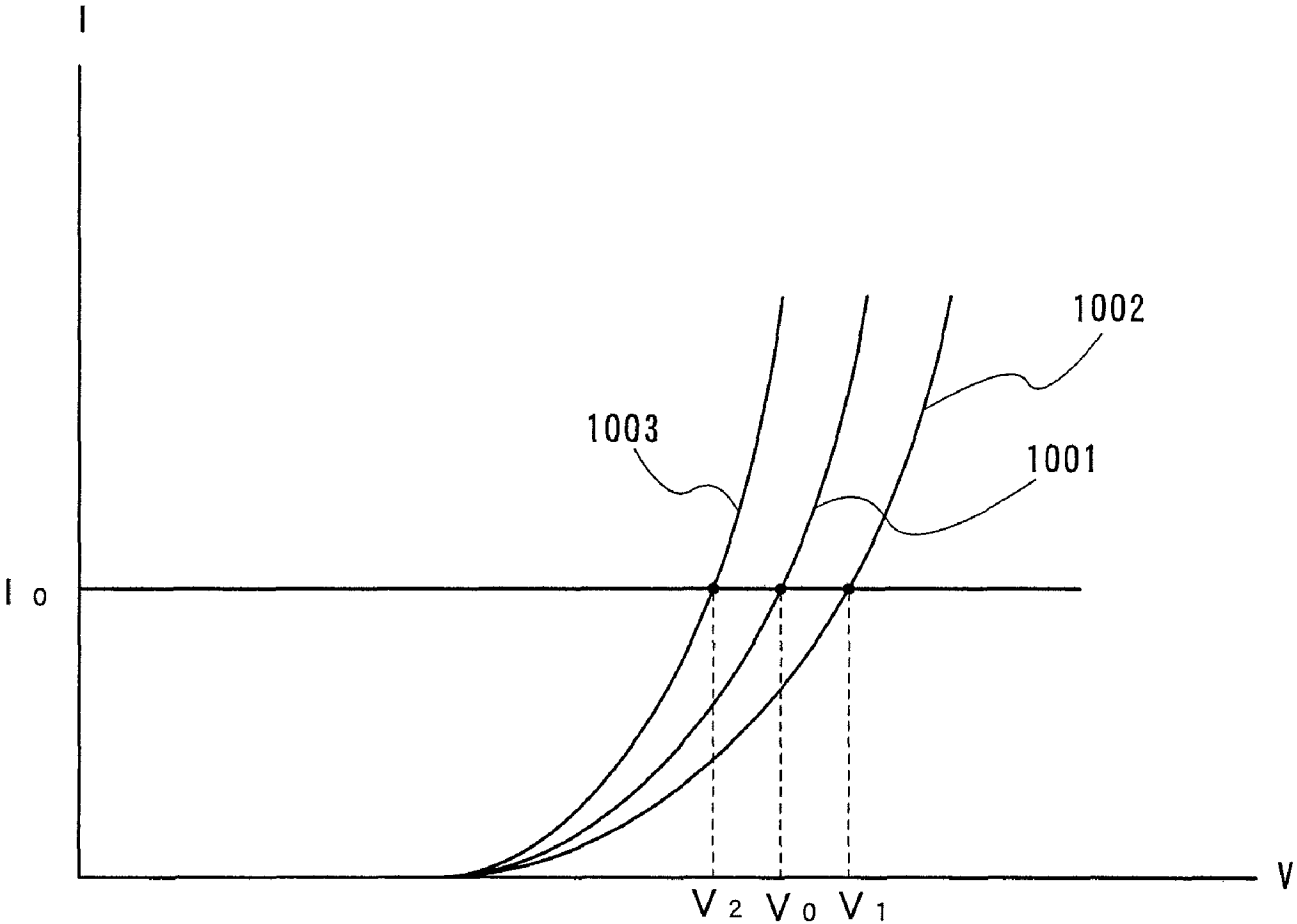
FIG. 10 is a graph showing temperature-dependent I-V characteristics of an EL element.

Temperature-dependent I-V characteristics of the monitoring element 107 are described with reference to FIG. 10. Reference numerals 1001, 1002 and 1003 denote I-V characteristics of the monitoring element 107 at room temperature, low temperature and high temperature respectively. When a current $I_0$ is supplied from the constant current source 105 to the monitoring element 107, a voltage $V_0$ is applied to the monitoring element 107 at room temperature, a voltage $V_1$ is applied at low temperature, and a voltage $V_2$ is applied at high temperature. In other words, when a current $I_0$ is supplied to the monitoring element 107, a voltage drop of $V_0$ occurs at room temperature, a voltage drop of $V_1$ occurs at low temperature, and a voltage drop of $V_2$ occurs at high temperature.

Data on such changes in the voltage of the monitoring element 107 is transferred to the amplifier 104, and the amplifier 104 determines a potential supplied to the light emitting element 108 based on the potential of the anode 106. That is, as shown in FIG. 10, the potential is determined so as to apply a voltage $V_1$ to the light emitting element 108 in the case of low ambient temperature, while the potential is determined so as to apply a voltage $V_2$ to the light emitting element 108 in the case of high ambient temperature. Accordingly, a power supply potential inputted to the light emitting element 108 can be corrected in accordance with changes in ambient temperature. Thus, it is possible to suppress variations in current value due to changes in ambient temperature.

Figure 11:
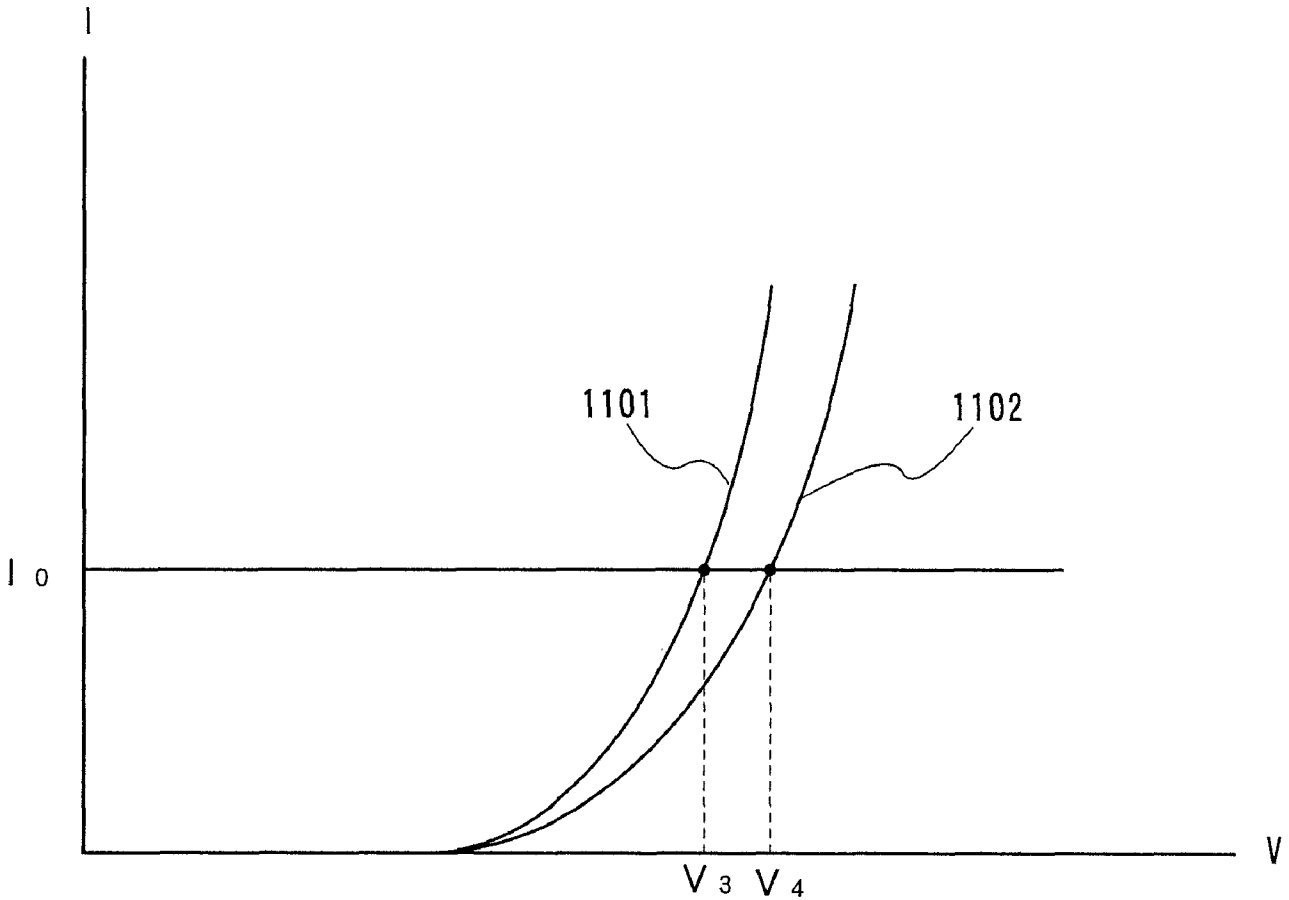
FIG. 11 is a graph of I-V characteristics showing degradation with time of an EL element.

FIG. 11 is a graph of I-V characteristics showing degradation with time of the monitoring element 107. Reference numeral 1101 denotes initial characteristics of the monitoring element 107 and 1102 denotes characteristics thereof after degradation. Note that the initial characteristics and the characteristics after degradation are measured under the same temperature conditions. When a current $I_0$ is supplied to the monitoring element 107, a voltage $V_3$ is applied to the monitoring element 107 in the initial characteristics while a voltage $V_4$ is applied to the monitoring element 107 after degradation. Therefore, when applying the voltage $V_4$ to the light emitting element 108 that degrades similarly, apparent degradation of the light emitting element 108 can be reduced. In this manner, if the monitoring element 107 degrades as well as the light emitting element 108, degradation of the light emitting element 108 can be compensated as well.

A voltage follower circuit using an operational amplifier can be applied to the aforementioned amplifier 104 that determines the potential of the anode of the light emitting element 108 in accordance with changes in the potential of the anode 106 of the monitoring element 107. This is because a non-inverting input terminal of the voltage follower circuit has a high input impedance whereas an output terminal thereof has a low output impedance, thus the input terminal and the output terminal can have the same potential and a current can be supplied from the output terminal while preventing a current of the constant current source 105 from flowing to the voltage follower circuit. It is thus needless to say that other circuits than the voltage follower circuit may also be applied as long as they have such a function.

In this mariner, the potential of the anode of the light emitting element 108 is determined and outputted to column signal lines S1 to Sn. Then, a bias voltage is applied to a pixel at an intersection of a row signal line selected from row signal lines V1 to Vm (a row signal line connected to GND in FIG. 1) and each of the column signal lines S1 to Sn, thereby a current flows therethrough and the light emitting element 108 emits light. Note that a row signal line that is not selected means a row signal line connected to VDD such that the light emitting element 108 is not supplied with current (or does not emit light).

Figure 13:
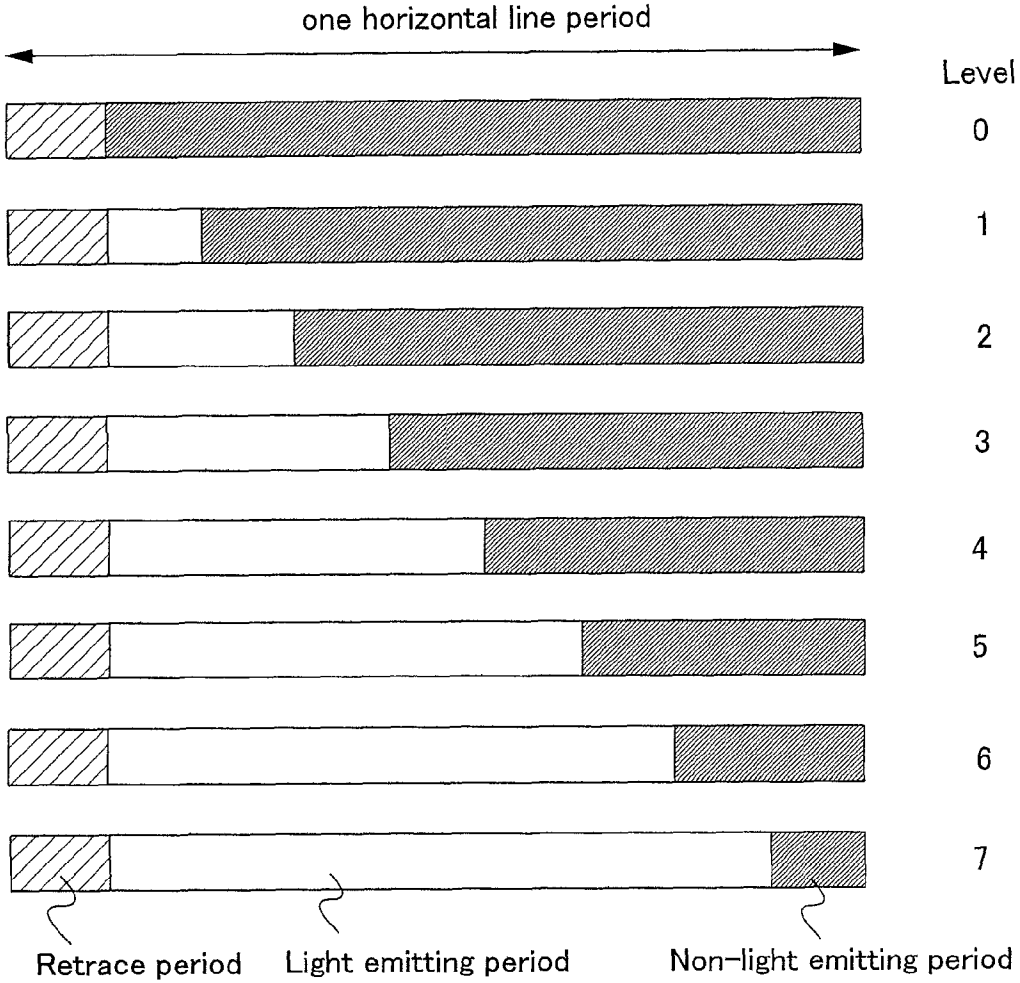
FIG. 13 is a timing chart for 3-bit time gray scale.

A gray scale display method of the light emitting element is described hereinafter. FIG. 13 is a timing chart for displaying a 3-bit gray scale image by a time gray scale method. A period obtained by dividing one frame period by the number of pixels in the vertical direction is substantially equal to one horizontal line period. If 3-bit, namely 8-level gray scale display is performed, as shown in FIG. 13, a potential may be outputted to the column signal lines S1 to Sn in each period in proportion to a gray scale level.

In an active matrix display device, a light emitting element of each pixel can emit light during almost all of one frame period. In a passive matrix display device adopting a time gray scale method with line sequential drive, however, a light emitting element of each pixel can emit light during at most one horizontal line period of one frame period as described above, and it is thus necessary to increase the brightness of each pixel instantaneously. For example, a value obtained by multiplying the brightness required for each pixel by the number of pixels in the vertical direction in an active matrix display device is equal to the brightness that is required for each pixel instantaneously in a passive matrix display device having the same number of pixels as the active matrix display device. In order to obtain a high brightness level instantaneously, the display device consumes more power. In addition, when a large current flows instantaneously to obtain a high brightness level of each pixel, degradation of the light emitting element progresses more rapidly.

Accordingly, if a passive matrix display device adopts a constant current drive, the potential of a source is required to be set extremely high when a transistor operating in the saturation region is used for a current source. This is because a large current is necessary to increase the brightness of a light emitting element instantaneously, and a voltage higher than required is applied to the light emitting element so that a transistor used as a current source operates in the saturation region. In addition, degradation of the light emitting element progresses more rapidly since a large current flows instantaneously to obtain a high brightness level, and thus a higher voltage is necessary to supply the same current to the degraded light emitting element. Therefore, the potential of a source of a transistor used as the current source is required to be set higher in advance.

According to the invention, however, when the potential of the anode of the light emitting element is determined, the display device can be driven with constant brightness without setting a high potential in advance as in the constant current drive.

Although one monitoring element 107 is provided in FIG. 1, a plurality of monitoring elements may be connected in parallel as well. For example, if x monitoring elements are connected in parallel, the current value of the current source 105 may be increased to x times.

[Embodiment Mode 1]

In this embodiment mode, a structure of a display device of the invention is described in detail.

Figure 2:
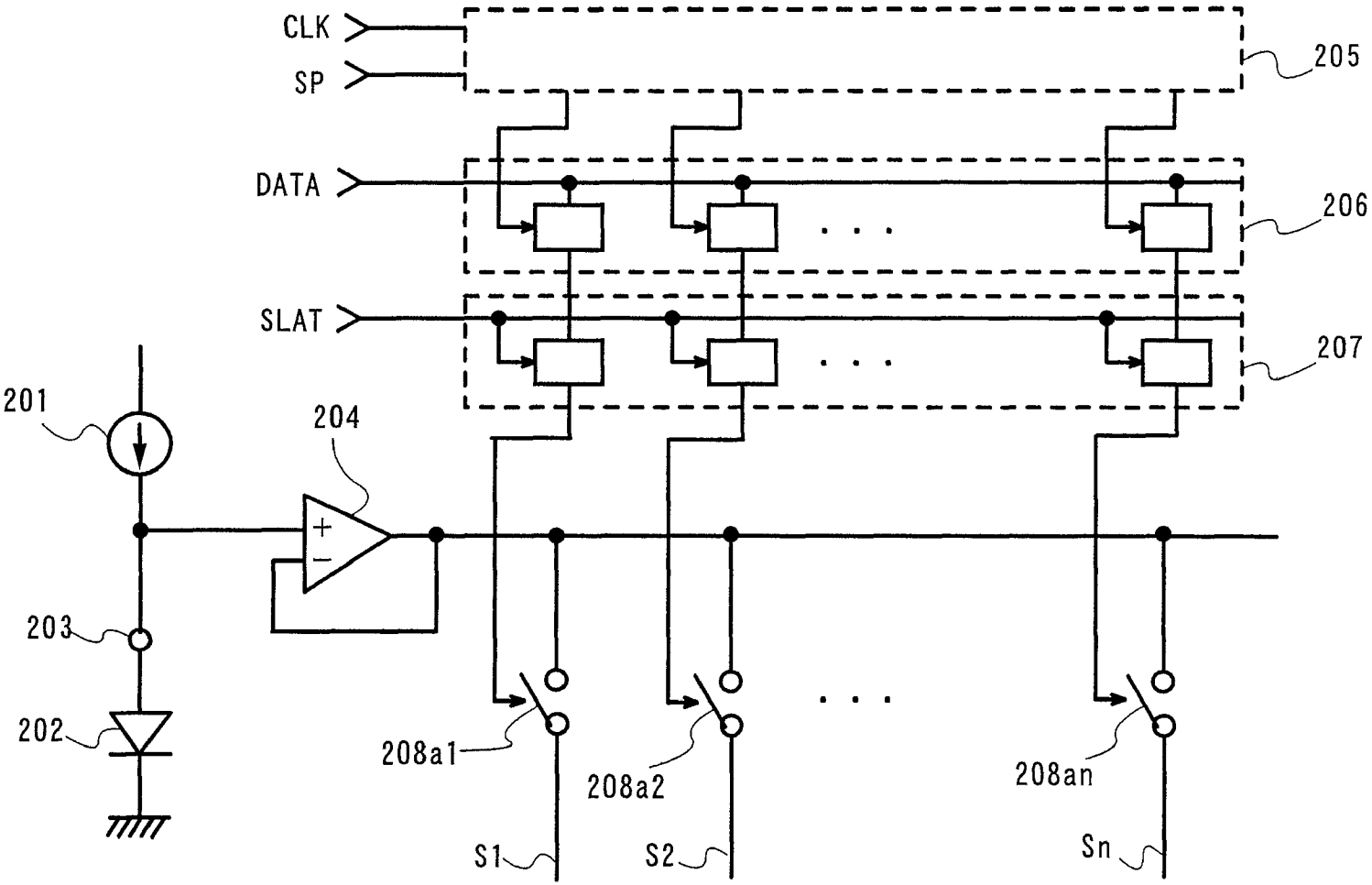
FIG. 2 is a diagram showing a column signal line driver circuit and a compensation circuit.

A column signal line driver circuit capable of being applied to the display device of the invention is described. FIG. 2 shows a column signal line driver circuit that can perform time gray scale display by controlling a period during which a potential determined by a temperature and degradation compensation circuit (hereinafter simply referred to as a compensation circuit) is outputted to the column signal lines S1 to Sn.

A constant current source 201 supplies a constant current to a monitoring element 202. That is, the monitoring element 202 is driven with a constant current. The potential of an anode 203 of the monitoring element 202 is detected by an amplifier 204 and outputted to the column signal line. Note that a voltage follower circuit is used for the amplifier 204 in this embodiment mode, though other circuits may be employed as long as they have the same function.

A pulse is outputted from a pulse output circuit 205, and video signals (DATA) are sequentially inputted to a first latch circuit 206 in accordance with the pulse. The data held in the first latch circuit 206 is inputted to a second latch circuit 207 at the timing of a latch pulse (SLAT). The data held in the second latch circuit 207 controls a period during which switches 208*a*1 to 208*a*n are on, and determines a period for supplying a potential to each of the column signal lines S1 to Sn, namely a light emitting element. Time gray scale display can thus be performed.

In practice, if 3-bit gray scale display is performed for example, the first latch circuit 206 and the second latch circuit 207 each has three latch circuits for each column signal line to hold 3-bit data for each column signal line. Then, the 3-bit data outputted from the second latch circuit 207 is converted into a pulse width corresponding to 8-level gray scale display, and the switches 208*a*1 to 208*a*n are on during the period of the pulse width. In this manner, 8-level gray scale display can be performed.

Figure 14:
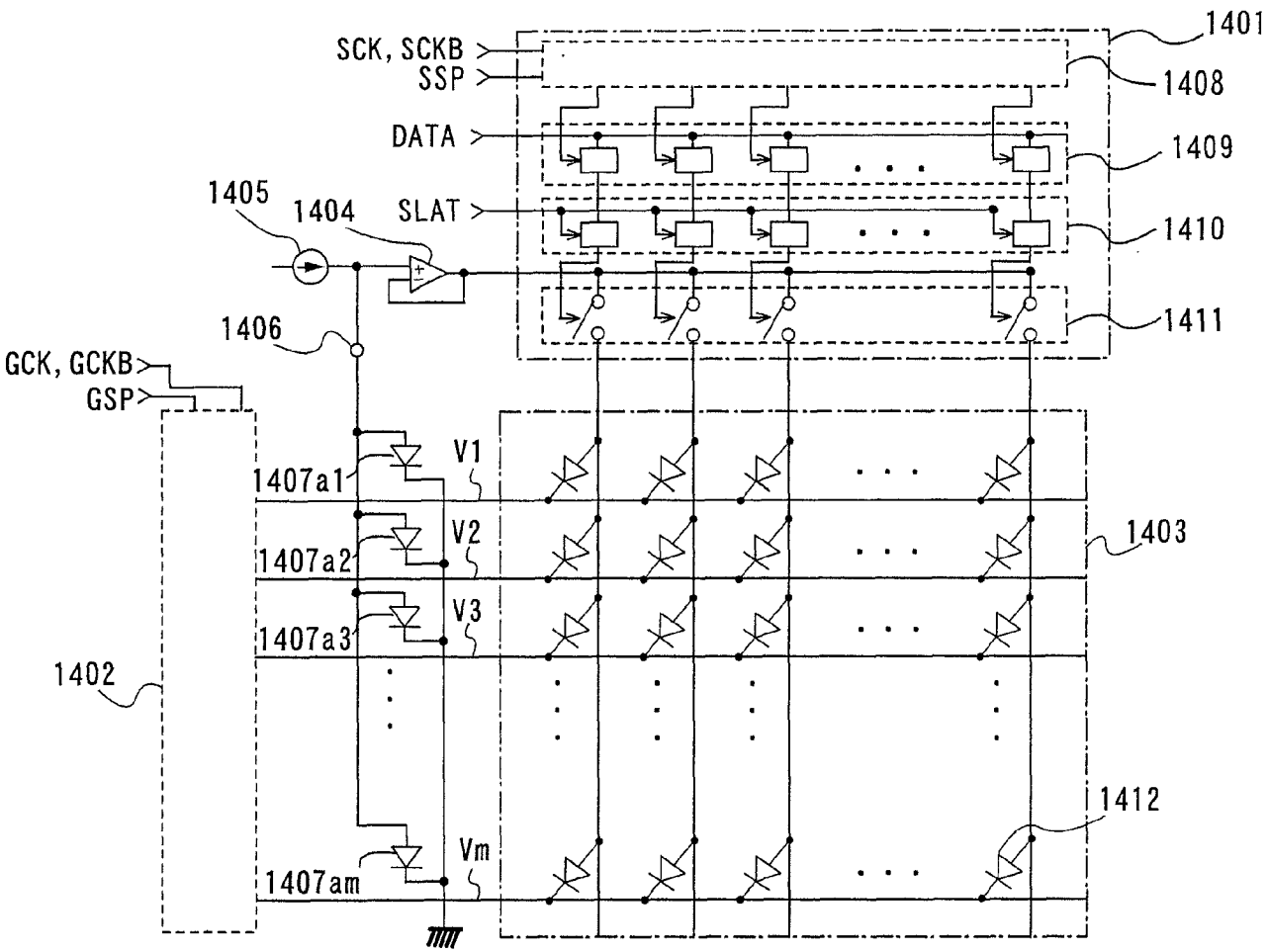
FIG. 14 is a diagram showing a display device having a plurality of monitoring elements.

FIG. 14 shows an example of a display device using the column signal line driver circuit shown in FIG. 2. In the structure of FIG. 14, as many monitoring elements 1407*a*1 to 1407*a*m as the row signal lines are arranged in parallel. The display device includes a row signal line driver circuit 1402, a column signal line driver circuit 1401, and a pixel portion 1403. The column signal line driver circuit 1401 includes a pulse output circuit 1408, a first latch circuit 1409, a second latch circuit 1410, and a switch 1411. According to this structure, a signal can be outputted from the second latch circuit 1410 while a signal is inputted to the first latch circuit 1409. A signal is outputted from the row signal line driver circuit 1402 to select one of the row signal lines V1 to Vm. Then, the potential difference between the selected row signal line and a column signal line is applied to a light emitting element 1412 sandwiched between the row signal line and the column signal line. Thus, a current flows and the light emitting element 1412 emits light. The same potential is supplied to each column signal line at this time, though a period of supplying the potential is different for each column. Accordingly, time gray scale display can be performed.

According to the invention, a constant current is supplied from a constant current source 1405 to the monitoring elements 1407*a*1 to 1407*a*m that are connected in parallel. That is, constant current drive is performed. Then, a voltage follower circuit 1404 detects the potential of an anode 1406 of the monitoring elements 1407*a*1 to 1407*a*m to determine a potential supplied to the column signal line. In this manner, the display device having a temperature and degradation compensation function can be provided.

Such a driving method having a temperature and degradation compensation function to drive with constant brightness is also called a constant brightness drive.

The number of monitoring elements can be selected arbitrarily. One monitoring element may be provided or a plurality of monitoring elements may be provided as shown in FIG. 14. If one monitoring element is used, the constant current source 1405 can flow a current required for the light emitting element of each pixel, leading to reduction in power consumption.

The structure of the display device is not limited to that shown in FIG. 14, and the monitoring elements may be arranged at the column signal line driver circuit side, at the opposite side of the row signal line driver circuit with the pixel portion interposed therebetween, or at the opposite side of the column signal line driver circuit with the pixel portion interposed therebetween. The arrangement of the monitoring elements can be selected arbitrarily for efficient use of temperature and degradation compensation function.

It is preferable that the monitoring elements and the light emitting elements be simultaneously formed over the same substrate using the same material. According to this, variations in I-V characteristics of the monitoring elements and the light emitting elements can be reduced.

If all the column signal lines have the same potential as shown in FIG. 14, a monochrome display device may be obtained, or a full color display device may be obtained by combining a white light emitting element and a color filter.

The potential of the power supply line may be determined for each pixels of a red color (R), a green color (G), and a blue color (B). An example of such a structure is shown in FIG. 9 where the same portion as FIG. 2 is denoted by the same reference numeral.

Figure 9:
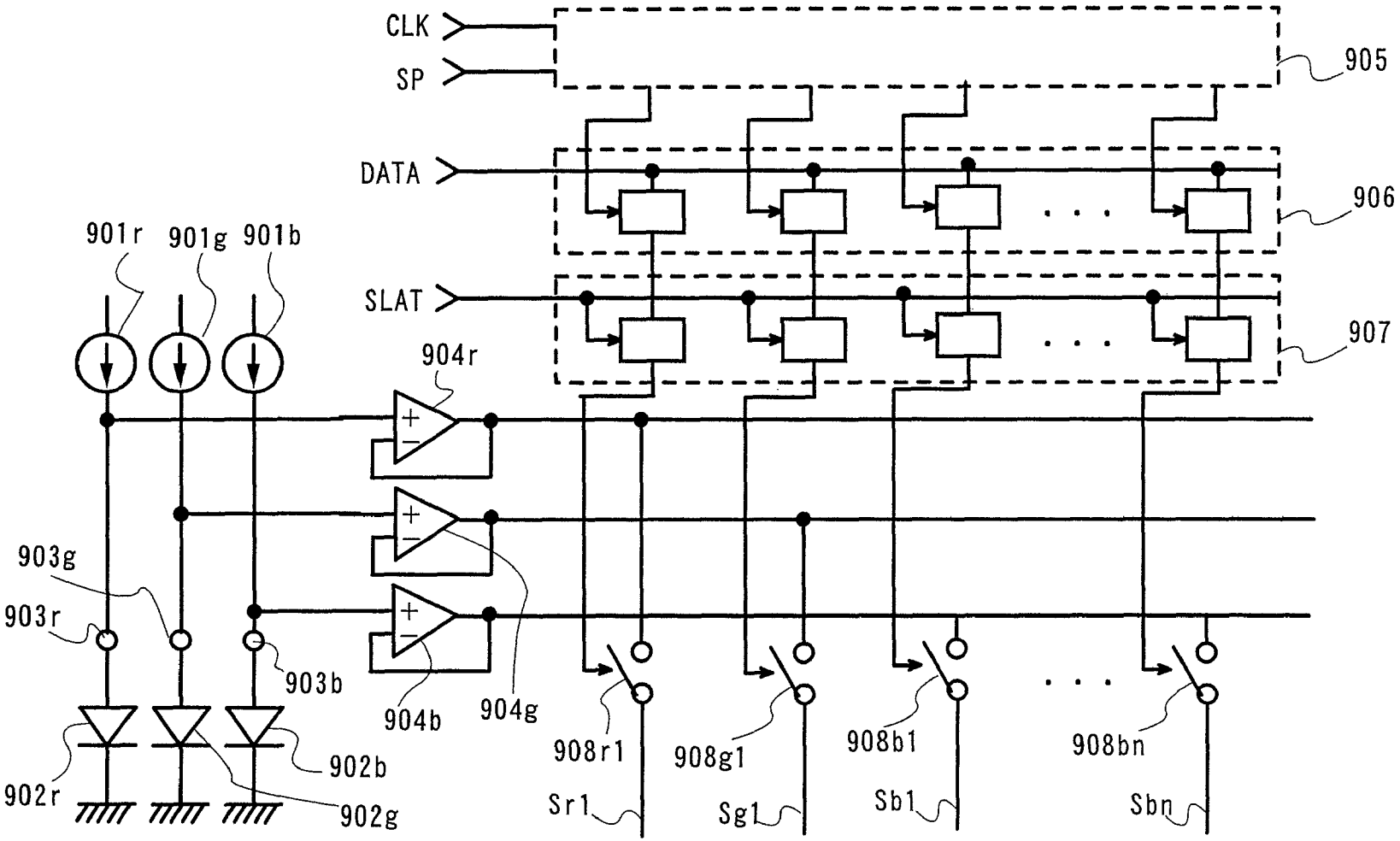
FIG. 9 is a diagram showing a column signal line driver circuit and a compensation circuit.

In FIG. 9, signal lines Sr1 to Srn denote column signal lines each connected to a pixel that emits red (R) light. Signal lines Sg1 to Sgn denote column signal lines each connected to a pixel that emits green (G) light. Signal lines Sb1 to Sbn denote column signal lines each connected to a pixel that emits blue (B) light.

The operation of the column signal lines in FIG. 9 is briefly described. A pulse is outputted from a pulse output circuit 905, and video signals (DATA) are sequentially inputted to a first latch circuit 906 in accordance with the pulse. The data held in the first latch circuit 906 is inputted to a second latch circuit 907 at the timing of a latch pulse (SLAT). The data held in the second latch circuit 907 controls the period during which switches 908*r*1 to 908*r*n, 908*g*1 to 908*g*n, and 908*b*1 to 908*b*n are on, thereby determining the period during which the data is outputted to the column signal lines Sr1 to Srn, Sg1 to Sgn, and Sb1 to Sbn, namely the period during which the potential is supplied to each light emitting element. Accordingly, time gray scale display can be achieved.

A current source 901*r* supplies a current to a monitoring element 902*r* and a voltage follower circuit 904*r* detects the potential of an anode 903*r* of the monitoring element 902*r*, such that the column signal lines Sr1 to Srn each has this potential. A current source 901*g* supplies a current to a monitoring element 902*g* and a voltage follower circuit 904*g* detects the potential of an anode 903*g* of the monitoring element 902*g*, such that the column signal lines Sg1 to Sgn each has this potential. A current source 901*b* supplies a current to a monitoring element 902*b* and a voltage follower circuit 904*b* detects the potential of an anode 903*b* of the monitoring element 902*b*, such that the signal lines Sb1 to Sbn each has this potential. In this manner, the potential can be determined for each pixels of R, G, and B. Therefore, a desired potential can be determined for each light emitting element when, for example, temperature characteristics or degradation characteristics are different for each EL materials of R, G, and B. In other words, the potential of the column signal line can be determined and corrected for each pixels of R, G, and B.

[Embodiment Mode 2]

Described in this embodiment mode is a structure where the accuracy of degradation compensation is further improved.

When a display device is used for a long period, degradation progresses at different rates in a monitoring element and a light emitting element. This difference in degradation rate increases with the duration of use, which results in lower degradation compensation function.

Figure 12:
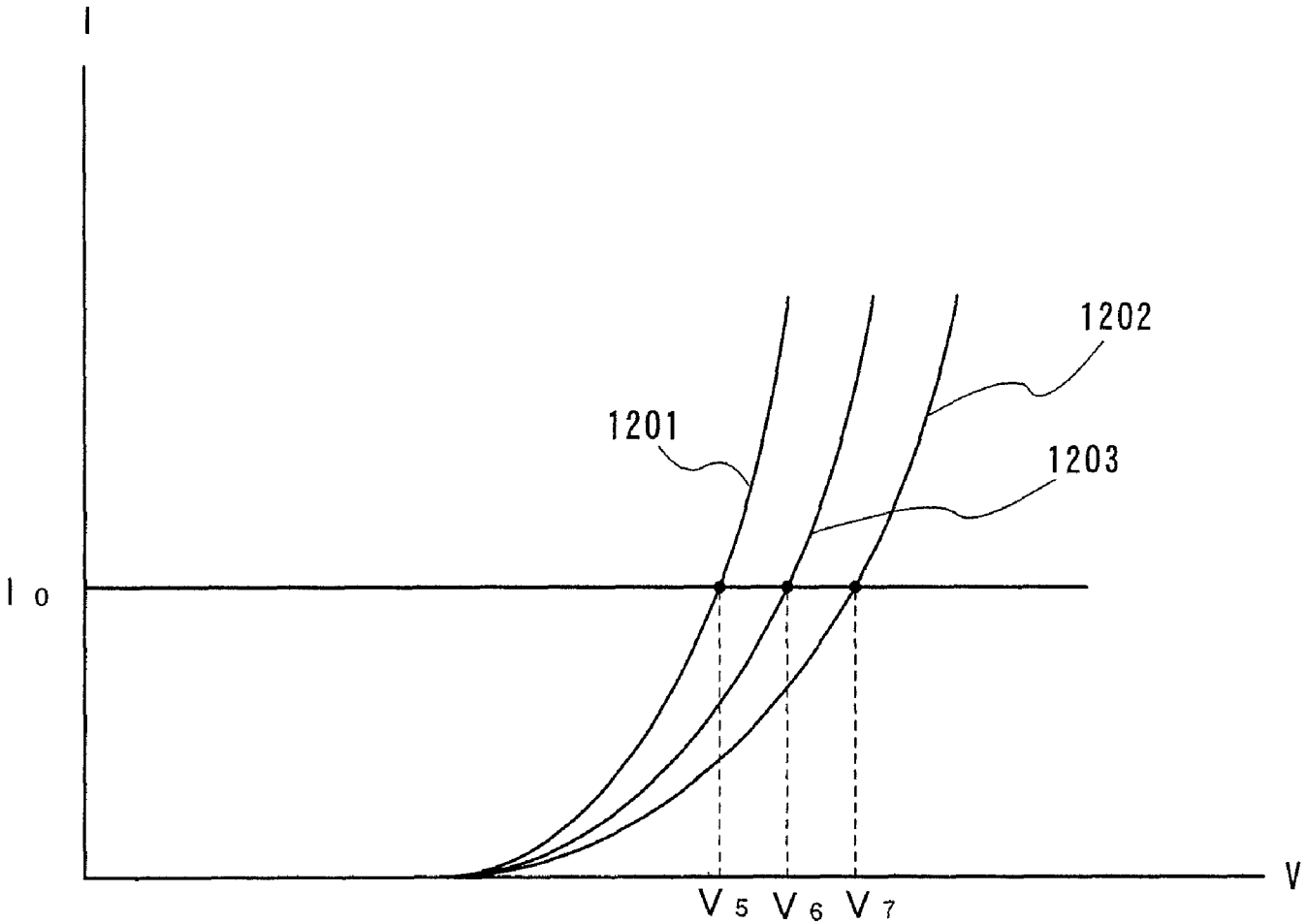
FIG. 12 is a graph showing I-V characteristics of a light emitting element and a monitoring element, which degrade with time depending on the duty ratio.

The I-V characteristics in the case where there is a difference in degradation rate are described with reference to FIG. 12. Reference numeral 1201 denotes initial I-V characteristics of the monitoring element 107 and the light emitting element 108 that are shown in FIG. 1, 1202 denotes I-V characteristics of the monitoring element 107 that degrades after a display device is used for a certain period, and 1203 denotes I-V characteristics of the light emitting element 108 that degrades after the display device is used for a certain period. As shown in FIG. 12, degradation of the monitoring element 107 and the light emitting element 108 progresses at different rates. This difference in degradation rate is caused because a current is supplied to the monitoring element 107 always when the display device displays images while the light emitting element 108 in each pixel emits light or no light in each period (a light emitting period and a non-light emitting period). That is, the light emitting element 108 degrades at a slower rate than the monitoring element 107.

When a current $I_0$ is supplied to the monitoring element 107 and the light emitting element 108 in the initial characteristics, a voltage $V_5$ is applied to the monitoring element 107 and the light emitting element 108 in the initial characteristics, a voltage $V_6$ is applied the light emitting element 108 after degradation of the light emitting element 108, and a voltage $V_7$ is applied the monitoring element 107 after degradation of the monitoring element 107. In other words, the voltage $V_6$ is required for supplying the current $I_0$ to the light emitting element 108 after degradation while the voltage $V_7$ is required for supplying the current $I_0$ to the monitoring element 107 after degradation.

When the potential $V_7$ of the anode 106 of the monitoring element 107 is detected and supplied to the light emitting element 108 by the amplifier 104, a voltage higher than the voltage $V_6$ that is required for supplying the current $I_0$ to the light emitting element 108 is applied to the light emitting element 108, leading to higher power consumption. In addition, since the light emitting element in each pixel degrades at different rates, image burn-in occurs frequently when a voltage higher than necessary is applied.

In view of the foregoing, according to this embodiment mode, each light emitting element and monitoring element degrade at substantially the same rate to improve the accuracy of degradation compensation.

This embodiment mode thus provides a display device where a current is supplied to a monitoring element during a period corresponding to the average emission period of a light emitting element in each pixel. Preferably, a current is supplied to the monitoring element during 10 to 70% of a period in which the display device displays images.

The average ratio between a light emitting period and a non-light emitting period of a light emitting element in each pixel of a display device is substantially 3:7. Accordingly, it is more preferable that a current be supplied to the monitoring element during 30% of a period in which the display device displays images.

Figure 3:
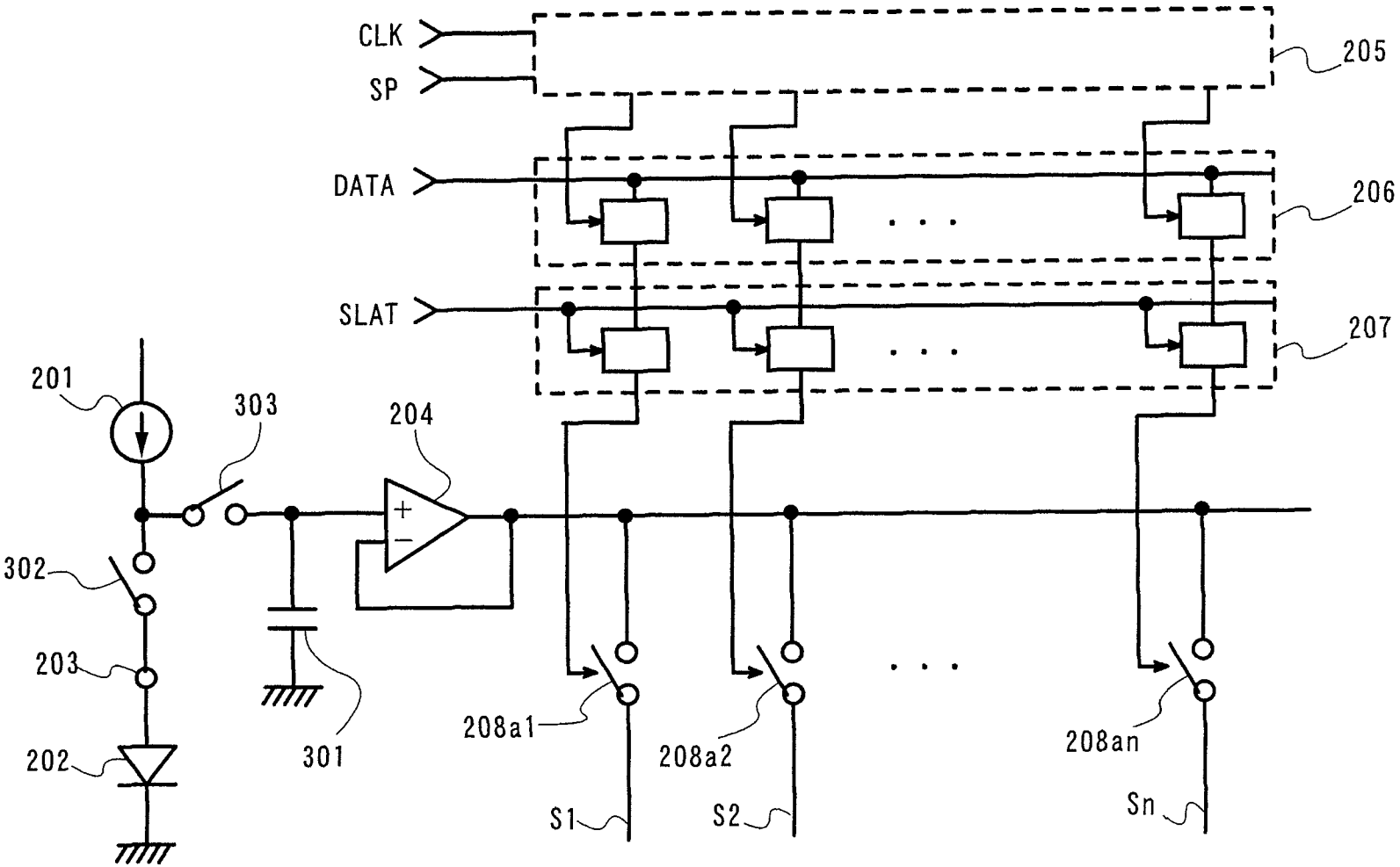
FIG. 3 is a diagram showing a column signal line driver circuit and a compensation circuit.

FIG. 3 shows a structure of a compensation circuit capable of determining a light emitting period of a monitoring element. In FIG. 3, the same portions as FIG. 2 are denoted by the same reference numerals. The structure in FIG. 3 is different from FIG. 2 in that a capacitor 301, a first switch 302 and a second switch 303 are provided.

When a constant current is supplied to the monitoring element 202, the first switch 302 and the second switch 303 are turned on. Then, a current is supplied to the monitoring element 202, the potential of the anode 203 of the monitoring element 202 is accumulated in the capacitor 301, and this potential is inputted to a non-inverting input terminal of the voltage follower circuit 204 and the same potential is outputted from an output terminal thereof. In this manner, a desired potential can be determined for a light emitting element whose I-V characteristics vary due to changes in ambient temperature.

When the monitoring element 202 emits no light, the first switch 302 and the second switch 303 are turned off, and the potential of the anode 203 of the monitoring element 202 is held in the capacitor 301. If the first switch 302 is turned off before the second switch 303 at this time, the potential of the capacitor that holds the potential of the anode 203 of the monitoring element 202 varies, therefore, the second switch 303 is turned off at the same time or before the first switch 302.

As a result, the potential of the anode 203 of the monitoring element 202 at the moment when the second switch 303 is turned off is inputted to a non-inverting input terminal of the voltage follower circuit 204 in a non-light emitting period. The same potential is outputted from the output terminal of the voltage follower circuit 204. Accordingly, a current flowing through the monitoring element 202 at the moment when the second switch 303 is turned off can be supplied to the light emitting element.

According to this structure, a temperature compensation function can be performed during a period in which a current is supplied to the monitoring element, and thus both degradation compensation and temperature compensation can be achieved. This embodiment mode provides a superior degradation compensation function in particular.

As set forth above, in time gray scale display of a display device, the average ratio between a light emitting period and a non-light emitting period of each pixel in one frame period is substantially 3:7. Accordingly, it can be found that the average ratio between the amount of current flowing in the monitoring element when the display device displays images and the amount of current flowing in each light emitting element is 10:3. Therefore, when a current is supplied to the monitoring element during 30% of one frame period, the degradation rates of the monitoring element and the light emitting element of each pixel can be close to each other. In other words, the accuracy of degradation compensation can be improved.

In addition, when a monitoring element for degradation compensation is provided for each of R, G, and B in the aforementioned structure, the accuracy of degradation compensation and temperature compensation can be further improved. A monitoring element corresponding to a light emitting elements for each of R, G, and B may be provided to perform temperature and degradation compensation in the case where degradation rate and life of an EL element are different for each of R, G, and B, or temperature-dependent I-V characteristics of an EL element are different for each of R, G, and B. Further, the light emitting period of a monitoring element for each of R, G, and B may be determined in accordance with the average ratio (duty ratio) between a light emitting period and a non-light emitting period of a light emitting element for each of R, G, and B, which results in improved accuracy of degradation compensation. That is, the monitoring element and each light emitting element degrade at substantially the same rate, and thus the accuracy of degradation compensation is improved. In addition, the accuracy of temperature compensation of a light emitting element can also be improved since the monitoring element can be formed by using an EL material of the same color.

[Embodiment Mode 3]

Figure 4:
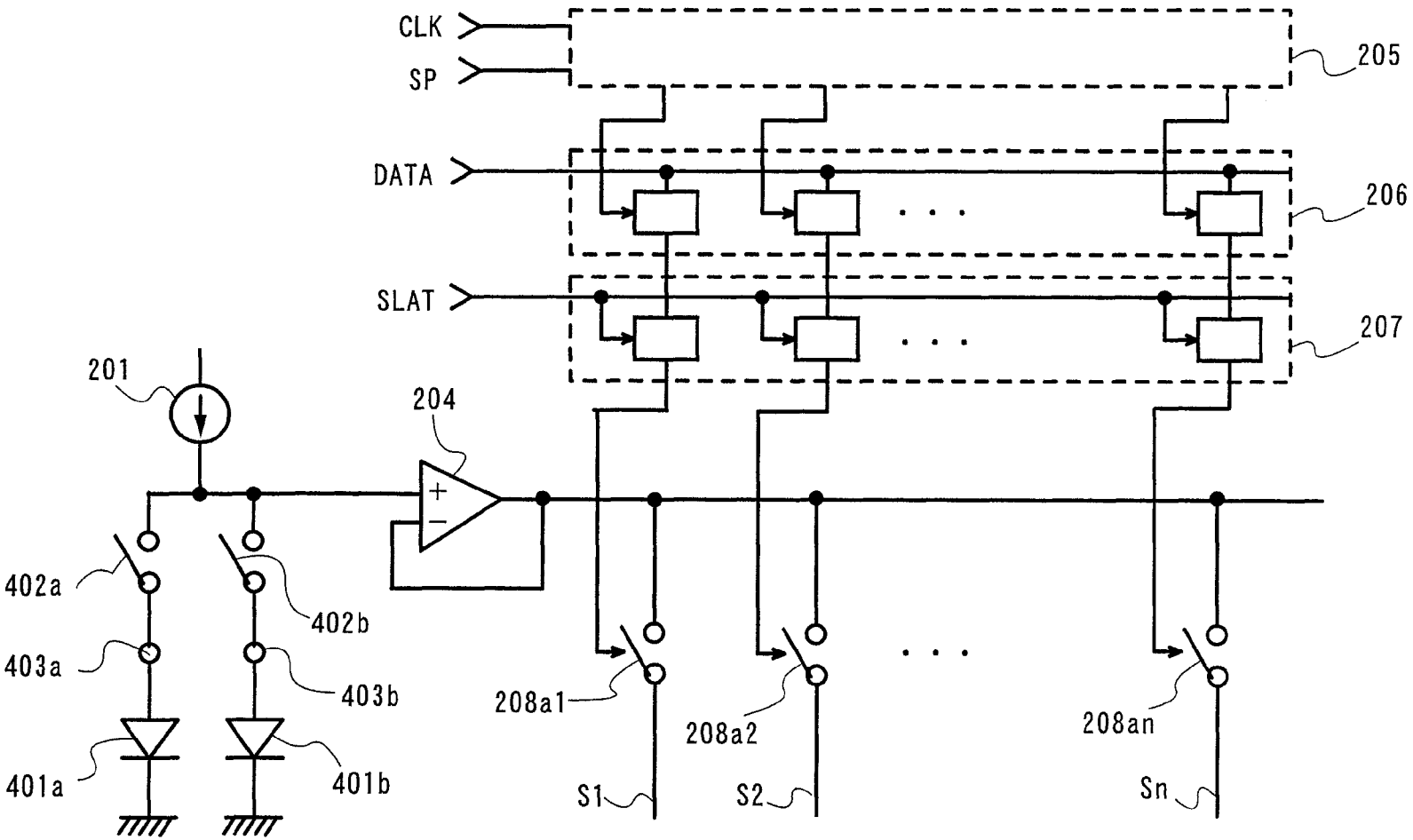
FIG. 4 is a diagram showing a column signal line driver circuit and a compensation circuit.

Described in this embodiment mode is a structure where the accuracy of degradation compensation is improved while maintaining the accuracy of temperature compensation. The description is made with reference to FIG. 4.

A display device includes the current source 201, monitoring elements 401*a* and 401*b*, the voltage follower circuit 204, and switches 402*a* and 402*b*.

The operation of a compensation circuit with such a structure is briefly described. The switch 402*a* and the switch 402*b* are alternately turned on. Thus, a current is necessarily supplied to the monitoring element 401*a* or the monitoring element 401*b*. Then, the potential of an anode (an anode 403*a* or an anode 403*b*) of either the monitoring element 401*a* or the monitoring element 401*b* is detected by the voltage follower circuit 204 and that potential can be inputted to each of the column signal lines S1 to Sn. When the periods during which the switches 402*a* and 402*b* are on are determined to be the same, it is possible to slow degradation with time of the monitoring elements 401*a* and 401*b*.

Further, a current is always supplied to either the monitoring element 401*a* or 401*b*, and the potential of the anode of the monitoring element is detected to determine the potential of the anode of the light emitting element; therefore, temperature compensation can also be performed all the time.

Figure 5:
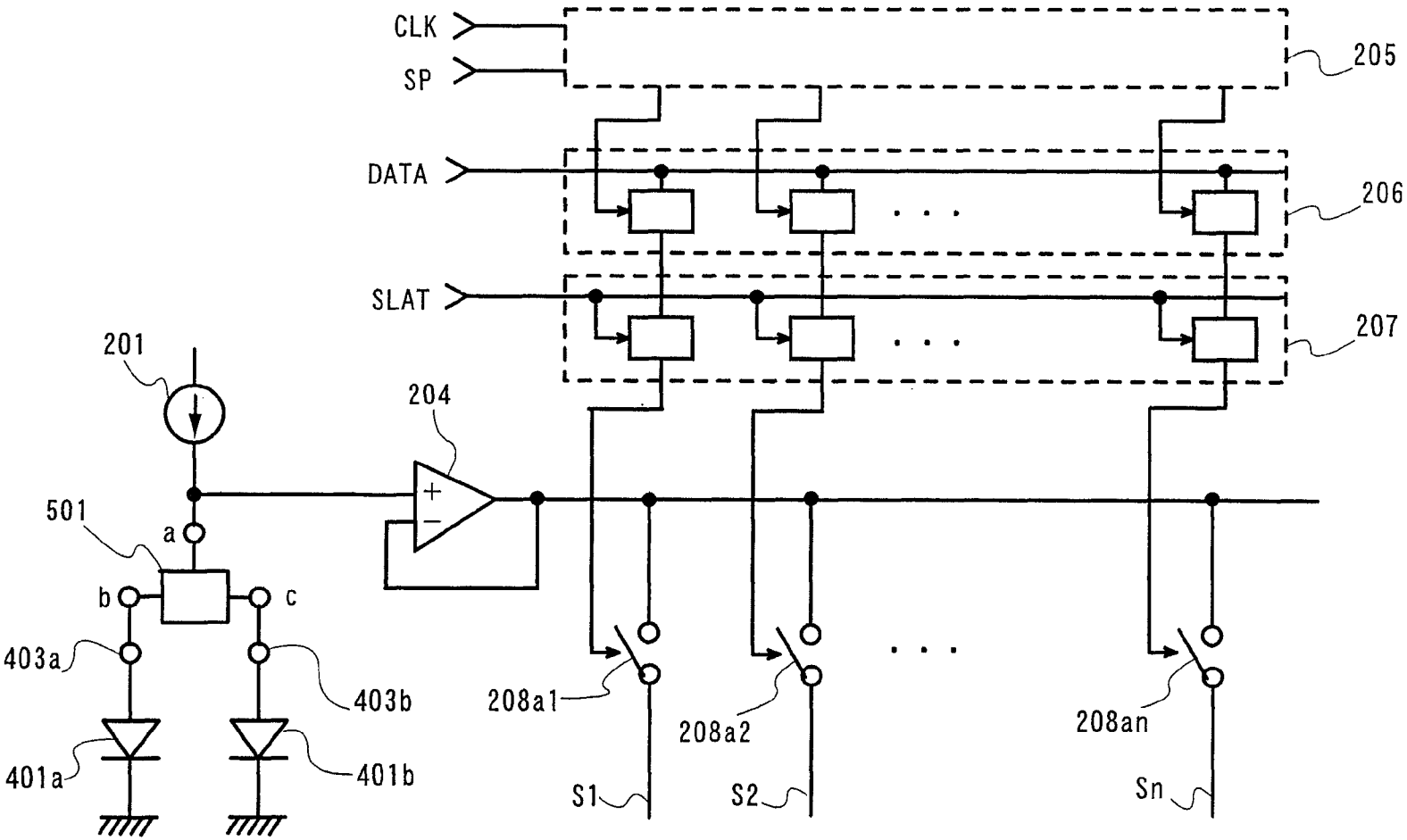
FIG. 5 is a diagram showing a column signal line driver circuit and a compensation circuit.

FIG. 5 shows an example of a switch that can operate in the aforementioned manner. A switch 501 functions as the switches 402*a* and 402*b* shown in FIG. 4. A terminal a of the switch 501 is connected to the current source 201, a terminal b is connected to the anode 403*a* of the monitoring element 401*a*, and a terminal c is connected to the anode 403*b* of the monitoring element 401*b*. When a current is supplied from the current source 201 to the monitoring element 401*a*, the terminal a of the switch 501 is electrically connected to the terminal b. Meanwhile, when a current is supplied to the monitoring element 401*b*, the terminal a is electrically connected to the terminal c.

Figure 6:
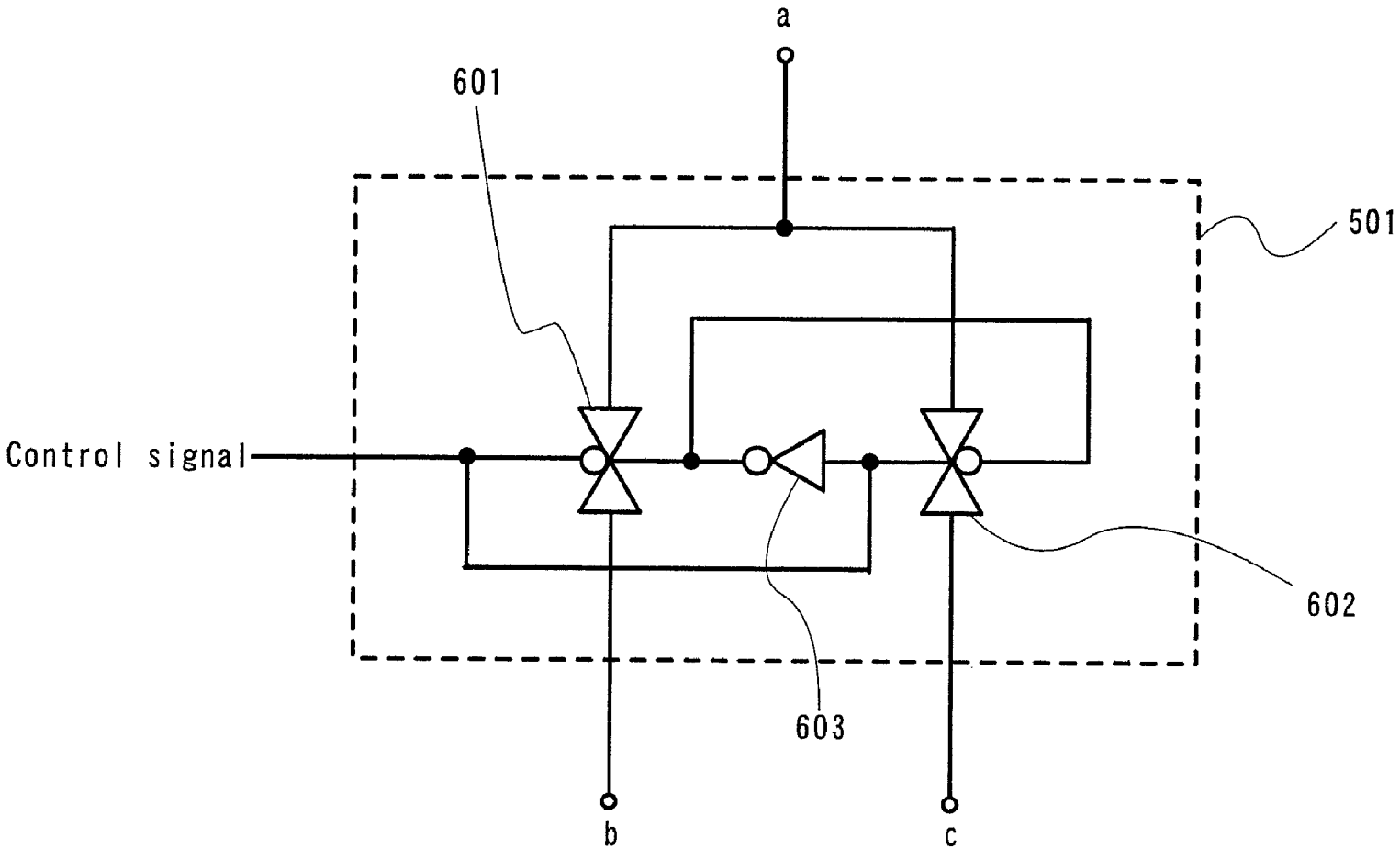
FIG. 6 is a diagram showing a structure of a switch that can be applied to the invention.

FIG. 6 shows an example of a specific structure of the switch 501. The switch 501 includes analog switches 601 and 602, and an inverter 603. A control signal is inputted to each control input terminal of the analog switch 601 and the analog switch 602, thereby either the analog switch 601 or the analog switch 602 is turned on. Thus, which of the monitoring element 401*a* and the monitoring element 401*b* is supplied with current can be selected.

Figure 7:
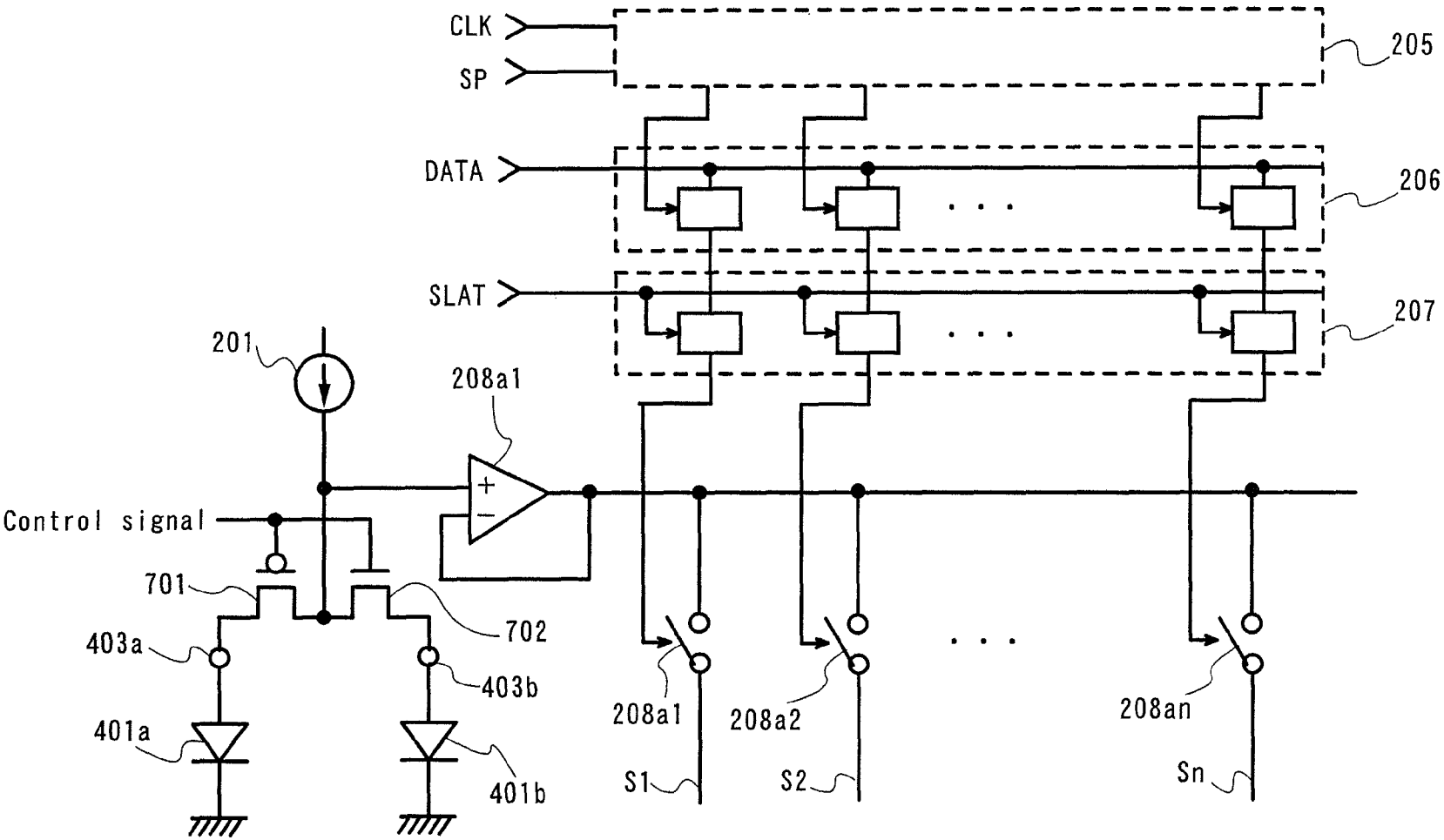
FIG. 7 is a diagram showing a column signal line driver circuit and a compensation circuit.

Alternatively, a transistor may be used to function as the switches 402*a* and 402*b* as shown in FIG. 7. In FIG. 7, a P-channel switching transistor 701 and an N-channel switching transistor 702 are used. A source terminal of the switching transistor 701 and a drain terminal of the switching transistor 702 are connected to the current source 201. A drain terminal of the switching transistor 701 is connected to the anode 403*a* of the monitoring element 401*a* while a source terminal of the switching transistor 702 is connected to the anode 403*b* of the monitoring element 401*b*. Control signals are inputted to gate terminals of these transistors 701 and 702. Then, either the switching transistor 701 or 702 is turned on since these transistors have different polarity. Accordingly, either the monitoring element 401*a* or 401*b* can be selected. It is needless to say that this structure can be applied to the display device as shown in FIG. 14 where a plurality of monitoring elements are provided.

Figure 8:
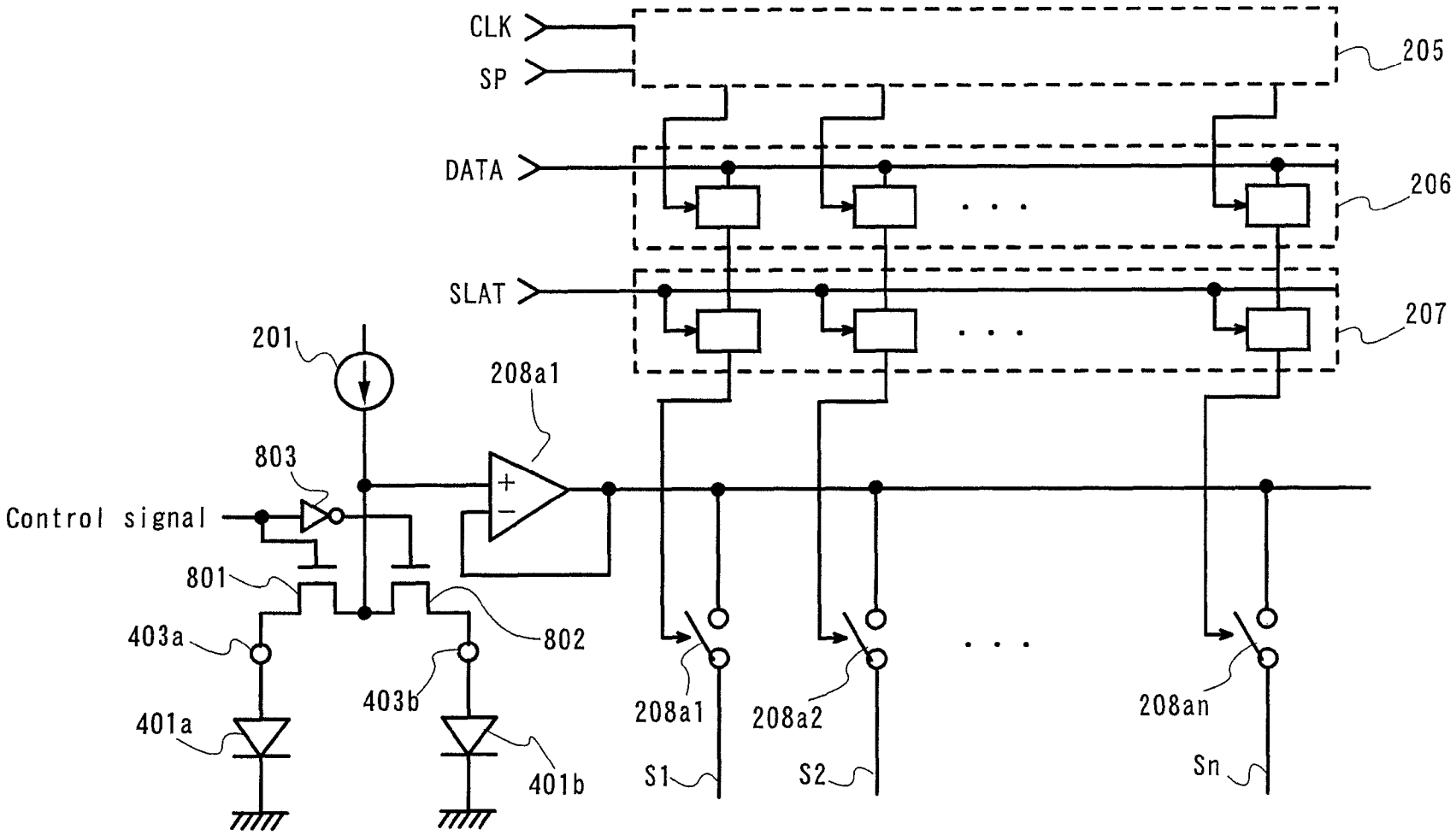
FIG. 8 is a diagram showing a column signal line driver circuit and a compensation circuit.

The same function can be achieved by using transistors with the same polarity as shown in FIG. 8. A control signal is inputted to a control input terminal of one switching transistor 801 while a control signal is inputted to the other switching transistor 802 through an inverter 803. Thus, an inverted control signal is inputted to the switching transistor 802, such that either the switching transistor 801 or 802 can be turned on. Note that the N-channel transistors 801 and 802 are used in FIG. 8, though the same function can be achieved by using only P-channel transistors. It is needless to say that a pair of switching transistors 801 and 802 may be provided for each row signal line as shown in FIG. 14.

The number of monitoring elements to be selected is not limited to two, and three or more monitoring elements may be arranged in parallel to further slow the progression of degradation. When three monitoring elements are arranged in parallel and sequentially selected to be supplied with current, degradation rates of the light emitting element and the monitoring element can be close to each other. The degradation rates of the light emitting element and the monitoring element can be close to each other by arbitrarily selecting the number of monitoring elements and switching them.

Figure 19:
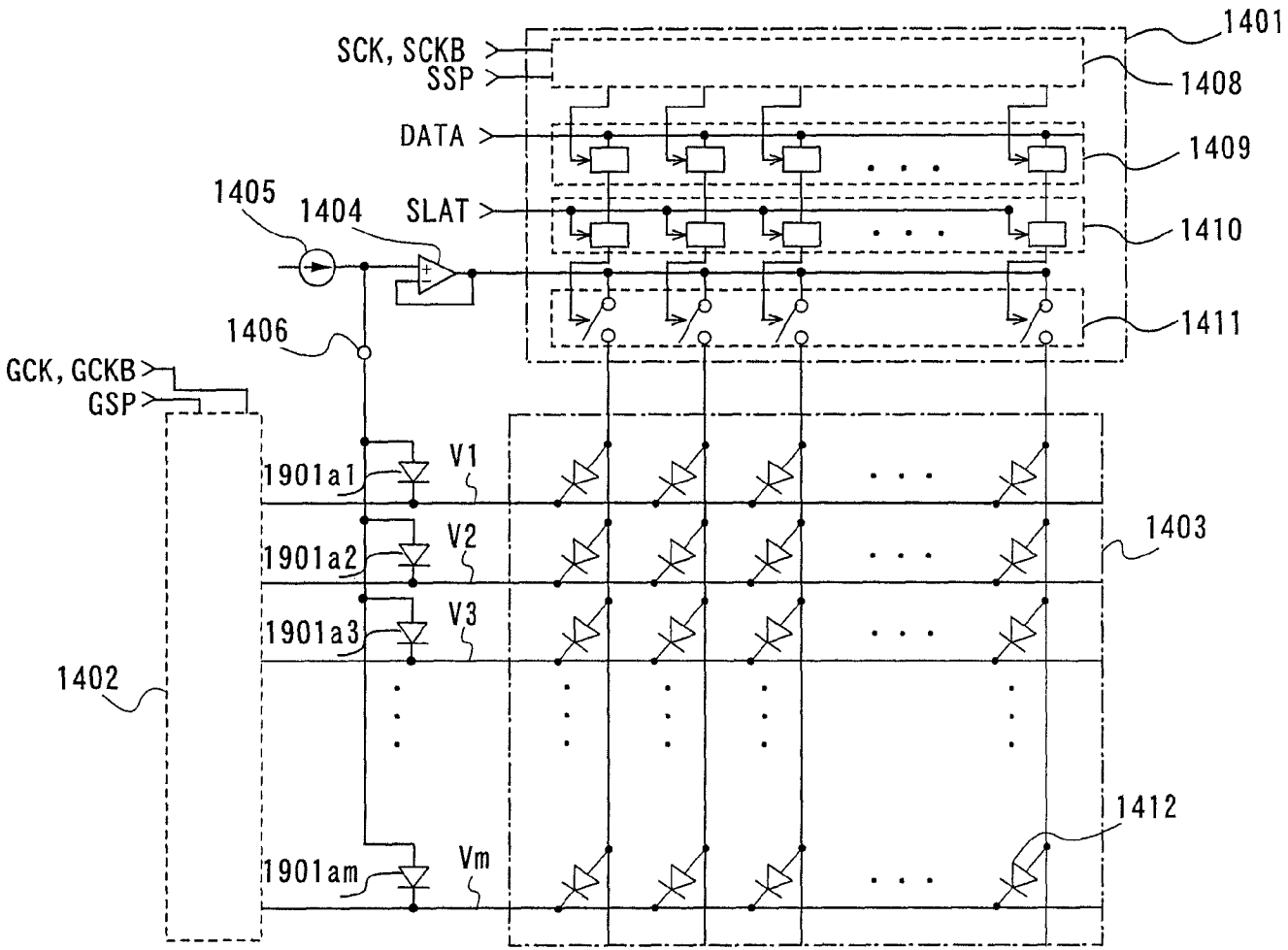
FIG. 19 is a diagram showing a display device having a plurality of monitoring elements.
Figure 20:
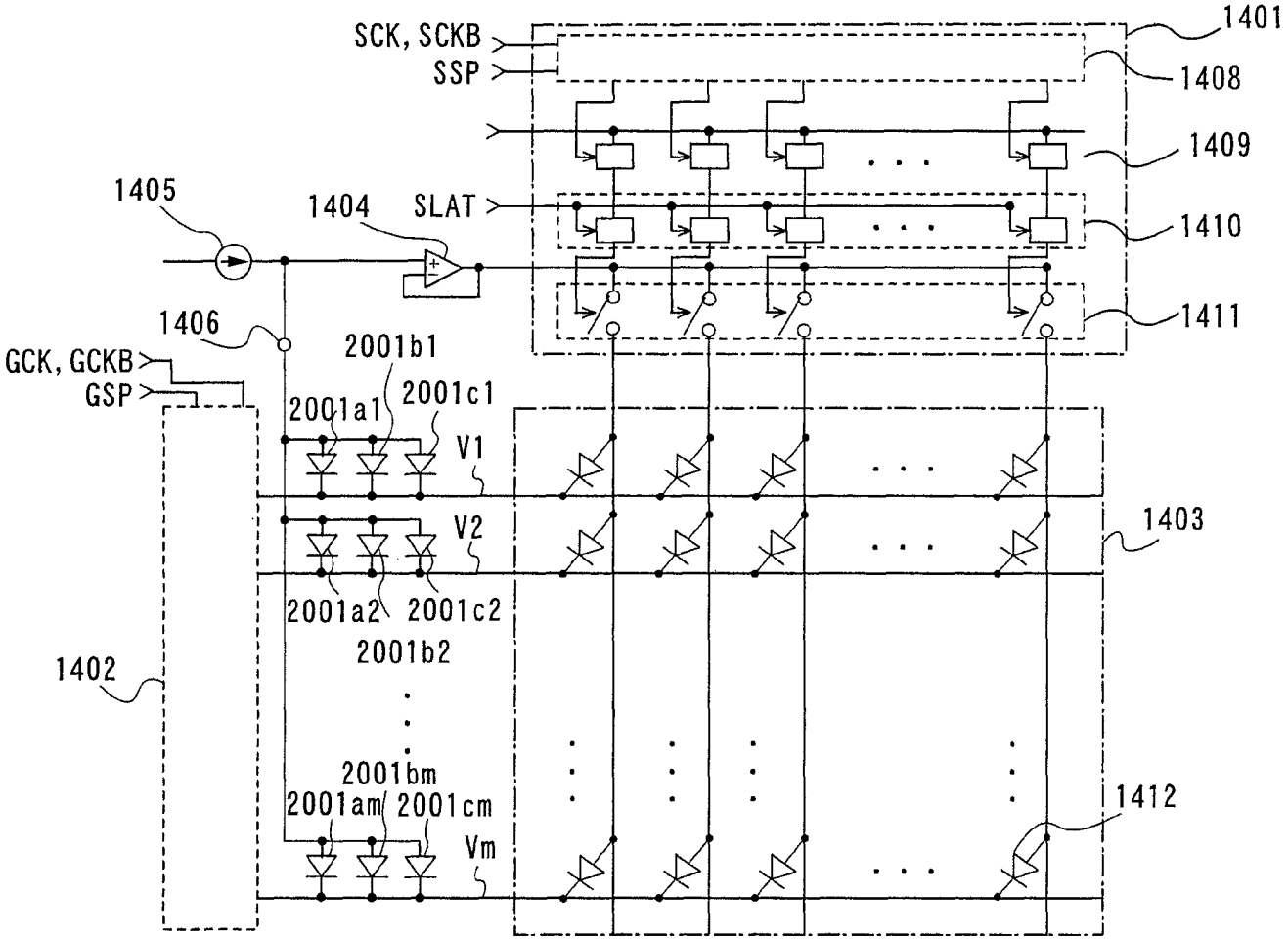
FIG. 20 is a diagram showing a display device having a plurality of monitoring elements.

In the structure as shown in FIG. 19 where cathodes of monitoring elements 1901*a*1 to 1901*a*m are connected to row signal lines V1 to Vm respectively, the monitoring elements can be switched for each row signal line. That is, a current is supplied only to a monitoring element connected to a selected row signal line (row signal line having a potential difference from a signal potential of a column signal line such that a current is supplied to the light emitting element). Therefore, the duty ratio of the light emitting element can be close to that of the monitoring element. Further, when a plurality of monitoring elements are provided, variations in characteristics of the monitoring elements can be averaged. FIG. 20 shows an example of such a structure, where three monitoring elements are connected in parallel for each of the row signal lines V1 to Vm. In the structure of FIG. 20, the row signal lines V1 to Vm are connected to cathodes of monitoring elements 2001*a*1 to 2001*a*m, 2001*b*1 to 2001*b*m, and 2001*c*1 to 2001*c*m, respectively. As a result, the duty ratios of the light emitting element and the monitoring element can be close to each other, and characteristics of the three monitoring elements connected in parallel can be averaged. Note that the number of monitoring elements connected in parallel is not limited to three, and can be selected arbitrarily.

Figure 15:
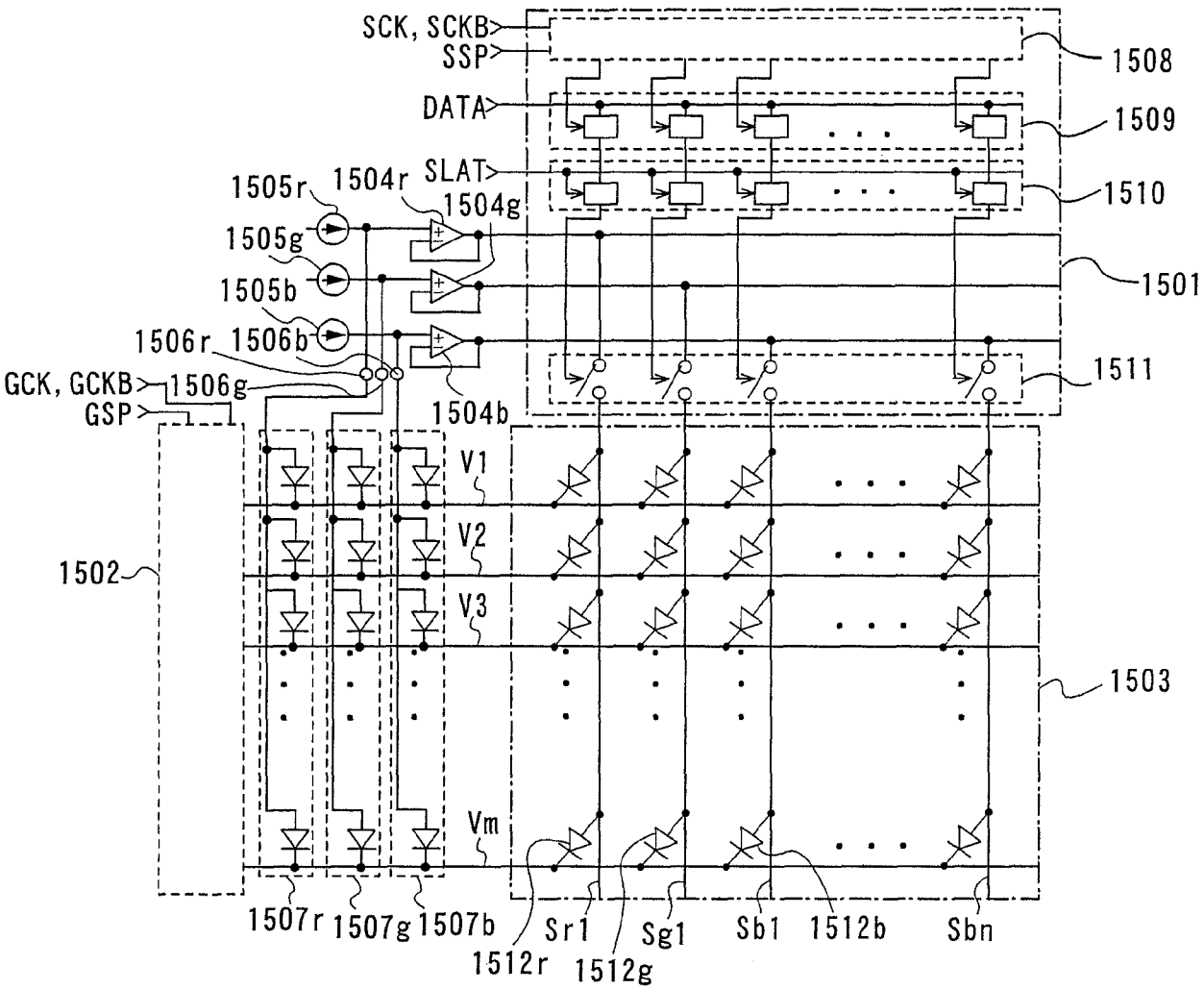
FIG. 15 is a diagram showing a display device having a plurality of monitoring elements for each of a red color (R), a green color (O), and a blue color (B).

The structure as shown in FIG. 9 where the potential is determined for each pixels of R, and B can be applied to the structure shown in FIG. 19. Such a structure is shown in FIG. 15. Since the potential is determined for each of R, G, and B in FIG. 15, the display device includes a monitoring element group 1507*r* formed by using the same material as a red light emitting element, a monitoring element group 1507*g* formed by using the same material as a green light emitting element, and a monitoring element group 1507*b* formed by using the same material as a blue light emitting element. Note that each monitoring element group has as many monitoring elements as row signal lines. The display device includes a row signal line driver circuit 1502, a column signal line driver circuit 1501, and a pixel portion 1503. The column signal line driver circuit 1501 includes a pulse output circuit 1508, a first latch circuit 1509, a second latch circuit 1510, and a switch 1511. The pixel portion 1503 includes a red light emitting element 1512*r*, a green light emitting element 1512*g*, and a blue light emitting element 1512*b*. According to this structure, a signal can be inputted to the first latch circuit 1509 while a signal is outputted from the second latch circuit 1510. A signal is outputted from the row signal line driver circuit 1502 to select one of the row signal lines V1 to Vm, thereby the potential difference between the selected row signal line and the column signal line is applied to a light emitting element sandwiched between the row signal line and the column signal line. Then, current flows and the light emitting element emits light. At this time, the potential inputted to the column signal line may differ for each of R, G, and B. Note that column signal lines for the same color light emitting element have the same potential, though the period during which the potential is supplied is different. Thus, time gray scale display can be achieved.

According to the invention, a constant current is supplied from a current source 1505*r* to the monitoring element group 1507*r* having a plurality of monitoring elements connected in parallel, a constant current is supplied from a current source 1505*g* to the monitoring element group 1507*g* having a plurality of monitoring elements connected in parallel, and a constant current is supplied from a current source 1505*b* to the monitoring element group 1507*b* having a plurality of monitoring elements connected in parallel. In other words, a constant current drive is performed. However, a current is supplied to only one monitoring element in each of the monitoring element groups 1507*r*, 1507*g*, and 1507*b* at a time, since a current is supplied to a monitoring element only when a row signal line connected to the monitoring element is selected (when the row signal line has a potential difference from a signal potential of a column signal line such that a current is supplied to the light emitting element). That is, each of the current sources 1505*r*, 1505*g*, and 1505*b* may have a current value to drive one monitoring element with a constant current. Then, the potential of an anode 1506*r* of the monitoring element group 1507*r* is detected by a voltage follower circuit 1504*r* to be supplied to the column signal lines Sr1 to Srn, the potential of an anode 1506*g* of the monitoring element group 1507*g* is detected by a voltage follower circuit 1504*g* to be supplied to the column signal lines Sg1 to Sgn, and the potential of an anode 1506*b* of the monitoring element group 1507*b* is detected by a voltage follower circuit 1504*b* to be supplied to the column signal lines Sb1 to Sbn. Accordingly, the monitoring element can be switched when the row signal line is switched, thus the duty ratio of each monitoring element can be close to that of the light emitting element and the potential of the light emitting element can be determined for each of R, G, and B. Therefore, the potential of the light emitting element can be determined by taking into consideration element characteristics of each of R, G, and B. In this manner, a display device having temperature and degradation compensation functions can be provided.

[Embodiment Mode 4]

Described in this embodiment mode is a method for correcting an error in degradation with time caused by duty ratios of a monitoring element and a light emitting element in each pixel.

A current flowing in an organic thin film is called a trap charge limited current (TCLC) and represented by the following formula (1).

$$J=S\cdot V^n \tag{1}$$

(J: current density, V: voltage, S: value determined by the material and structure of an EL element, n: value of two or more)

The following formula (2) can be obtained by modifying the formula (1).

$$\log J=n\cdot\log V+\log S \tag{2}$$

Figure 16:
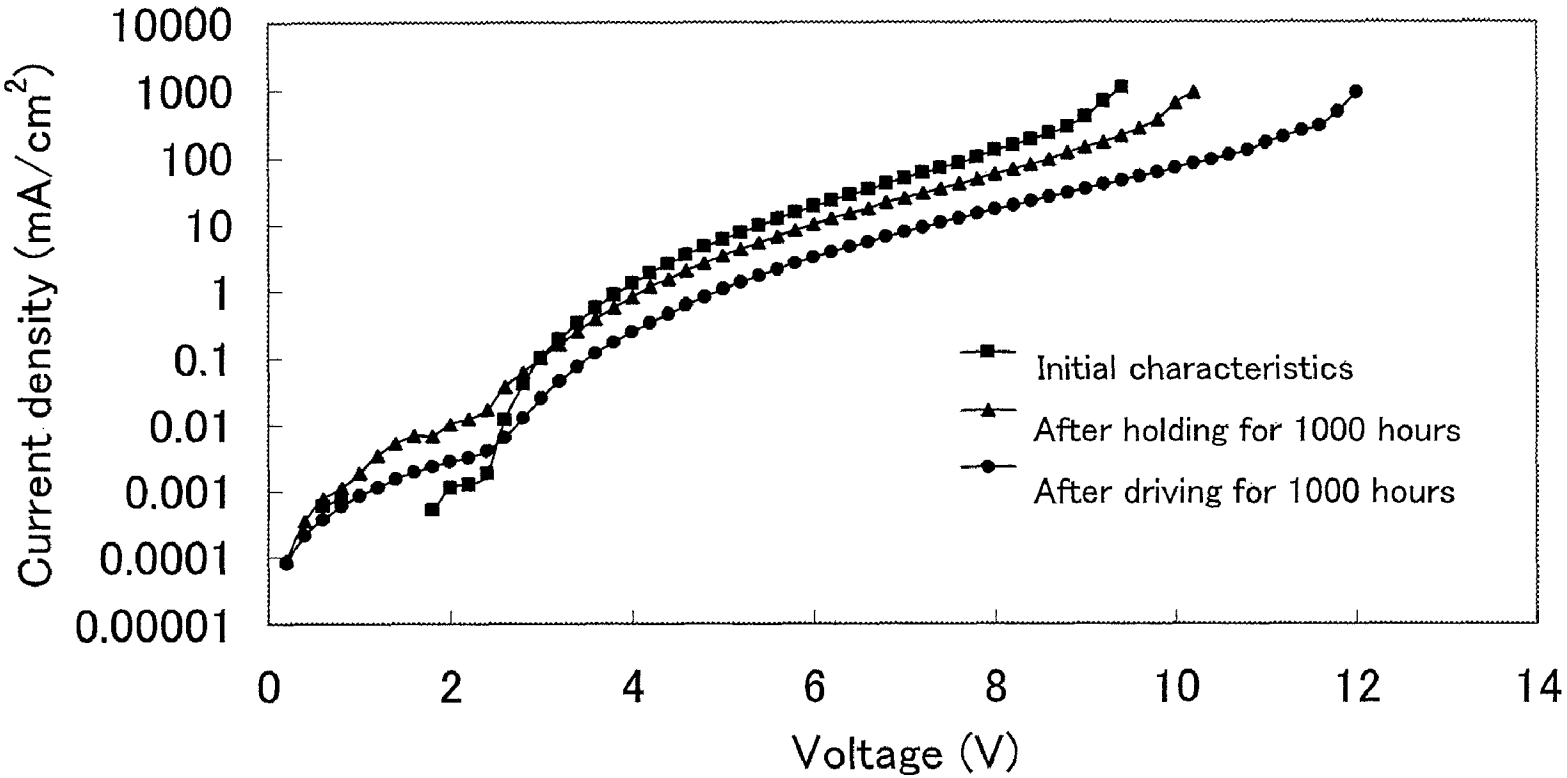
FIG. 16 is a graph showing I-V characteristics at the initial state, after being held for 1000 hours, and after being driven for 1000 hours.

The formula (2) is represented by a straight line with a slope of n. The smaller the value of log S becomes, the higher voltage side the straight line is shifted to. FIG. 16 is a graph showing I-V characteristics of an EL element having a certain element structure. The graph shows I-V characteristics in the initial state (denoted as initial characteristics in FIG. 16), I-V characteristics after being held for 1000 hours at room temperature (denoted as after holding for 1000 hours in FIG. 16), and I-V characteristics after being driven with a constant current for 1000 hours at room temperature (initial brightness is 1000 cd/m$^2$, and decreased by 30%) (denoted as after driving for 1000 hours in FIG. 16). The graph of FIG. 16 shows that the I-V characteristics are shifted to a higher voltage side than the initial characteristics after being held for 1000 hours without driving as well as after being driven for 1000 hours.

Figure 17:
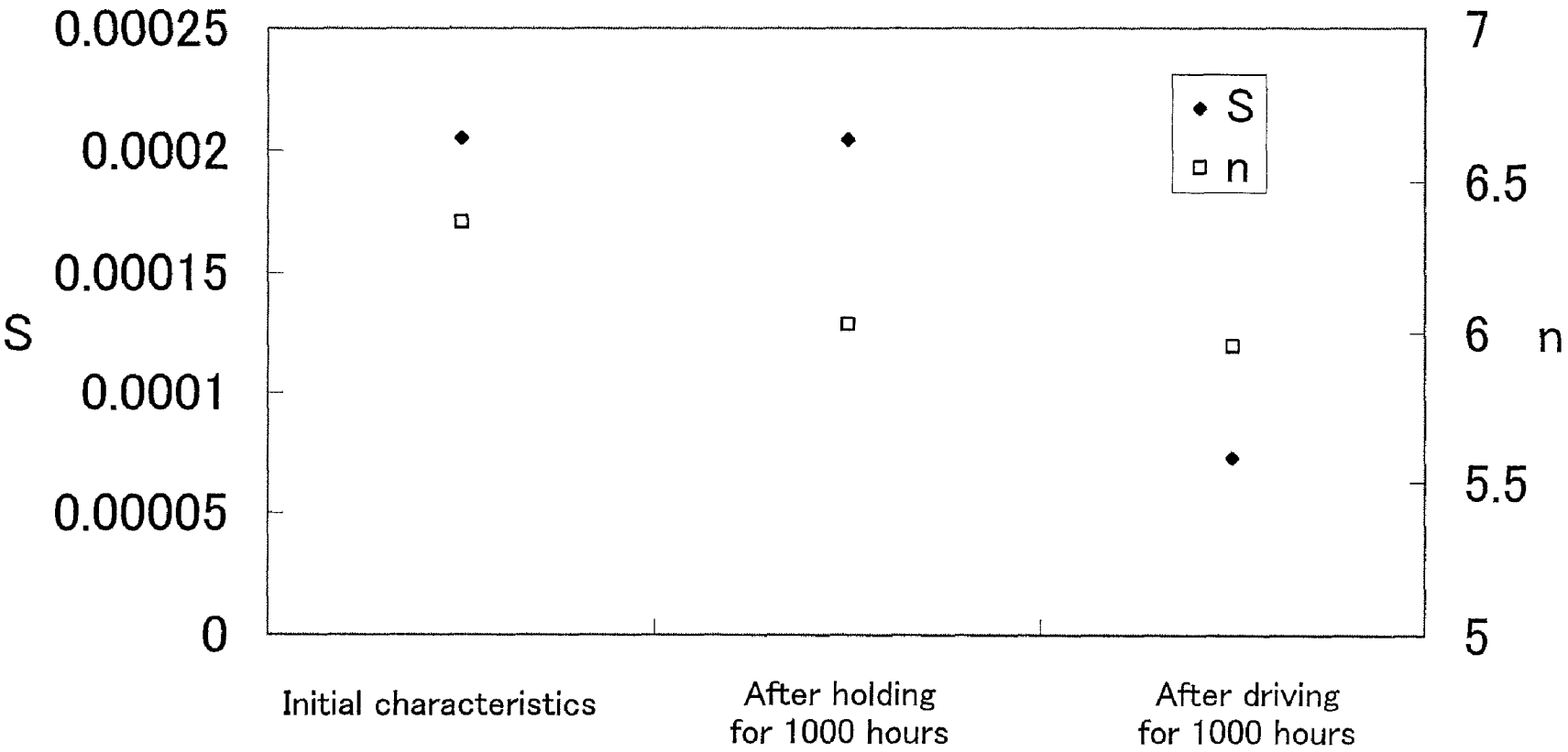
FIG. 17 is a graph showing changes of n and s at the initial state, after being held for 1000 hours, and after being driven for 1000 hours.

FIG. 17 shows changes in n and S in the initial state of the EL element, after being held for 1000 hours at room temperature, and after being driven with a constant current for 1000 hours at room temperature (initial brightness is 1000 cd/m$^2$, and decreased by 30%). Squares indicate n values while diamonds indicate S values. As shown in FIG. 17, the value of n decreases even when the light emitting element is held with no current supplied, and the rate of the decrease is substantially the same as the rate of decrease when the light emitting element is driven for 1000 hours with current supplied. That is, n is a parameter that decreases almost exclusively with time regardless of whether a current is supplied or not, and n can be represented by the following formula (3).

$$n=f(t) \tag{3}$$

On the other hand, S is a parameter that hardly changes when the light emitting element is held for 1000 hours and it decreases only when a current is supplied thereto. The value of S that is independent of time and varies with current can be represented as a function of the total amount of charge Q (current×time=[C]), and the following formula (4) can be obtained.

$$S=g(Q) \tag{4}$$

Since the value of S decreases when a current is supplied to the light emitting element, g(Q) is a monotonically decreasing function. From the formulas (1), (3) and (4), the I-V characteristics of the monitoring element and the I-V characteristics of the pixel can be represented by the following formulas (5) and (6).

$$J_o=g(Q_m)\cdot V^{f(t)} \tag{5}$$

$$J_p=g(Q_p)\cdot V^{f(t)} \tag{6}$$

$J_o$ is a current density (constant) of the monitoring element, $J_p$ is a current density of the pixel, $Q_m$ is a total amount of charge flowing in the monitoring element, $Q_p$ is a total amount of charge flowing in the pixel, V is a voltage, and t is time. From the formulas (5) and (6), the current density $J_p$ flowing in the pixel can be represented by the following formula (7).

$$J_p=J_o\cdot g(Q_p)/g(Q_m) \tag{7}$$

Since g(Q) is a monotonically decreasing function, when more charges are added to the monitoring element than the pixel which has a different duty ratio from that of the monitoring element, $J_p$ is always larger than $J_o$. The formula (7) represents the rate of rise of the current density $J_p$ of the pixel according to the compensation function of the invention. That is, the value of $J_p$ is required to increase according to a certain formula to ideally perform the constant brightness drive.

First, the following formula (8) can be obtained when the brightness of the pixel is L and current efficiency is η.

$$L=\eta\cdot J_p \tag{8}$$

Supposed that the initial brightness is $L_o$ and the initial current density is $J_o$, the current efficiency η is represented by the following degradation curve.

$$\eta=(L_o/J_o)\cdot\exp[-(k\cdot t)\beta] \tag{9}$$

(k is a rate constant and β is a parameter indicating the initial degradation. The rate herein means the rate at which a light emitting element becomes an element that emits no light, and the light emitting element degrades faster with a higher rate constant.) As a result, the following formula (10) can be obtained from the formulas (8) and (9).

$$L=J_p\cdot(L_o/J_o)\cdot\exp[-(k\cdot t)\beta] \quad (10)$$

In order to maintain the brightness constant, $L=L_o$ (constant) should be satisfied. Thus, when $L=L_o$ is substituted in the formula (10), the following formula (11) can be obtained.

$$J_p=J_o\cdot\exp[(k\cdot t)\beta] \quad (11)$$

In other words, the constant brightness drive can be achieved by increasing the value of $J_p$ in accordance with the formula (11). Finally, the following formula (12) can be obtained from the formulas (7) and (11).

$$g(Q_p)/g(Q_m)=\exp[(k\cdot t)\beta] \quad (12)$$

Further, the constant brightness drive can be achieved by selecting the values of $Q_p$ and $Q_m$ so that $g(Q_p)/g(Q_m)$ is close to $\exp[(k\cdot t)\beta]$. Therefore, the accuracy of degradation compensation can be improved by determining the duty ratios of the light emitting element and the monitoring element so as to satisfy the formula (12).

[Embodiment Mode 5]

Described in this embodiment mode is a method for correcting degradation with time of a light emitting element in a pixel during a period in which a display device does not display images. Description is made using the display devices shown in Embodiment Modes 1 to 3.

Changes with time of a light emitting element progress rapidly in the initial stages and gradually slow down with time. Accordingly, in a display device using a light emitting element, it is preferable to perform an initial aging process where initial changes with time occur in all the light emitting elements before adjustment of the brightness of the light emitting elements (e.g., before shipment of the display device). When initial drastic changes with time of a light emitting element occur in advance by such an initial aging process, changes with time do not progress rapidly thereafter, which reduces the phenomenon due to the changes with time, such as image burn-in.

The initial aging process is performed by activating a light emitting element only during a certain period, and preferably by applying a voltage higher than usual. According to this, initial changes with time occur in a short time.

If the display device of the invention operates using a rechargeable battery, it is preferable to perform, during charging the display device that is not in use, a process of lighting or flashing all the pixels, a process of displaying an image whose contrast is inverted relative to a normal image (e.g., standby image or the like), a process of sampling a video signal to detect a pixel that emits light at a low frequency and lighting or flashing the pixel, and the like. The aforementioned process is performed in order to reduce image burn-in during a period in which the display device is not in use, and called a flashout process. This flashout process can reduce image burn-in. Even when image burn-in occurs after the flashout process, the difference between the brightest point and the darkest point of the burned-in image can be set to five-level gray scale or less, and more preferably one-level gray scale or less. In order to reduce image burn-in, a fixed image may be reduced as much as possible in addition to the aforementioned process.

[Embodiment Mode 6]

Described in this embodiment mode is a current-driven passive matrix display device where a current is supplied from a current source to a monitoring element and a column signal line is precharged by using a voltage generated in the monitoring element.

Figure 28:
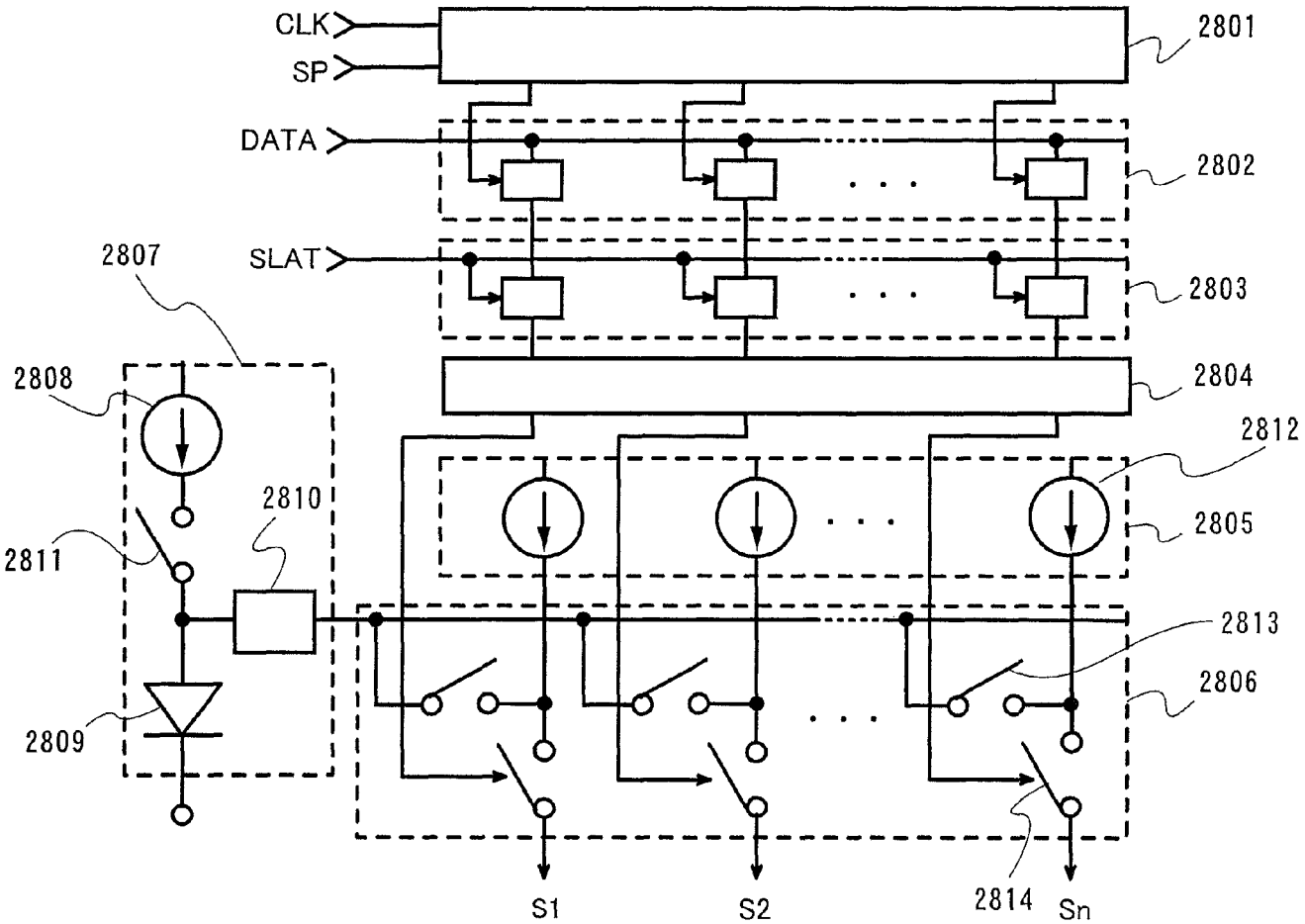
FIG. 28 is a diagram showing a column signal line driver circuit.

FIG. 28 is a schematic diagram of a column signal line driver circuit that can be applied to a passive matrix display device that performs gray scale display using different light emitting periods. That is, the same amount of current is supplied to each column signal line and the period for supplying the current is controlled to achieve gray scale display. Note that the column signal line driver circuit shown in this embodiment mode can be applied to the display device shown in FIG. 1, and thus Embodiment Mode 1 can be referred to for the operation of the pixel portion 103 and the row signal line driver circuit 102.

The display device shown in FIG. 28 includes a pulse output circuit 2801, a first latch circuit 2802, a second latch circuit 2803, a pulse width control circuit 2804, a current source circuit 2805, a switching circuit 2806, and a precharge circuit 2807.

The precharge circuit 2807 includes a current source 2808, a current supplying switch 2811, a monitoring element 2809, and an amplifier 2810. The current source 2808 is connected to an anode of the monitoring element 2809 through the current supplying switch 2811.

The switching circuit 2806 includes a lighting switch 2814 for selecting whether a current source 2812 in each stage of the current source circuit 2805 is electrically connected to each column signal line. The switching circuit 2806 also includes a precharging switch 2813 for selecting whether an output terminal of the amplifier 2810 is electrically connected to each column signal line to precharge a column signal line connected to the lighting switch 2814 that is turned on.

A clock signal (CLK), a start pulse signal (SP) and the like are inputted to the pulse output circuit 2801. Then, a sampling pulse is outputted from the pulse output circuit 2801 at the timing of these signals.

The sampling pulse outputted from the pulse output circuit 2801 is inputted to the first latch circuit 2802. At the timing of the sampling pulse, a video signal (DATA) that has been inputted to the first latch circuit 2802 is held in each stage of the first latch circuit 2802.

When a latch pulse (SLAT) is inputted to the second latch circuit 2803, the video signal (DATA) held in each stage of the first latch circuit 2802 is transferred to the second latch circuit 2803 at a time.

The signal held in the second latch circuit 2803 is converted into a pulse with a predetermined pulse width by the pulse width control circuit 2804. A period during which the lighting switch 2814 in each stage of the switching circuit 2806 is on is determined depending on the pulse width of the pulse outputted from the pulse width control circuit 2804. Then, a current is supplied to a selected row signal line through each of the column signal lines S1 to Sn from the current source 2812 in the current source circuit 2805 of the stage where the lighting switch 2814 is on.

Figure 29B:
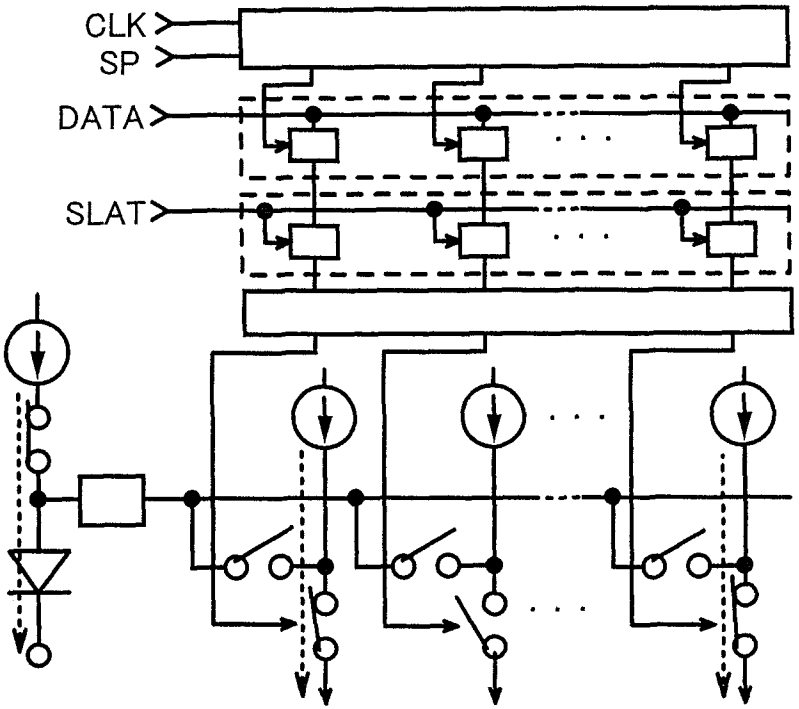
FIGS. 29A and 29B are diagrams each showing the operation of a column signal line driver circuit.
Figure 29A:
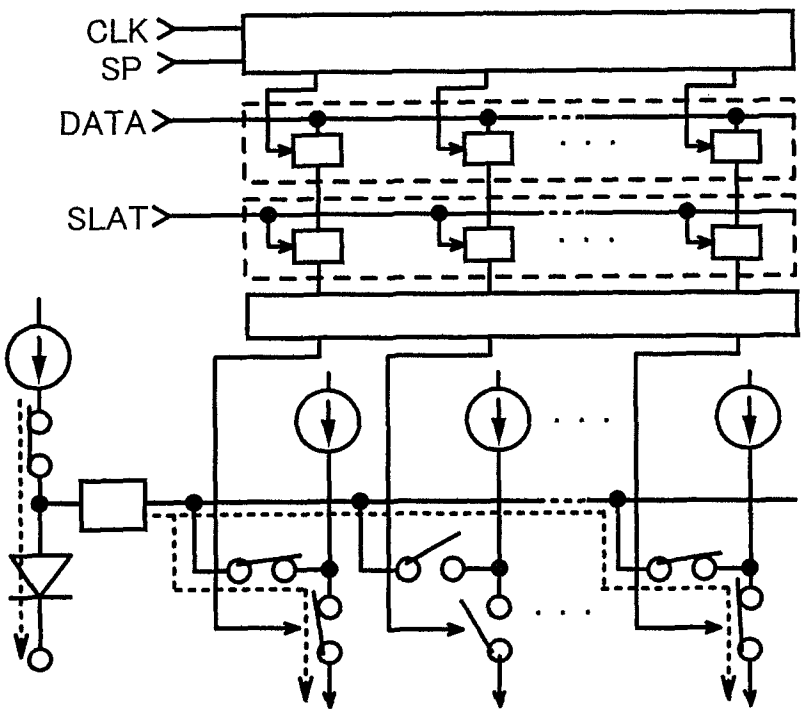

Note that each time a row signal line is selected, the current supplying switch 2811 and the precharging switch 2813 are turned on immediately before or simultaneously with selecting the row signal line. Then, a current is supplied from the current source 2808 to the monitoring element 2809 and a voltage is generated between two electrodes of the monitoring element 2809. The potential of the anode of the monitoring element 2809 at this time is inputted to an input terminal of the amplifier 2810, and a potential substantially equal to that of the input terminal is outputted from the amplifier 2810. The outputted potential is inputted to the column signal line through the switch 2813 of the stage where the lighting switch 2814 is on. At this time, a current flows as shown in FIG. 29A.

Then, the current supplying switch 2811 and the precharging switch 2813 are turned off immediately. Since the amplifier 2810 has a low output impedance, the potential of the column signal line can be made equal to the potential of the anode of the monitoring element 2809 quickly. In other words, the monitoring element 2809 is made of the same material as the light emitting element in the pixel, thus, a potential required for supplying the current of the current source 2802 to the light emitting element is inputted to the column signal line in advance. Accordingly, when the current source 2808 and the current source 2812 have the same amount of current, the light emitting element sandwiched between the selected row signal line and the column signal line of the stage where the lighting switch 2814 is on can emit light immediately. At this time, a current flows as shown in FIG. 29B.

Figure 32A:
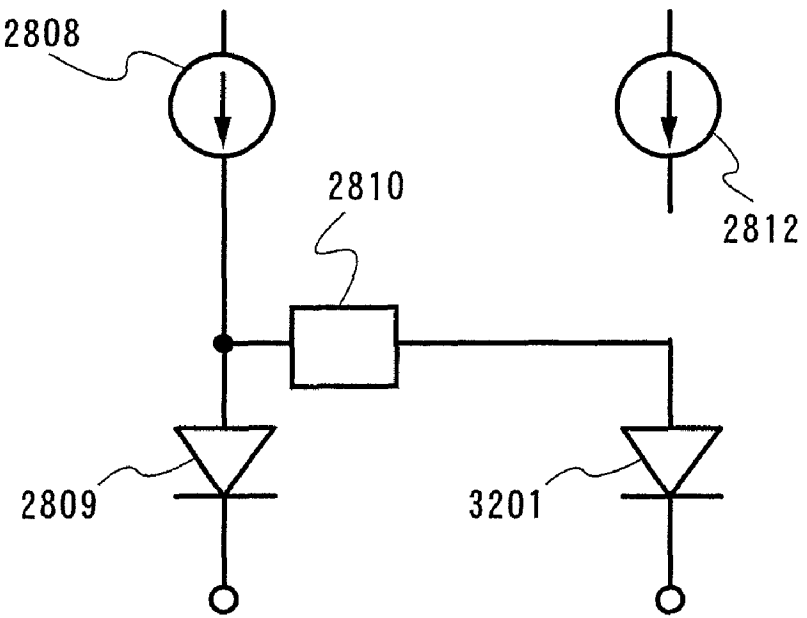
FIGS. 32A and 32B are diagrams each showing the connection of a column signal line driver circuit.
Figure 32B:
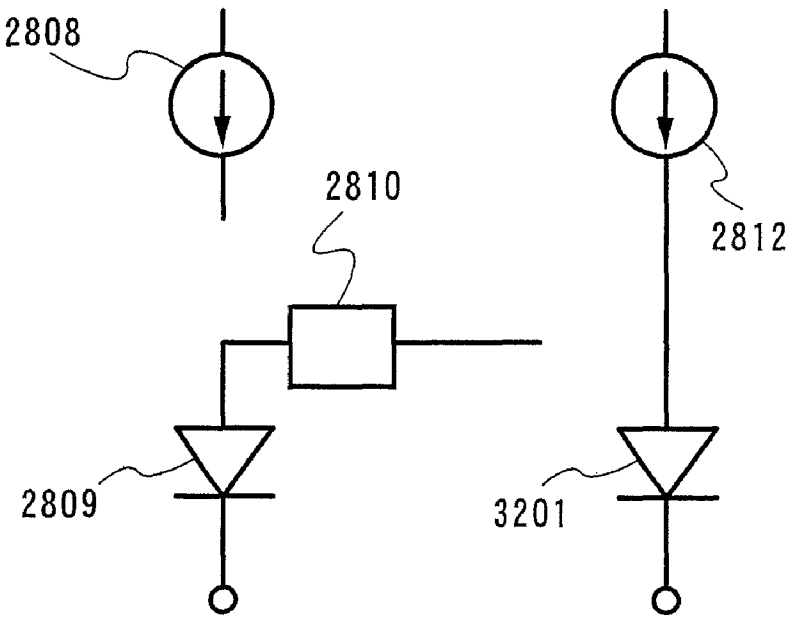
Figure 33B:
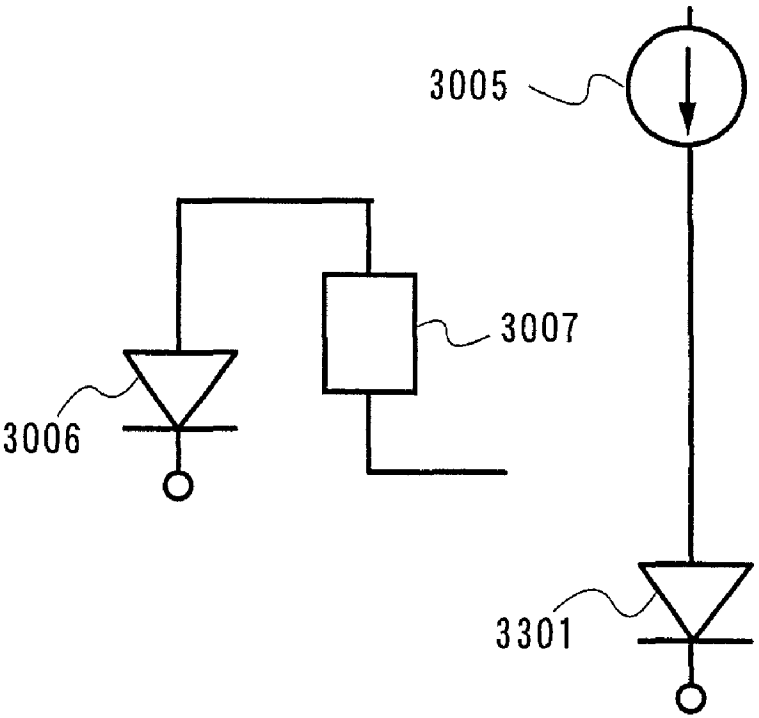
FIGS. 33A and 33B are diagrams each showing the connection of a column signal line driver circuit.
Figure 33A:
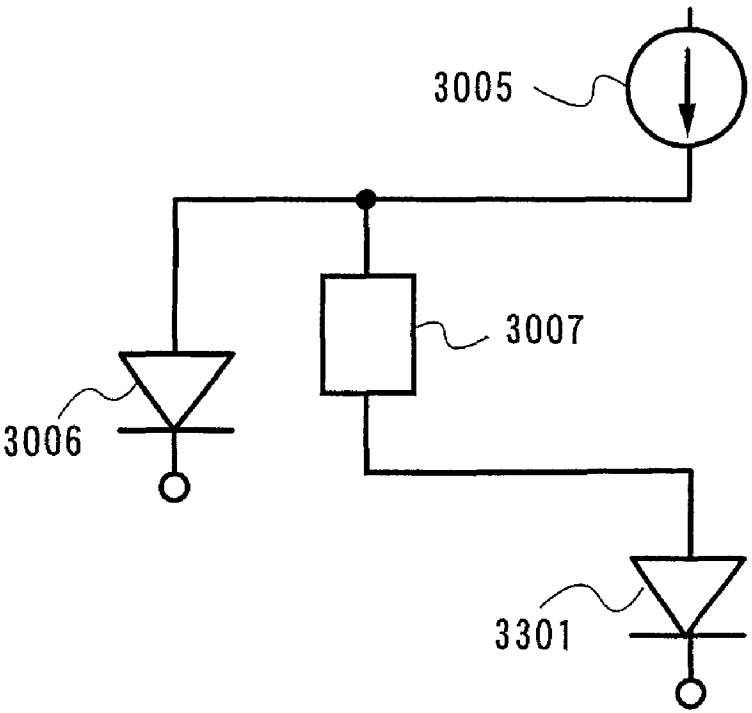

In other words, in a precharge period, as shown in FIG. 32A, the current source 2808 is electrically connected to the monitoring element 2809, and the input terminal of the amplifier 2810 is electrically connected to the anode of the monitoring element 2809 while the output terminal thereof is electrically connected to an anode of a light emitting element 3201. At this time, the current source 2812 is disconnected from the anode of the light emitting element 3201. Meanwhile, in a light emitting period, as shown in FIG. 32B, the current source 2808 is disconnected from the anode of the monitoring element 2809 while the current source 2812 is electrically connected to the anode of the light emitting element 3201. At this time, the output terminal of the amplifier 2810 is disconnected from the anode of the light emitting element 3201. This embodiment mode is not limited to the structure shown in FIG. 28 and such a connection may be adopted as well.

Figure 34:
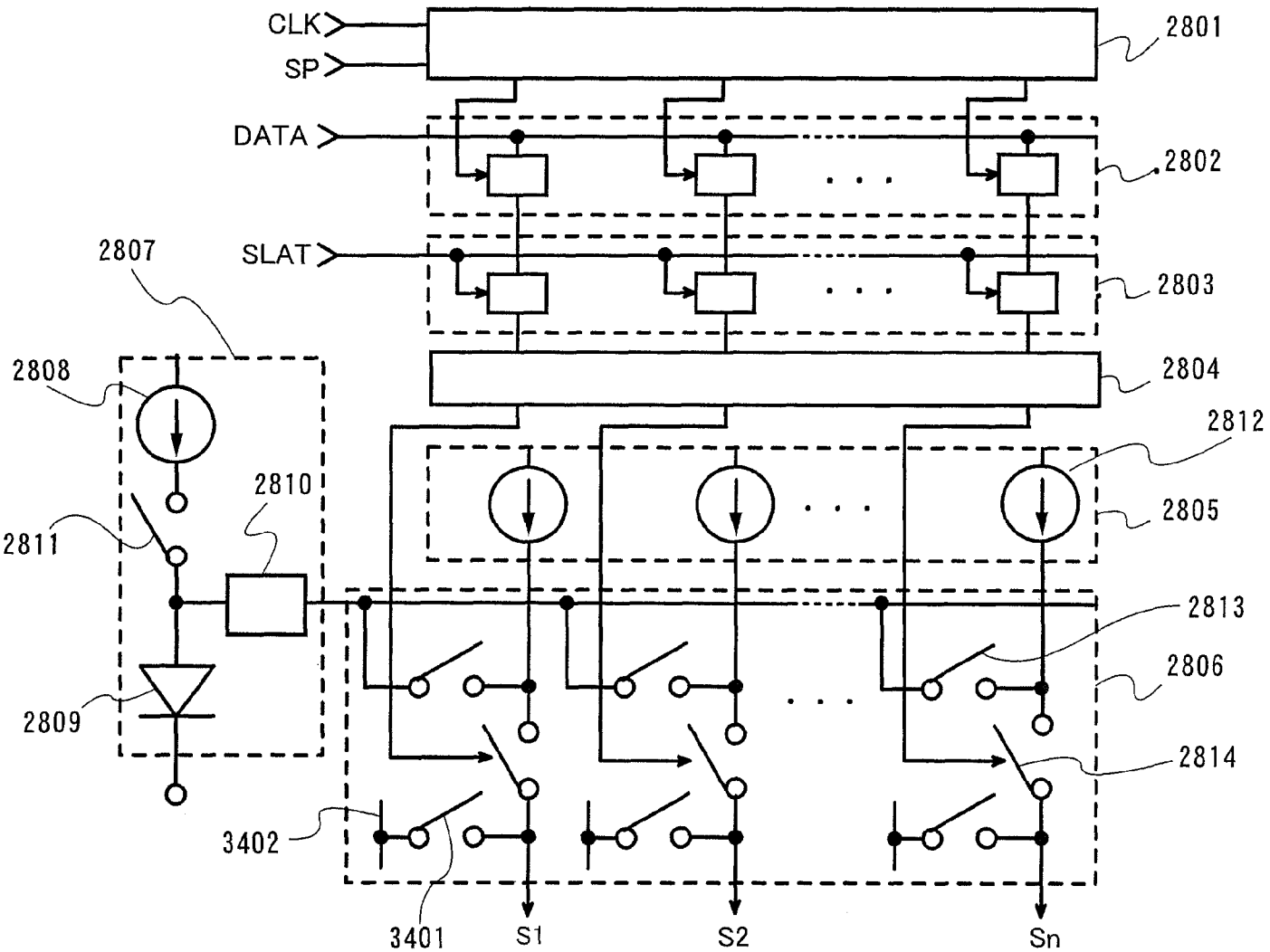
FIG. 34 is a diagram showing a column signal line driver circuit.

Alternatively, the potential may be inputted such that the light emitting element in a pixel emits no light immediately after the lighting switch 2814 is turned off. That is, as shown in FIG. 34, the column signal line may be connected to a wiring 3402 through a switch 3401 that is turned on when the lighting switch 2814 is turned off. Note that the wiring 3402 has a potential for turning off the light emitting element in a selected pixel.

Figure 36A:
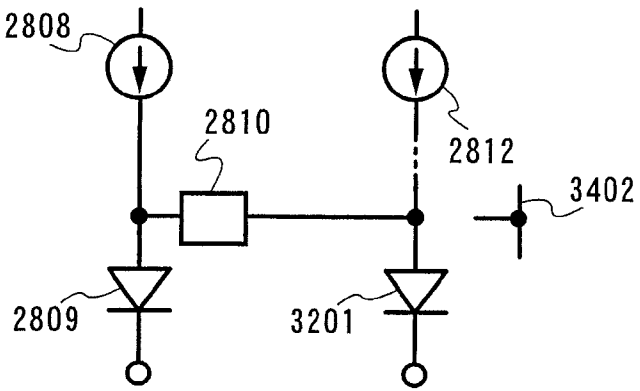
FIGS. 36A to 36C are diagrams each showing the connection of a column signal line driver circuit.

According to such a structure, in a precharge period, as shown in FIG. 36A, the current source 2808 is electrically connected to the anode of the monitoring element 2809, and the input terminal of the amplifier 2810 is electrically connected to the anode of the monitoring element 2809 while the output terminal thereof is electrically connected to the anode of the light emitting element 3201. The current source 2812 may be electrically connected to or disconnected from the anode of the light emitting element 3201. At this time, the wiring 3402 is disconnected from the anode of the light emitting element 3201 (column signal line).

Figure 36B:
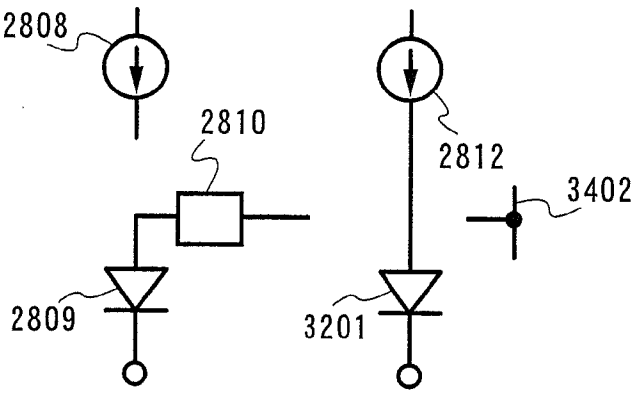

Meanwhile, in a light emitting period, as shown in FIG. 36B, the current source 2808 is disconnected from the anode of the monitoring element 2809 while the current source 2812 is electrically connected to the anode of the light emitting element 3201. At this time, the output terminal of the amplifier 2810 is disconnected from the anode of the light emitting element 3201 and the wiring 3402 is disconnected from the anode of the light emitting element 3201 (column signal line).

Figure 36C:
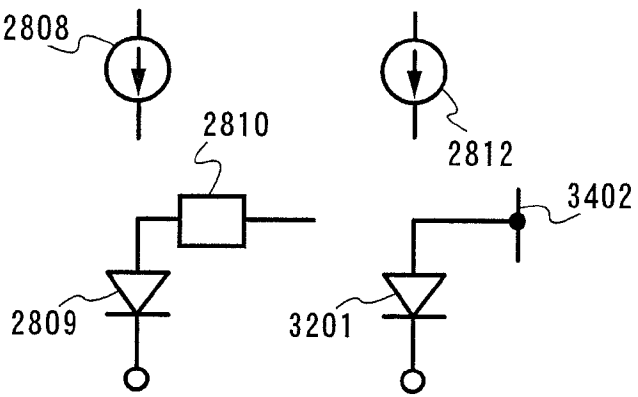

When the light emitting period of the pixels of the selected column is completed, as shown in FIG. 36C, the current source 2812 is disconnected from the anode of the light emitting element 3201 and the anode of the light emitting element 3201 is connected to the wiring 3402.

This embodiment mode is not limited to the structure shown in FIG. 34 and such a connection may be adopted as well.

Figure 30:
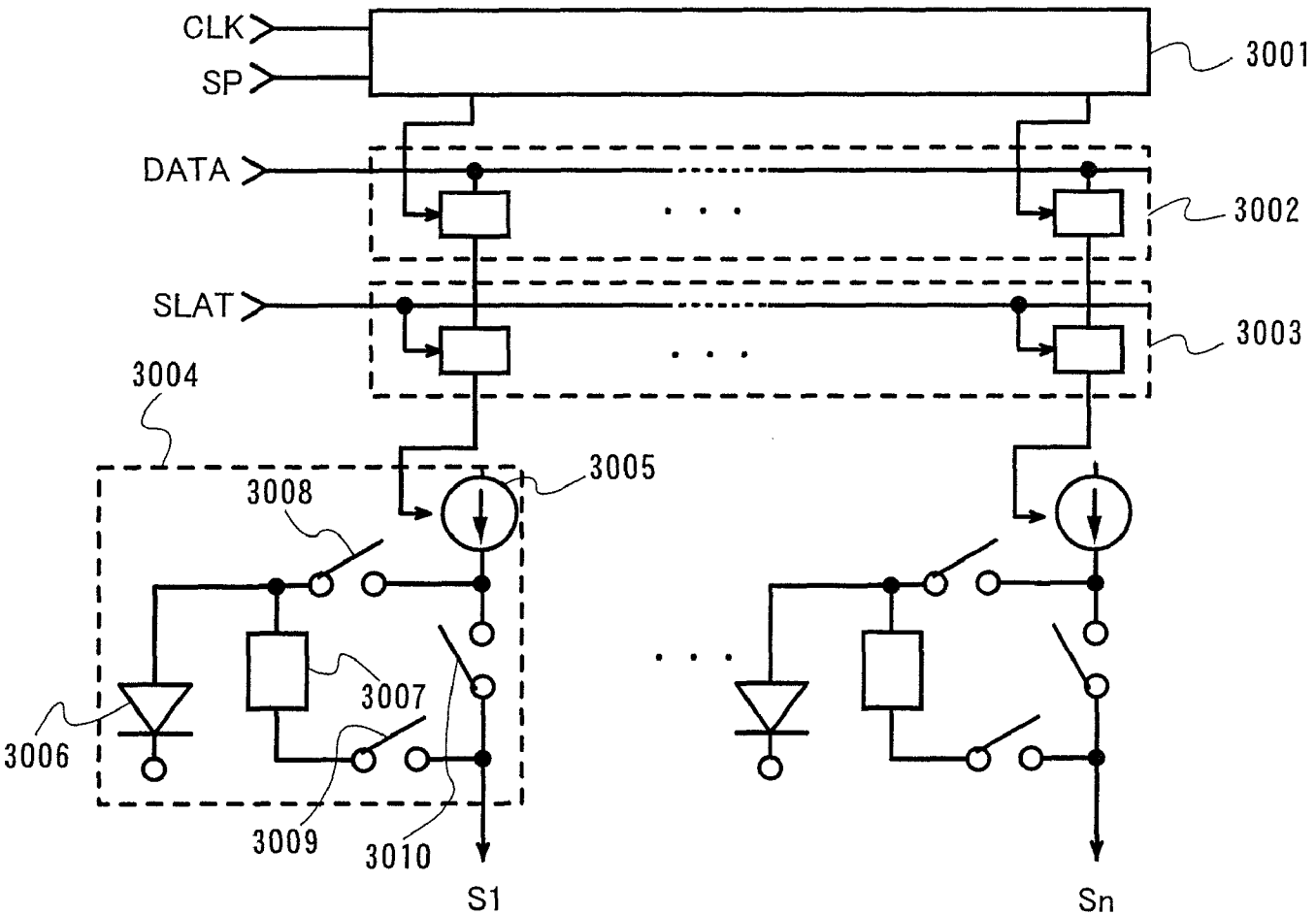
FIG. 30 is a diagram showing a column signal line driver circuit.

FIG. 30 is a schematic diagram of a column signal line driver circuit of a passive matrix display device that performs gray scale display using the difference in emission intensity.

The display device shown in FIG. 30 includes a pulse output circuit 3001, a first latch circuit 3002, a second latch circuit 3003, and a power supply circuit 3004. The power supply circuit 3004 includes a current source 3005, a monitoring element 3006, an amplifier 3007, a first precharging switch 3008, a second precharging switch 3009, and a lighting switch 3010.

A clock signal (CLK), a start pulse signal (SP) and the like are inputted to the pulse output circuit 3001. Then, a sampling pulse is outputted from the pulse output circuit 3001.

The sampling pulse outputted from the pulse output circuit 3001 is inputted to the first latch circuit 3002. At the timing of the sampling pulse, a video signal (DATA) that has been inputted to the first latch circuit 3002 is held in each stage of the first latch circuit 3002.

When a latch pulse (SLAT) is inputted to the second latch circuit 3003, the video signal held in each stage of the first latch circuit 3002 is transferred to the second latch circuit 3003 at a time.

The current value of the current source 3005 in the current supply circuit 3004 is determined by the video signal transferred to the second latch circuit 3003.

Figure 31B:
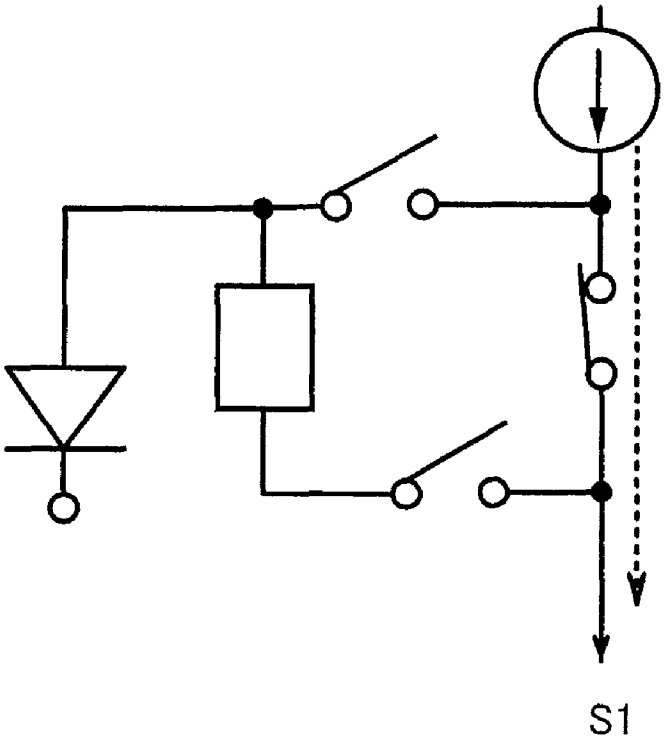
FIGS. 31A and 31B are diagrams each showing the operation of a column signal line driver circuit.
Figure 31A:
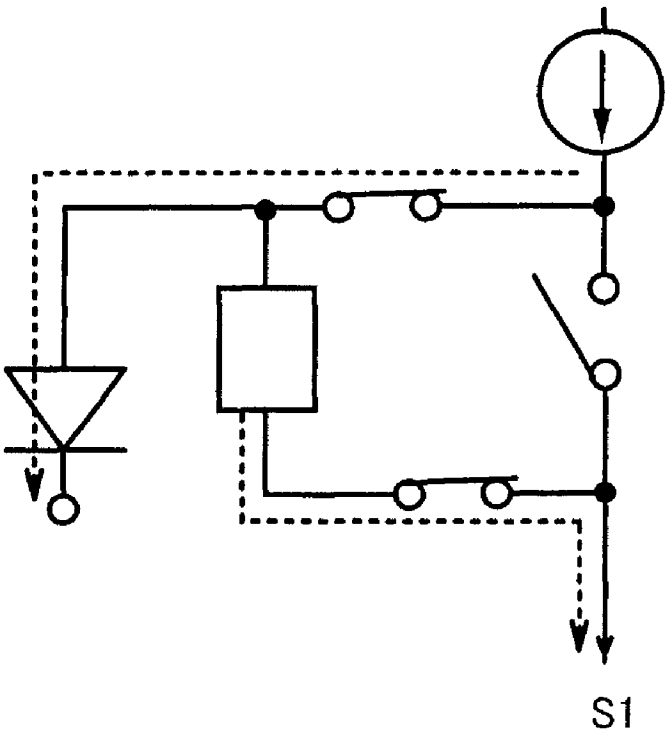

In a precharge period, the first precharging switch 3008 and the second precharging switch 3009 are turned on while the lighting switch 3010 is turned off. Then, a current is supplied from the current source 3005 to the monitoring element 3006 as shown in FIG. 31A, and a voltage is generated between two electrodes of the monitoring element 3006. At this time, the potential of an anode of the monitoring element 3006 is inputted to the amplifier 3007, and a potential substantially equal to the inputted potential is outputted from the amplifier 3007. Accordingly, a column signal line is charged with a potential so that the current from the current source 3005 is inputted to a light emitting element through the column signal line. Then, the first precharging switch 3008 and the second precharging switch 3009 are turned off while the lighting switch 3010 is turned on as shown in FIG. 31B. Thus, a current can be immediately supplied from the current source 3005 to the light emitting element through the column signal line.

That is, if the current value from the current source 3005 is small, it takes a long time to charge the load capacitance such as wire intersecting capacitance generated in the column signal line from the current source 3005, and thus brightness according to the video signal cannot be obtained. In this structure, however, the column signal line is charged with the current outputted from the amplifier 3007 in a precharge period, which allows the load capacitance of the column signal line to be charged immediately. Accordingly, a desired brightness can be obtained immediately.

Figure 35:
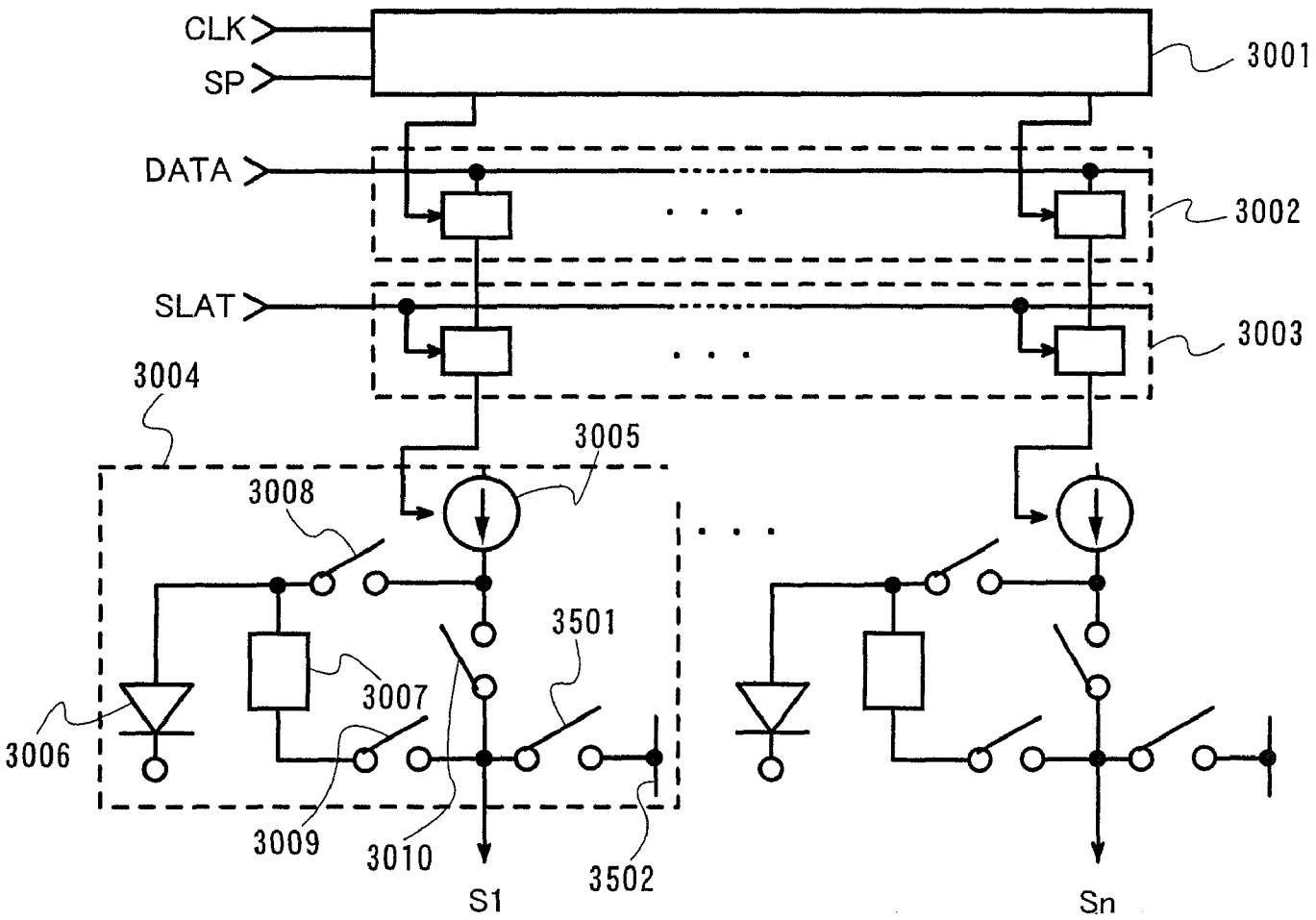
FIG. 35 is a diagram showing a column signal line driver circuit.

Alternatively, the potential may be inputted such that the light emitting element in a pixel emits no light immediately after the lighting switch 3010 is turned off. That is, as shown in FIG. 35, the column signal line may be connected to a wiring 3502 through a switch 3501 that is turned on when the lighting switch 3010 is turned off. Note that the wiring 3502 has a potential for turning off the light emitting element in a selected pixel.

Figure 37B:
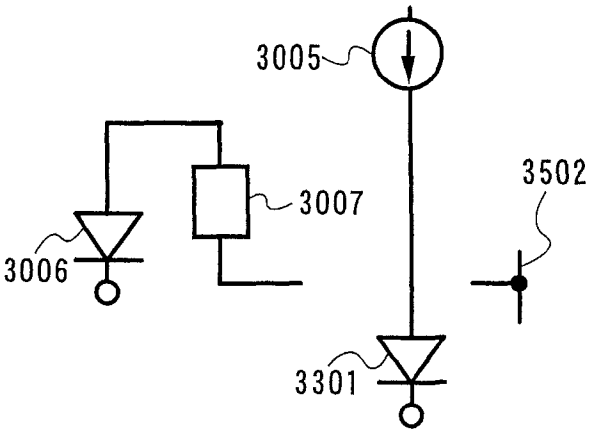
FIGS. 37A to 37C are diagrams each showing the connection of a column signal line driver circuit.
Figure 37A:
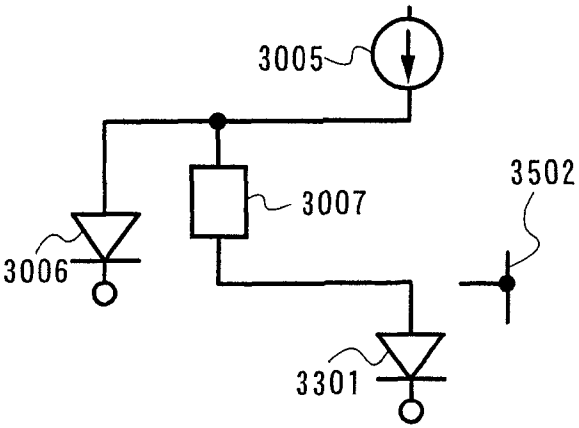

According to such a structure, in a precharge period, as shown in FIG. 37A, the current source 3005 is electrically connected to the monitoring element 3006, and the input terminal of the amplifier 3007 is electrically connected to the anode of the monitoring element 3006 while the output terminal thereof is electrically connected to the anode of the light emitting element 3301. At this time, the current source 3005 is disconnected from the light emitting element 3301, and the wiring 3502 is disconnected from the anode of the light emitting element 3301 (column signal line).

Meanwhile, in a light emitting period, as shown in FIG. 37B, the current source 3005 is disconnected from the anode of the monitoring element 3006 while the current source 3005 is electrically connected to the anode of the light emitting element 3301. At this time, the output terminal of the amplifier 3007 is disconnected from the anode of the light emitting element 3301 and the wiring 3502 is disconnected from the anode of the light emitting element 3301 (column signal line).

Figure 37C:
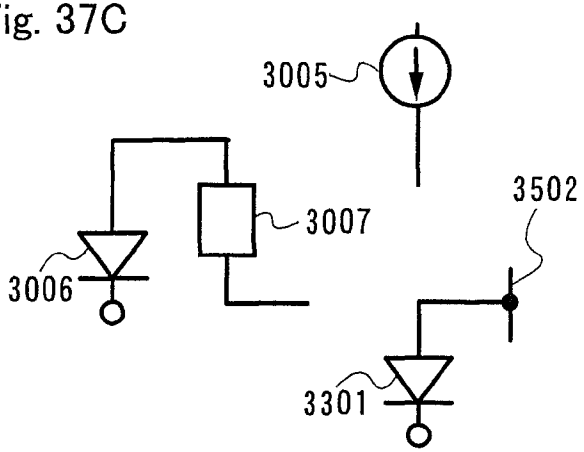

When the light emitting period of the pixels of the selected column is completed, as shown in FIG. 37C, the current source 3005 is disconnected from the anode of the light emitting element 3301 and the anode of the light emitting element 3301 is connected to the wiring 3502.

This embodiment mode is not limited to the structure shown in FIG. 35 and such a connection may be adopted as well.

[Embodiment Mode 7]

Described in this embodiment mode is a structure of a passive display panel that can be applied to the invention.

Figure 21A:
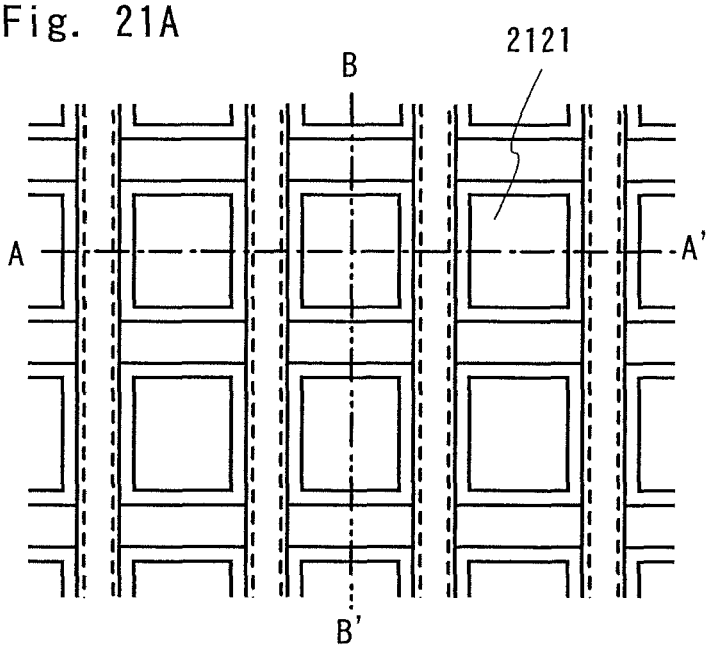
FIG. 21A is a top plan view of a display panel and FIGS. 21B and 21C are cross sectional views of the display panel.
Figure 21C:
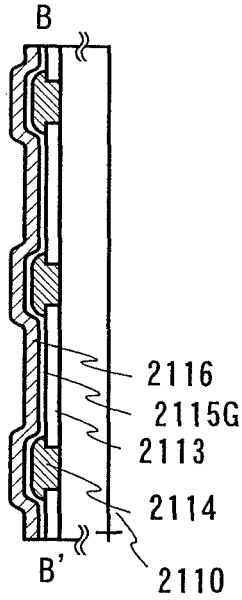
Figure 21B:
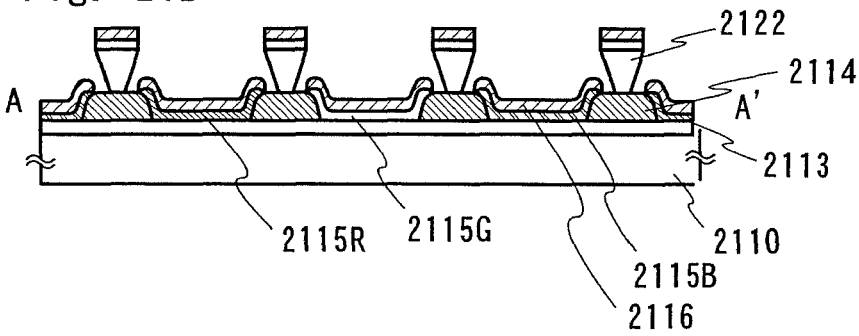

FIG. 21A is a top plan view of a pixel portion before sealing. FIG. 21B is a cross sectional view obtained by cutting along a dashed line A-A' of FIG. 21A and FIG. 21C is a cross sectional view obtained by cutting along a dashed line B-B' of FIG. 21A.

A plurality of first electrodes 2113 in the shape of strips are provided over a first substrate 2110 at regular intervals. A bank 2114 having an opening corresponding to each pixel is provided over each of the first electrodes 2113. The bank 2114 having an opening is made of a light shading material (a photosensitive or non-photosensitive organic material such as polyimide, acrylic, polyamide, polyimide amide, resist, or benzocyclobutene, which is dispersed black pigment or carbon black), or an SOG film (e.g., $SiO_x$ film containing an alkyl group). For example, the bank 2114 having an opening is made by using COLOR MOSAIC CK (product of Fuji Film Olin Corp.) or the like. The bank 2114 having an opening functions as a black matrix (BM). Note that an opening corresponding to each pixel serves as a light emitting area 2121. At this time, a monitoring element is integrated over the same substrate, which reduces variations in element characteristics and improves the accuracy of compensation function.

A plurality of banks 2122 in a reverse tapered shape are provided in parallel over the bank 2114 having an opening so as to intersect the first electrodes 2113. The bank 2122 in a reverse tapered shape is formed by using a positive photosensitive resin that remains as a pattern in a non-exposed area, and by controlling exposure dose or developing time so that the area under the pattern is etched more rapidly. The bank 2122 in a reverse tapered shape may also be made of the aforementioned light shading material to further increase the contrast. When the monitoring element is covered with the material of the bank 2122 at this time, light from the monitoring element can be shielded.

Figure 22:
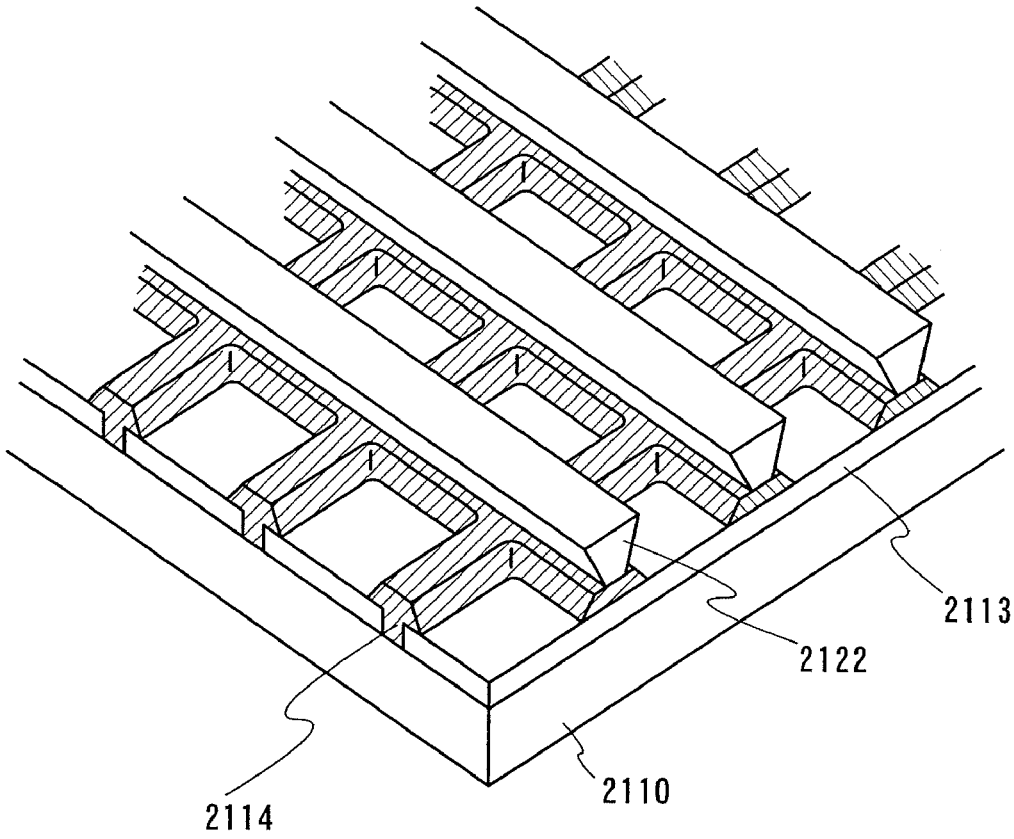
FIG. 22 is a perspective view of a display panel.

FIG. 22 is a perspective view immediately after the plurality of banks 2122 in a reverse tapered shape are formed in parallel. Note that the same portion as FIG. 21 is denoted by the same reference numeral.

The height of each of the banks 2122 in a reverse tapered shape is higher than the thickness of a film containing an organic compound and a conductive film. When a film containing an organic compound and a conductive film are stacked over the first substrate 2110 having the structure shown in FIG. 22, a plurality of areas electrically isolated from each other are obtained as shown in FIGS. 21A to 21C, thereby layers 2115R, 2115G and 2115B each containing an organic compound, and second electrodes 2116 are formed. The second electrodes 2116 in the shape of strips are provided in parallel and intersect the first electrodes 2113. Note that the film containing an organic compound and a conductive film are also formed over the banks 2122 in a reverse tapered shape, though they are separated from the layers 2115R, 2115G and 2115B each containing an organic compound, and the second electrodes 2116.

In this embodiment mode, the layers 2115R, 2115G and 2115B each containing an organic compound are selectively formed to obtain a full color light emitting display device that can emit three kinds of lights (R, G, and B). The layers 2115R, 2115G and 2115B each containing an organic compound are formed in a parallel strip pattern. Such a structure is preferably applied to the display device shown in FIG. 15 where the potential of the column signal line can be determined for each of R, G, and B.

Alternatively, it is also possible to form a layer containing an organic compound over the entire surface and provide a monochrome light emitting element, thereby a monochrome light emitting display device or an area color light emitting display device is obtained. Further alternatively, a white light emitting device may be combined with a color filter to obtain a full color light emitting display device. In that case, a color filter including only a colored layer may be used since the bank 2114 functions as a black matrix in the invention. Such a structure can be applied to the display device described in Embodiment Mode and Embodiment Modes 1 to 5, where the column signal lines have the same potential.

The light emitting element is sealed by attaching a second substrate with a sealing member. A protective film may be formed to cover the second electrodes 2116 if necessary. It is preferable that the second substrate has a capacity for highly blocking moisture. Further, if needed, an area surrounded by the sealing member may contain a drying agent.

If the first electrode 2113 is made of a light reflective conductive material while the second electrode 2116 is made of a light transmissive conductive material, a top emission light emitting device where light from the light emitting element is transmitted through the second substrate can be obtained. It is preferable that an aluminum alloy film containing carbon and nickel (Al(C+Ni)) be used for the first electrode 2113 as a single layer or a layer under a transparent conductive film, because contact resistance with indium tin oxide (ITO) or a transparent conductive material such as indium tin oxide containing Si (ITSO) does not change much even after energization or heat treatment. When the monitoring element is covered with the material of the bank 2122 in this case, light from the monitoring element can be shielded.

If the first electrode 2113 is made of a light transmissive conductive material while the second electrode 2116 is made of a light reflective conductive material, a bottom emission light emitting device where light from the light emitting element is transmitted through the first substrate 2110 can be obtained. In that case, a light shielding film is preferably formed under the monitoring element in advance.

If the first electrode 2113 and the second electrode 2116 are both made of a light transmissive conductive material, a light emitting device where light from the light emitting element is transmitted through both the second substrate and the first substrate can be obtained. In that case, the monitoring element is covered with the material of the bank 2122 and a light shielding film is formed under the monitoring element in advance, thereby light from the monitoring element can be shielded.

Figure 23:
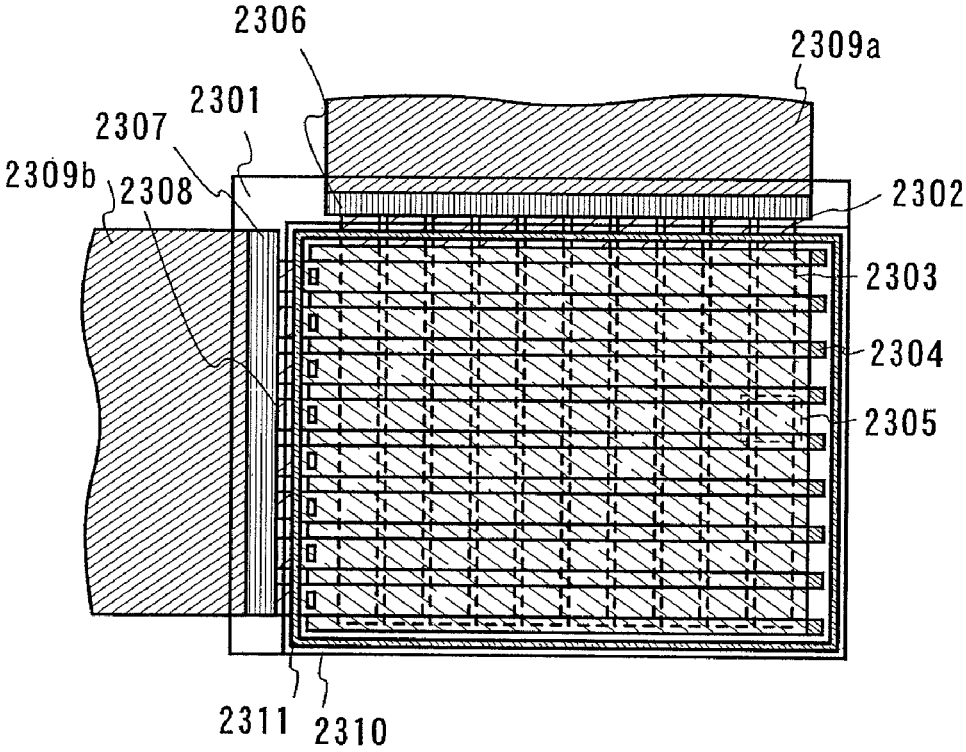
FIG. 23 is a top plan view showing an outline of a light emitting module.

FIG. 23 is a top plan view of a light emitting module where an FPC and the like are incorporated after sealing the light emitting element.

Note that the light emitting device in this specification means an image displaying device, a light emitting device, or a light source (including a lighting device). The light emitting device also includes a module where a light emitting device is provided with a connecter, for example such as an FPC (Flexible Printed Circuit), a TAB (Tape Automated Bonding) tape and a TCP (Tape Carrier Package), a module where a printed wiring board is attached to the end of a TAB tape or a TCP, and a module where an IC (Integrated Circuit) is directly incorporated by COG (Chip On Glass).

A first substrate 2301 and a second substrate 2310 are attached with a sealing member 2311 so as to face each other. The sealing member 2311 may be formed by using a photo curable resin, and more preferably, a material with little degasification and low hydroscopicity. Further, the sealing member 2311 may be added with a filler (a stick or fiber spacer) or a spherical spacer in order to keep the distance between the substrates constant. The second substrate 2310 is preferably made of a material having the same thermal expansion coefficient as the first substrate 2301, and glass (including quartz glass) or plastic may be employed.

As shown in FIG. 23, a pixel portion for displaying images has row signal lines and column signal lines that perpendicularly intersect each other.

The first electrode 2113 in FIG. 21 corresponds to a column signal line 2302 in FIG. 23, the second electrode 2116 corresponds to a row signal line 2303, and the bank 2122 in a reverse tapered shape corresponds to a bank 2304. A layer containing an organic compound is sandwiched between the column signal line 2302 and the row signal line 2303, and an intersection denoted as 2305 corresponds to one pixel.

The end of the row signal line 2303 is electrically connected to a connection wiring 2308, and the connection wiring 2308 is connected to an FPC 2309*b* through an input terminal 2307. The column signal line 2302 is connected to an FPC 2309*a* through an input terminal 2306.

If necessary, an optical film such as a polarizer, a circular polarizer (including an elliptic polarizer), a wave plate (a quarter-wave plate, a half-wave plate), and a color filter may be provided on the emission surface. Further, an antireflection film may be provided on the polarizer or the circular polarizer. For example, antiglare treatment may be performed to reduce reflected glare by diffusing reflected light due to the unevenness of the surface. Alternatively, antireflection treatment for heating the polarizer or the circular polarizer may be performed as well. Hard coat treatment is preferably performed thereafter in order to protect the polarizer or the circular polarizer from external impact. However, the polarizer or the circular polarizer decreases light extraction efficiency, and the polarizer or the circular polarizer itself is expensive and degrades easily.

According to the invention, a black bank (also called a partition wall) functioning as a black matrix (BM) is provided between pixels on the substrate side over which the light emitting element is provided, and stray light from the light emitting element is absorbed or shielded, leading to improved display contrast.

An example of a manufacturing method of a light emitting module incorporating an IC chip is described with reference to FIGS. 24A and 24B and FIG. 25.

First, a column signal line (anode) 2402 having a stacked structure where a reflective metal film and a transparent conductive oxide film are stacked in this order is formed over a first substrate 2401. At the same time, connection wirings 2408, 2409*a* and 2409*b*, and an input terminal are formed. At this time, a monitoring element group 2415 is simultaneously formed.

Subsequently, a bank having an opening corresponding to each pixel is formed. The bank having an opening is made by using COLOR MOSAIC CK (product of Fuji Film Olin Corp.). Then, a bank 2404 in a reverse tapered shape is provided over the bank having an opening so as to intersect the column signal line 2402.

Figure 24A:
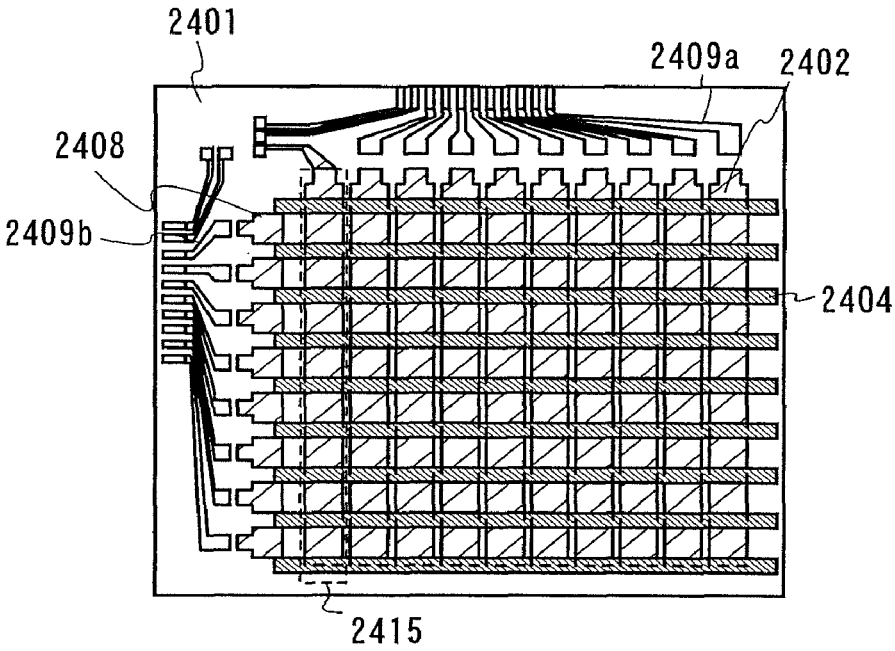
FIGS. 24A and 24B are top plan views of a light emitting module.

FIG. 24A is a top plan view in the state where the aforementioned steps are completed.

Figure 24B:
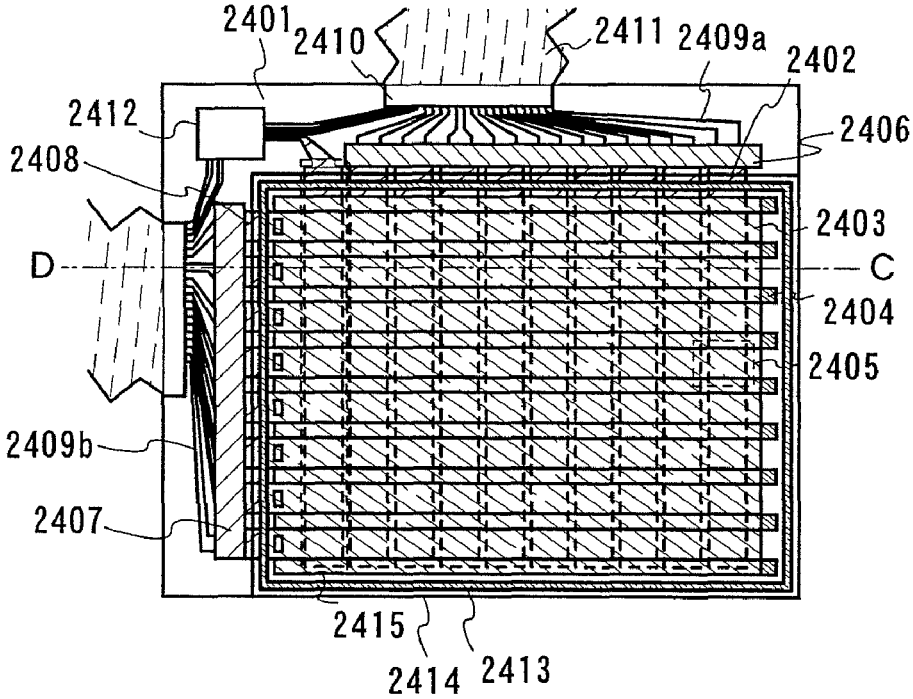

When a film containing an organic compound and a transparent conductive film are stacked, a plurality of areas electrically isolated from each other are obtained as shown in FIG. 24B, thereby a row signal line 2403 including a transparent conductive film and a layer containing an organic compound are formed. The row signal line 2403 including the transparent conductive film is an electrode formed in a parallel stripe pattern so as to intersect the column signal line 2402.

A second substrate 2414 having light transmissivity is attached with a sealing member 2413.

At the periphery of the pixel portion, a column signal line IC 2406 and a row signal line IC 2407 each including a driver circuit for transmitting each signal to the pixel portion are incorporated by COG. The ICs may be incorporated by TCP or wire bonding as well as COG. The TCP is a TAB tape provided with an IC, where an IC is incorporated by connecting a TAB tape to a wiring over an element substrate. The column signal line IC 2406 and the row signal line IC 2407 may be formed by using a silicon substrate, or a driver circuit including TFTs formed over a glass substrate, a quartz substrate or a plastic substrate. Although FIG. 24B shows an example where one IC is provided on one side, it may be divided into a plurality of ICs to be provided on one side.

The end of the row signal line 2403 is electrically connected to the connection wiring 2408, and the connection wiring 2408 is connected to the row signal line IC 2407. This is because it is difficult to form the row signal line IC 2407 over the bank 2404 in a reverse tapered shape.

The column signal line IC 2406 formed in this manner is connected to an FPC 2411 through the connection wiring 2409*a* and the input terminal 2410. The row signal line IC 2407 is connected to an FPC through the connection wiring 2409*a* and the input terminal.

In addition, an IC chip 2412 (memory chip, CPU chip, power supply circuit chip or the like) is incorporated for integration.

Figure 25:
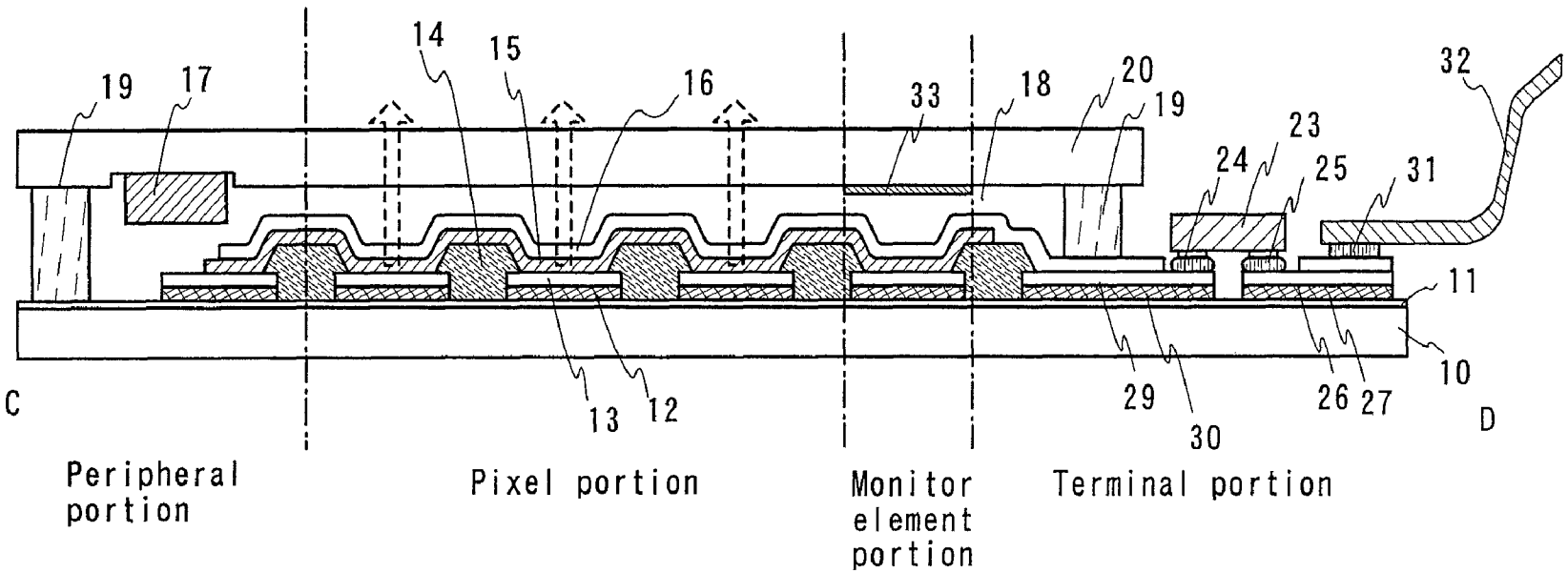
FIG. 25 is a cross sectional view of a light emitting module.

The light emitting module shown in FIGS. 24A and 24B and FIG. 25 can be applied to the display device shown in FIG. 19. That is, the row signal line IC 2407 corresponds to the row signal line driver circuit 1402 in FIG. 19, while the column signal line IC 2406 corresponds to the column signal line driver circuit in FIG. 19. The monitoring element group 2415 corresponds to the monitoring elements 1901*a* to 1901*m* in FIG. 19. The IC chip 2412 includes the current source 1405 and the amplifier 1404.

FIG. 25 shows an example of a cross sectional structure obtained by cutting along a dashed line C-D of FIG. 24B.

A base insulating film 11 is formed over a first substrate 10, and a column signal line having a stacked structure is formed thereover. A bottom layer 12 is a reflective metal film and a top layer 13 is a transparent conductive oxide film. The top layer 13 is preferably formed by using a conductive film having a high work function. For example, it is possible to use indium tin oxide (ITO), a transparent conductive material such as indium tin oxide containing Si (ITSO) and indium zinc oxide (IZO) obtained by mixing 2 to 20% of zinc oxide (ZnO) into indium oxide, or a film containing a compound obtained by combing these materials. In particular, ITSO is suitable for the anode of the light emitting element since it is not crystallized and remains in an amorphous state even after baking, and thus ITSO has higher uniformity than ITO and is not easily short-circuited with the cathode even when a layer containing an organic compound is thin.

The bottom layer 12 is made of Ag, Al, or Al(C+Ni) alloy. In particular, an Al(C+Ni) film (an aluminum alloy film containing carbon and nickel (1 to 20 wt %)) is preferably used since contact resistance with ITO or ITSO does not change much even after energization or heat treatment.

A bank 14 for isolating adjacent column signal lines is made of a black resin, and functions as a boundary between different colored layers (provided on a sealing substrate side) or a black matrix (BM) overlapping the gap. Each area surrounded by the black bank corresponds to a light emitting area having the same area.

A layer 15 containing an organic compound has a stacked structure where an HIL (hole injection layer), an HTL (hole transporting layer), an EML (light emitting layer), an ETL (electron transporting layer), and an EIL (electron injection layer) are stacked in this order from the column signal line (anode) side. The layer containing an organic compound may have a single layer structure or a mixed layer structure as well as the stacked layer structure.

A row signal line 16 (cathode) is formed to intersect the column signal line (anode). The row signal line 16 (cathode) is made of a transparent conductive material such as ITO, indium tin oxide containing Si (ITSO), and indium zinc oxide (170) obtained by mixing 2 to 20% of zinc oxide (ZnO) into indium oxide. Since the invention shows an example of a top emission light emitting device where light is transmitted through a sealing substrate 20, it is important that the row signal line 16 is transparent.

Not all light from the layer 15 containing an organic compound is transmitted through the row signal line 16 and the sealing substrate (second substrate) 20, and some light is emitted in the horizontal direction (direction parallel to the surface of the substrate). However, the light emitted in the horizontal direction cannot be extracted, which results in wasted light. Meanwhile, according to the invention, stray light from the light emitting element can be absorbed or shielded by the bank 14 containing a black resin.

A transparent protective film covering the row signal line 16 may be provided in order to protect the light emitting element from damage due to moisture and degasification. The transparent protective film is preferably formed by using a dense inorganic insulating film formed by PCVD (SiN (silicon nitride) film, SiNO (silicon nitride oxide) film or the like), a dense inorganic insulating film formed by sputtering (SiN film, SiNO film or the like), a thin film mainly containing carbon (DLC film, CN film, amorphous carbon film), a metal oxide film ($WO_2$, $CaF_2$, $Al_2O_3$ or the like), and the like. The transparent film means that visible light transmittance is 80 to 100%.

A pixel portion including the light emitting element and a monitoring element portion are sealed with a sealing member 19 and the second substrate 20 to tightly seal the surrounded space. Further, a shielding film may be provided over the monitoring element portion to prevent light from being transmitted outside.

The sealing member 19 may be formed by using a UV ray curable resin, a heat curable resin, a silicone resin, an epoxy resin, an acrylic resin, a polyimide resin, a phenol resin, PVC (polyvinyl chloride), PVB (polyvinyl butyral), or EVA (ethylene vinyl acetate). The sealing member 19 may be added with a filler (a stick or fiber spacer) or a spherical spacer.

A glass substrate or a plastic substrate is used for the second substrate 20. The plastic substrate may be formed by using polyimide, polyamide, an acrylic resin, an epoxy resin, PES (polyether sulfone), PC (polycarbonate), PET (polyethylene terephtalate), or PEN (polyethylene naphthalate) in the form of plate or film.

A sealed space 18 is filled with a dry inert gas. The sealed space 18 surrounded by the sealing member 19 is dried completely by removing a small amount of moisture by a drying agent 17. The drying agent 17 may be formed by using a material that absorbs moisture by chemisorption, and an alkaline earth metal oxide such as calcium oxide and barium oxide may be used for example. Note that a material that absorbs moisture by physisorption, such as zeolite and silica gel may also be used as the drying agent 17.

A terminal electrode is formed at the end of the substrate 10, to which an FPC (Flexible Printed Circuit) 32 connected to an external circuit is attached. The terminal electrode has a stacked structure of a reflective metal film 30, a transparent conductive oxide film 29, and a conductive oxide film extending from a second electrode, though the invention is not limited to this.

The FPC 32 may be connected by using an anisotropic conductive material or a metal bump, or by wire bonding. In FIG. 25, the FPC 32 is connected by using an anisotropic conductive adhesive 31.

An IC chip 23 including a driver circuit for transmitting each signal to the pixel portion is electrically connected to the periphery of the pixel portion by anisotropic conductive materials 24 and 25. In order to obtain a pixel portion corresponding to the color display, 3072 column signal lines and 768 row signal lines are required in the case of XGA. Such column signal lines and row signal lines are divided into several blocks at the end of the pixel portion, and grouped in accordance with the pitch of output terminals of the IC by using lead wirings. Note that reference numeral 33, 26, and 27 denote a light shading film, a transparent conductive film, and reflective metal film, respectively.

Described above is a top emission light emitting device where light from the light emitting element is emitted in the direction shown by arrows in FIG. 25. The black bank 14 increases the display contrast of the light emitting device.

An example of a display panel provided with an optical film is described with reference to FIG. 26A.

An optical film 26121 is formed over a second substrate 26120 that is provided so as to face a first substrate 26110. In this embodiment mode, light from a light emitting element is emitted in the direction shown by arrows in FIG. 26A, namely the light is transmitted through the second substrate 26120 and then the optical film 26121. However, the invention is not limited to this, and the optical film 26121 may be formed over the second substrate 26110 on a side of the first substrate such that light from the light emitting element is transmitted through the optical film 26121 and then the second substrate 26120.

The optical film 26121 means an optical film such as a polarizer, a circular polarizer (including an elliptic polarizer), a wave plate (a quarter-wave plate, a half-wave plate), and a color filter.

A light emitting element in a pixel of a passive matrix light emitting device is structured by a column signal line (anode) having a stacked structure of a bottom layer 26112 made of a reflective metal film and a top layer 26113 made of a transparent conductive oxide film, a layer 26115 containing an organic compound, and a row signal line 26116 made of a transparent conductive film. A bank 26114 is made of a light shading material.

If a circular polarizer is used as the optical film 26121, it can be prevented that external light is reflected on the bottom layer 26112 and the visibility of images is reduced. Specifically, a circular polarizer denotes a circular polarizer (including an elliptic polarizer) having a combination of a wave plate (film) that has phase difference characteristics of $\lambda/4$ or $\lambda/4+\lambda/2$, and a polarizing plate (film) or a linear polarizing film. A broad band quarter-wave plate herein gives a certain phase difference (90°) in the range of visible light. In specific, a circular polarizer is one in which the angle between a transmission axis of a polarizer and a slow axis of a wave plate is 45°. Note that in this specification, a circular polarizer includes a circular polarizing film.

If a light emitting element emits white light and a color filter is used as the optical film 26121, a full color display device can be obtained.

Several kinds of optical films may be combined arbitrarily.

An example of a bottom emission light emitting device is described with reference to FIG. 26B.

Figure 26A:
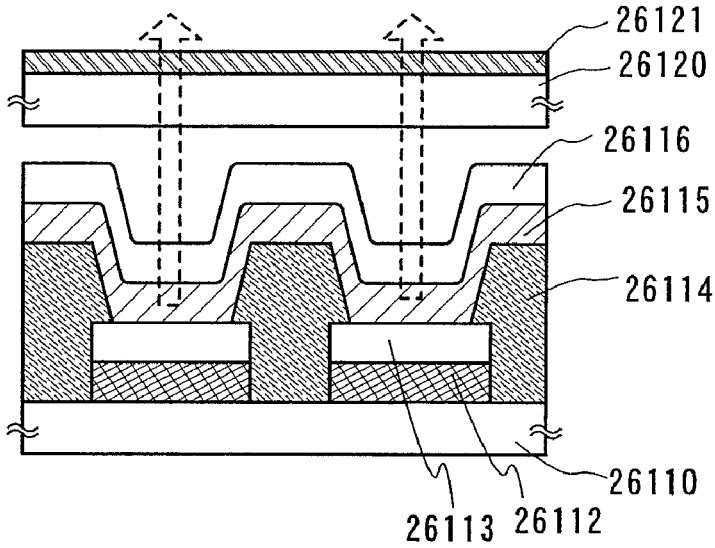
FIGS. 26A to 26C are diagrams showing the light emitting direction.
Figure 26B:
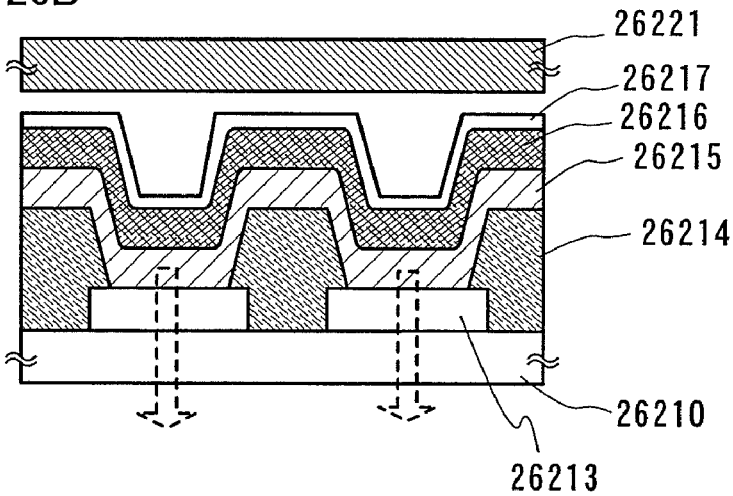

A light emitting element in FIG. 26B is structured by a column signal line (anode) 26213 made of a transparent conductive oxide film, a layer 26215 containing an organic compound, and a row signal line 26216 made of a reflective conductive film. A bank 26214 is made of a light shielding material.

Light from the light emitting element is emitted in the direction shown by arrows in FIG. 26B, namely, transmitted through a first substrate 26210. Accordingly, a second substrate 26221 does not necessarily transmit light and may be a metal plate. A thick protective film 26217 can be formed to improve reliability of the light emitting element without decreasing light extraction efficiency.

The structure shown in FIG. 26 can be freely combined with Embodiment Mode and Embodiment Modes 1 to 5. If an optical film is provided in such a case, the optical film may be provided over the first substrate 26210.

An example of a light emitting device that is different from those shown in FIGS. 26A and 26B is described with reference to FIG. 26C.

Figure 26C:
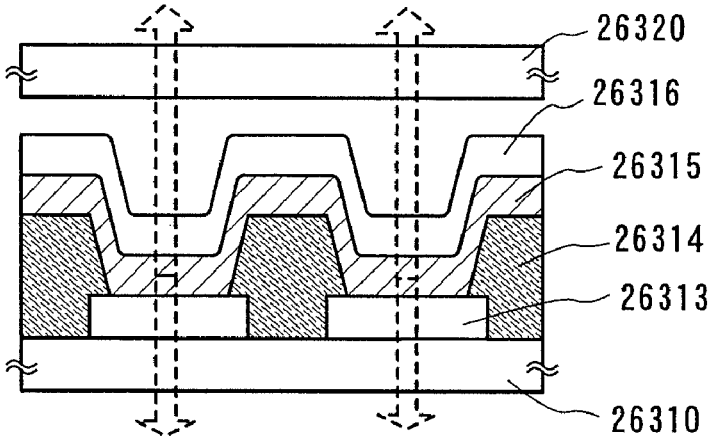

A light emitting element in FIG. 26C is structured by a column signal line (anode) 26313 made of a transparent conductive oxide film, a layer 26315 containing an organic compound, and a row signal line 26316 made of a transparent conductive oxide film. A bank 26314 is made of a light shielding material.

Light from the light emitting element is emitted in the directions shown by arrows in FIG. 26C, namely, transmitted through both a first substrate 26310 and a second substrate 26320. Accordingly, both the first substrate 26310 and the second substrate 26320 are formed by using a light transmissive substrate.

The structure shown in FIG. 26C can be freely combined with Embodiment Mode and Embodiment Modes 1 to 5. If an optical film is provided in such a case, optical films may be provided over the first substrate 26310 and the second substrate 26320.

Figure 27:
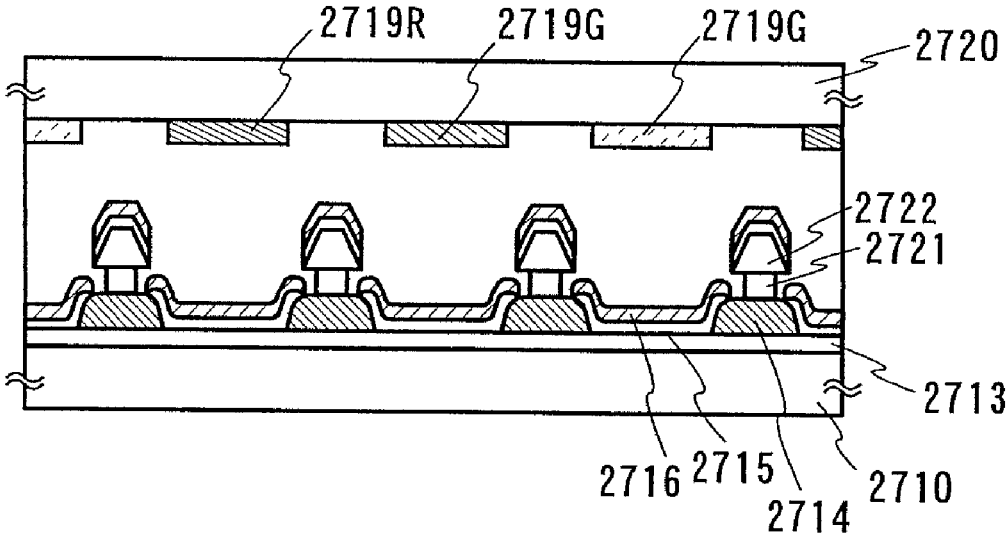
FIG. 27 is a cross sectional view showing a structure of a display panel.

FIG. 27 shows an example of a bank that does not have a reverse tapered shape but has a forward tapered shape. The structure shown in FIG. 27 is the same as those in FIGS. 21A to 21C except for the form of a bank and a light emitting element (white emission).

Similarly to FIGS. 21A to 21C, a first electrode 2713 in the shape of strips is formed over a first substrate 2710. In FIG. 27, a bank 2714 having an opening is formed over the first electrode 2713, and a bank including a spacer 2721 and a wide overhanging portion 2722 formed thereon is provided over the bank 2714.

The spacer 2721 is formed by using an organic resin film such as polyimide, and the overhanging portion 2722 is formed by using a photosensitive resin film such as resist. An organic resin film such as polyimide is formed and a photosensitive resin film such as resist is formed thereon so as to form a pattern for separating electrodes. Then, an exposed organic resin film is etched under conditions such that an undercut is formed under the pattern of the photosensitive resin. These steps produce an element separating portion having an overhanging structure, namely a bank.

In FIG. 27, the bank 2714 having an opening, the spacer 2721, or the overhanging portion 2722 is made of a light transmissive material to increase contrast.

When a layer containing an organic compound and a transparent conductive film are formed after forming the bank shown in FIG. 27, a layer 2715 containing an organic compound and a second electrode 2716 that are separated from each other can be obtained.

In FIG. 27, the layer 2715 containing an organic compound has a stacked structure where a green light emitting layer including $Alq_3$ doped with coumarin 6 and a yellow light emitting layer including TPD doped with rubrene are stacked, thereby a white light emitting element is obtained. According to this embodiment mode, the manufacturing time of a passive matrix light emitting device can be reduced since the step of applying different colors for each light can be omitted.

In order to perform full color display, a color filter including colored layers 2719R, 2719G and 2719B is provided over a second substrate 2720 so as to face the pixel including a white light emitting element.

The structure shown in FIG. 27 can be applied to the display device shown in Embodiment Mode and Embodiment Modes 1 to 5 in the case where each column signal line has the same potential. The pixel portion includes only white light emitting elements, therefore, variations in element characteristics can be suppressed when monitoring elements are made of the same material as the light emitting elements, leading to further increased accuracy of a compensation function.

[Embodiment Mode 7]

A display device having a pixel area including a light emitting element can be applied to various electronic apparatuses such as a television set (television, television receiver), a digital camera, a digital video camera, a mobile phone set (mobile phone), a portable information terminal such as a PDA, a portable game machine, a monitor, a computer, an audio reproducing device such as a car audio system, and an image reproducing device provided with a recording medium such as a home game machine. The display device of the invention can be applied to display portions of these electronic apparatuses. Specific examples of the electronic apparatuses are described with reference to FIGS. 18A to 18F.

Figure 18A:
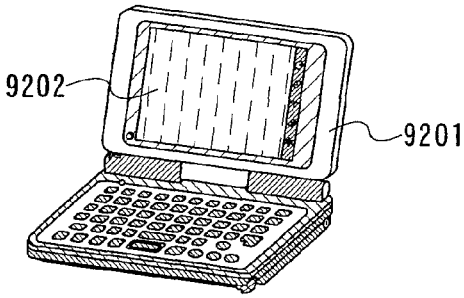
FIGS. 18A to 18F are views showing electronic apparatuses each having a display device of the invention.
Figure 18B:
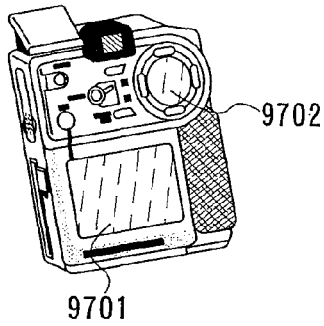
Figure 18C:
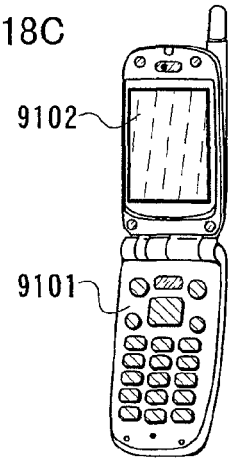
Figure 18D:
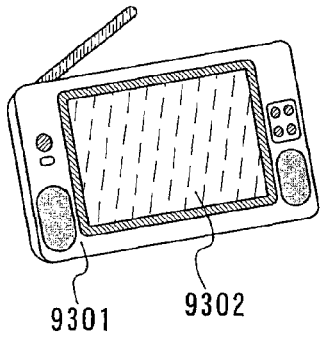
Figure 18E:
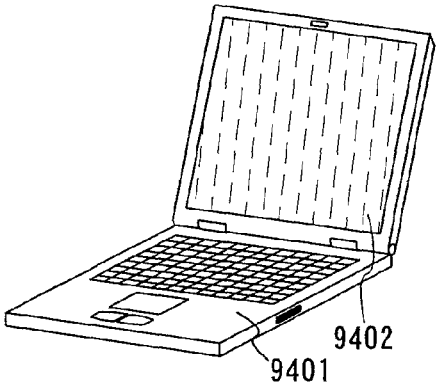
Figure 18F:
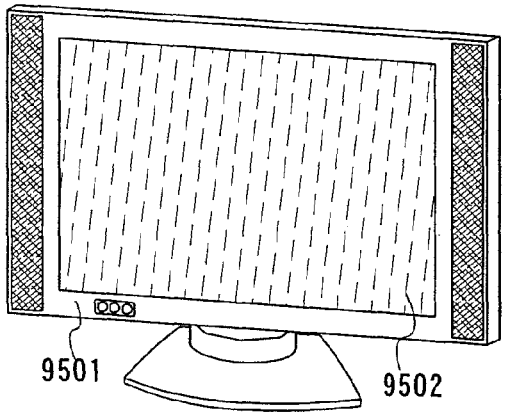

FIG. 18A shows a portable information terminal using the display device of the invention, which includes a main body 9201, a display portion 9202 and the like. The invention reduces the power consumption of the portable information terminal. FIG. 18B shows a digital video camera using the display device of the invention, which includes display portions 9701 and 9702 and the like. The invention reduces the power consumption of the digital video camera. FIG. 18C shows a mobile phone using the display device of the invention, which includes a main body 9101, a display portion 9102 and the like. The invention reduces the power consumption of the mobile phone. FIG. 18D shows a portable television set using the display device of the invention, which includes a main body 9301, a display portion 9302 and the like. The invention reduces the power consumption of the portable television set. FIG. 18E shows a portable computer using the display device of the invention, which includes a main body 9401, a display portion 9402 and the like. The invention reduces the power consumption of the portable computer. FIG. 18F shows a television set using the display device of the invention, which includes a main body 9501, a display portion 9502 and the like. The invention reduces the power consumption of the television set. If the aforementioned electronic apparatuses use a rechargeable battery, the life of them increases with reduction in power consumption, thereby the charge of the rechargeable battery can be saved.

As set forth above, the display device of the invention can be applied to various electronic apparatuses.

The display device of the invention having a compensation function can be called a constant brightness display device since it can maintain the brightness constant. Further, a driving method of the display device of the invention having a compensation function can be called a constant brightness driving method (constant brightness method, constant luminescence method, brightness control method, control brightness method, or bright control method). According to this driving method, as set forth above, an increase in current due to a compensation function and a decrease in current due to changes with time are obtained in advance, and a light emitting element is driven at a voltage where the increase is equal to the decrease.

This application is based on Japanese Patent Application serial No. 2004-192256 filed in Japan Patent Office on Jun. 29, 2004, the entire contents of which are hereby incorporated by reference.

What is claimed is:

1. A display device comprising:
a pixel;
a light emitting element;
an amplifier;
a first switch;
a second switch;
a third switch;
a first line;
a second line;
a first power supply line; and
a second power supply line,
wherein the pixel is electrically connected to the first line and the second line,
wherein the light emitting element is electrically connected to the second line,
wherein the amplifier is electrically connected to a first terminal of the first switch,
wherein a second terminal of the first switch is electrically connected to the first line,
wherein the second line is electrically connected to a first terminal of the second switch and a first terminal of the third switch,
wherein a second terminal of the second switch is electrically connected to the first power supply line, and
wherein a second terminal of the third switch is electrically connected to the second power supply line.

2. The display device according to claim 1, wherein the first power supply line is electrically connected to an input terminal of the amplifier.

3. The display device according to claim 1, wherein the light emitting element comprises a red light emitting element.

4. The display device according to claim 1, wherein the light emitting element comprises a green light emitting element.

5. The display device according to claim 1, wherein the light emitting element comprises a blue light emitting element.

6. The display device according to claim 1, wherein the light emitting element comprises a first electrode, a second electrode, and a light emitting layer interposed between the first electrode and the second electrode.

7. The display device according to claim 1, wherein the display device is incorporated in an electronic apparatus selected from the group consisting of a television, a digital camera, a digital video camera, a mobile phone, a portable information terminal, PDA, a portable game machine, a monitor, a computer, an audio reproducing device, a car audio system, an image reproducing device provided with a recording medium, and a home game machine.

8. A display device comprising:
a pixel;
a light emitting element;
a first amplifier;
a second amplifier;
a first switch;
a second switch;
a third switch;
a first line;
a second line;
a first power supply line; and
a second power supply line,
wherein the pixel is electrically connected to the first line and the second line,
wherein the light emitting element is electrically connected to the second line,
wherein the first amplifier is electrically connected to a first terminal of the first switch,
wherein the second amplifier is electrically connected to the first power supply line,
wherein a second terminal of the first switch is electrically connected to the first line,
wherein the second line is electrically connected to a first terminal of the second switch and a first terminal of the third switch,
wherein a second terminal of the second switch is electrically connected to the first power supply line, and
wherein a second terminal of the third switch is electrically connected to the second power supply line.

9. The display device according to claim 8, wherein the light emitting element comprises a red light emitting element.

10. The display device according to claim 8, wherein the light emitting element comprises a green light emitting element.

11. The display device according to claim 8, wherein the light emitting element comprises a blue light emitting element.

12. The display device according to claim 8, wherein the light emitting element comprises a first electrode, a second electrode, and a light emitting layer interposed between the first electrode and the second electrode.

13. The display device according to claim 8, wherein the display device is incorporated in an electronic apparatus selected from the group consisting of a television, a digital camera, a digital video camera, a mobile phone, a portable information terminal, PDA, a portable game machine, a monitor, a computer, an audio reproducing device, a car audio system, an image reproducing device provided with a recording medium, and a home game machine.

14. A display device comprising:
a pixel;
a light emitting element;

a first amplifier;
a second amplifier;
a third amplifier;
a first switch;
a second switch;
a third switch;
a first line;
a second line;
a first power supply line; and
a second power supply line,
wherein the pixel is electrically connected to the first line and the second line,
wherein the light emitting element is electrically connected to the second line,
wherein the first amplifier is electrically connected to a first terminal of the first switch,
wherein the second amplifier is electrically connected to the first power supply line,
wherein the third amplifier is electrically connected to the second power supply line,
wherein a second terminal of the first switch is electrically connected to the first line,
wherein the second line is electrically connected to a first terminal of the second switch and a first terminal of the third switch,
wherein a second terminal of the second switch is electrically connected to the first power supply line, and
wherein a second terminal of the third switch is electrically connected to the second power supply line.

15. The display device according to claim 14, wherein the light emitting element comprises a red light emitting element.

16. The display device according to claim 14, wherein the light emitting element comprises a green light emitting element.

17. The display device according to claim 14, wherein the light emitting element comprises a blue light emitting element.

18. The display device according to claim 14, wherein the light emitting element comprises a first electrode, a second electrode, and a light emitting layer interposed between the first electrode and the second electrode.

19. The display device according to claim 14, wherein the display device is incorporated in an electronic apparatus selected from the group consisting of a television, a digital camera, a digital video camera, a mobile phone, a portable information terminal, PDA, a portable game machine, a monitor, a computer, an audio reproducing device, a car audio system, an image reproducing device provided with a recording medium, and a home game machine.

* * * * *